US007607958B1

(12) United States Patent
Hochmayr et al.

(10) Patent No.: US 7,607,958 B1
(45) Date of Patent: Oct. 27, 2009

(54) MARINE ENGINE

(75) Inventors: Markus Hochmayr, Krenglbach (AT); Roland Ennsmann, Wels (AT); Robert Plomberger, St. Georgen i.A. (AT); Karl Glinsner, Wels (AT); Michael Dopona, Wartberg (AT); Richard Winkoff, Marchtrenk (AT)

(73) Assignee: BRP-Powertrain GmbH & Co KG, Gunskirchen (AT)

( * ) Notice: Subject to any disclaimer, the term of this patent is extended or adjusted under 35 U.S.C. 154(b) by 8 days.

(21) Appl. No.: 11/684,343

(22) Filed: Mar. 9, 2007

Related U.S. Application Data

(60) Provisional application No. 60/780,450, filed on Mar. 9, 2006.

(51) Int. Cl.
*B63H 23/00* (2006.01)

(52) U.S. Cl. ..... 440/75; 440/83; 440/89 R

(58) Field of Classification Search ..... 440/52, 440/75, 83, 89 R, 55, 56, 57, 64; 123/559.1, 123/561, 563
See application file for complete search history.

(56) References Cited

U.S. PATENT DOCUMENTS 1,745,235 A * 1/1930 Svendsen et al. ..... 440/56
4,392,832 A * 7/1983 Moberg ..... 440/49
4,925,414 A * 5/1990 Newman ..... 440/83
4,972,809 A * 11/1990 Hirasawa ..... 440/89 R
5,421,756 A * 6/1995 Hayasaka ..... 440/89 R
6,273,772 B1 * 8/2001 Smullin ..... 440/89 R
6,358,109 B1 * 3/2002 Neisen ..... 440/89 R
6,568,376 B2 * 5/2003 Sonnleitner et al. ..... 123/559.1
6,652,336 B1 * 11/2003 Chambers ..... 440/75
6,971,932 B2 * 12/2005 Maselter ..... 440/83
7,014,519 B1 3/2006 Batten, Jr. et al.
7,066,777 B2 6/2006 Maselter

OTHER PUBLICATIONS

Mercury VAZER "All new engine and sterndrive system", 2007.

* cited by examiner

*Primary Examiner*—Lars A Olson
(74) *Attorney, Agent, or Firm*—Osler, Hoskin & Harcourt LLP

(57) ABSTRACT

A boat has a hull, a deck having a deck floor, and an engine disposed in the hull. A top of the engine is disposed vertically below the deck floor. The engine includes a crankcase, a crankshaft, a pair of cylinder banks connected to the crankcase at an angle relative to each other. A transom extends generally vertically upwardly from a rear portion of the hull. A stern drive unit is connected to the transom and is operatively connected to the engine through the transom. In another aspect, a marine engine has a crankcase, a cylinder block, and a crankshaft. An output shaft is disposed vertically above the crankshaft. The output shaft is disposed at least partially internal to the engine. A drive, internal to the engine, is operatively connected to the crankshaft and the output shaft. A driveshaft coupling is disposed on the output shaft.

21 Claims, 48 Drawing Sheets

B-B

MARINE ENGINE

CROSS-REFERENCE

The present application claims priority to U.S. Provisional Patent Application No. 60/780,450, filed on Mar. 9, 2006, the entirety of which is incorporated herein by reference.

BACKGROUND OF THE INVENTION

1. Field of the Invention

The present invention relates generally to an internal combustion engine for use in marine applications.

2. Description of the Related Art

There exist three main types of engine/propulsion unit arrangements to power boats. They are outboards, inboards, and stern drives.

Outboards, as the name suggests, are located outside of the boat. Outboards have the engine, gear case, and propeller mounted as a complete unit to the transom of the boat. The engine has a vertically oriented driveshaft. Steering is achieved by swiveling the unit to direct the thrust of the propeller.

Inboards have the engine located inside the hull forward of the boat's transom. The engine turns a driveshaft which extends through the hull to a propeller or a jet pump. Where a propeller is used, steering is achieved by using rudders. Where a jet pump is used, steering is achieved by using a nozzle which directs the thrust generated by the pump.

Stem drives have the engine 1 located inside the hull 2 in a manner similar to inboards as seen in FIG. 1. The engine 1 turns a driveshaft (not shown) which is connected through the transom 3 to the drive unit 4. The drive unit 4 is equipped with a propeller 5. The drive unit 4 resembles the lower unit of an outboard. Steering is achieved by swiveling the drive unit 4 to direct the thrust of the propeller 5. Since stern drives combine some of the features of both inboards and outboards, they are also known as inboard/outboards (I/O).

Most stern drives and inboards use four-stroke or diesel automotive engines adapted for marine use (by improving their resistance to corrosion for example), as this represents a simpler, and less expensive (both in terms of time and money) approach than designing an engine specifically for marine uses. Although adequate, since such engines were not specifically designed to be used in a boat, they do not address all the needs of such an application.

When engineers design engines for automotive applications, they are concerned with the constraints resulting from placing the engine inside a car not a boat. One of the design constraints is the height inside which the engine has to fit. This height in a car is greater than a height between a deck floor and a hull of a boat, and as a result engines designed for automotive application are too high to fit between the deck floor and the hull of a boat. Another design constraint is that an engine designed for automotive applications needs to drive wheels located below the engine. In boats such as stern drives, the engine needs to drive a driveshaft located above the bottom of the hull on which the engine sits, as explained in greater detail below. Also, once an engine is installed in a car, the engine and it's components can be accessed relatively easily from above the engine (by opening the hood) and from below the engine (by getting under the car). Once an engine is installed in a boat, it can only be accessed from above since, as it would be understood, the engine cannot be accessed from under the hull, and therefore components located under an automotive engine are very difficult to access for maintenance or replacement when such an engine is placed in a boat. Since the above mentioned constraints for designing an engine for an automotive application conflict what would be necessary for a boat, the decision to use automotive engines in boats has forced boat manufacturers to compromise on the design of their boats.

As seen in FIG. 1, the drive unit 4 needs to be located a certain distance above the bottom of the hull 2 in order to minimize drag and maximize propulsion efficiency, which means that the driveshaft that couples the drive unit 4 to the engine 1 is located relatively high above the bottom of the hull 2. In automotive engines, as in the engine 1, the power take-off assembly is coaxial with the crankshaft located in the crankcase near the bottom of the engine 1. Therefore, in order to couple the power take-off assembly to the driveshaft of the drive unit 4, the engine 1 needs to be mounted high above the bottom of the hull 2. As can be seen in FIG. 1, this combined with the height of automotive engines results in the engine extending well above the deck floor 9 of a boat 6.

FIG. 2 shows the boat 6 equipped with a stern drive. The engine 1 is located inside the boat 6 near the transom. The drive unit 4 is attached to the transom. The drive unit 4 and propeller are located under a swim platform 7 from which people can reboard the boat 6 from the water. For the reasons mentioned above, an openable engine cover 8 in the form of a large box, which extends above the deck floor 9 and the seats, has to be accommodated in the boat 6. As can be seen in FIG. 2, the engine cover 8 takes up a substantial portion of the passenger area. Boat manufacturers have come up with some creative ways to integrate this engine cover 8 to the design of their boats by padding it to allow people to rest on it or by adding cup holders. In reality, the engine cover 8 only occupies valuable room inside the passenger area which boat designer could make better use of if this constraint did not exist. Similar compromises in the design of boats equipped with an inboard have to be made.

Therefore, there exists a need for an engine designed specifically for use in marine applications and more specifically stern drives and inboards.

SUMMARY OF THE INVENTION

It is an object of the present invention to ameliorate at least some of the inconveniences present in the prior art.

The present invention provides an engine believed to be particularly well suited for use on boats having a stern drive or an inboard. More specifically, the present invention provides an engine which can be installed under a deck floor of a boat without the need for a engine cover extending above the deck floor. The main reason for this is that the engine has been designed specifically to address the constraints inherent to boats, thus providing more freedom to boat designers in the design of the passenger area of their boats. To achieve this, the engine has been designed to have reduced vertical dimensions compared to prior art engines of the same category. Particular attention has been made to the geometry of the engine, such as the angle between the cylinder banks which as been increased compared to the prior art. Also, the various components that make up the engine systems had to be carefully packaged around the engine structure (crankcase and cylinder block) so as to comply with the engine height restrictions while maintaining accessibility to the components that require it. Therefore, many components have been located near a top of the engine in front of, behind, and between the cylinder banks where they can be easily accessed, thus leaving only a few components, which rarely require access, under the cylinder banks.

The present invention also provides an engine which can be installed near the bottom of the hull of a boat. More specifically, the power take-off assembly of the engine, which receives the driveshaft, is offset from and vertically higher than the crankshaft from which it is driven. This allows for proper alignment of the output shaft with the driveshaft of the stern drive unit while mounting the engine near the bottom of the hull.

In one aspect, the invention provides a boat having a hull, a deck disposed on the hull, the deck having a deck floor, and at least one engine disposed in the hull. A top of the at least one engine is disposed vertically below the deck floor. The at least one engine includes a crankcase, a crankshaft disposed in the crankcase for rotation therewithin, a first cylinder bank connected to the crankcase, and a second cylinder bank connected to the crankcase. The first cylinder bank and the second cylinder bank are disposed at an angle relative to each other. A transom extends generally vertically upwardly from a rear portion of the hull. A stern drive unit is connected to the transom and is operatively connected to the at least one engine through the transom.

In a further aspect, an exhaust pipe is in fluid communication with the at least one engine. A portion of the exhaust pipe extends vertically above the deck floor between the transom and a back wall of the deck.

In an additional aspect, the at least one engine further includes an output shaft driven by the crankshaft, and a driveshaft coupling disposed on the output shaft for operatively coupling a driveshaft of the propulsion unit. The output shaft is disposed vertically above the crankshaft.

In a further aspect, the at least one engine is two engines. Each of the engines is disposed on a different side of a longitudinal centerline of the hull. The output shaft of each engine is horizontally offset from its respective crankshaft towards the longitudinal centerline of the hull.

In an additional aspect, at least two auxiliary units are selected from a group consisting of a counter-balance shaft, an output shaft, a water pump, a hydraulic pump, a first oil pump, a second oil pump, and a supercharger. The at least two auxiliary units are gear driven from the crankshaft.

In a further aspect, the angle between the cylinder banks is greater than 90 degrees.

In an additional aspect, the angle is less than 150 degrees.

In a further aspect, the angle is approximately 105 degrees.

In an additional aspect, a distance from a bottom of the at least one engine to the top of the at least one engine is less than 5 10 mm.

In a further aspect, the distance from the bottom of the at least one engine to the top of the at least one engine is less than or equal to 475 mm.

In an additional aspect, the deck floor is approximately 35 mm above the top of the at least one engine.

In a further aspect, an intercooler is disposed between the first and second cylinder banks.

In an additional aspect, a supercharger is disposed at a front of the at least one engine.

In a further aspect, a counter-balance shaft is driven by the crankshaft. The supercharger is driven by the counter-balance shaft.

In another aspect, the invention provides a marine engine having a crankcase, a cylinder block connected to the crankcase, and a crankshaft disposed in the crankcase for rotation therewithin. An output shaft is disposed vertically above the crankshaft. The output shaft is disposed at least partially internal to the engine for rotation therewithin. A drive is operatively connected to the crankshaft and the output shaft to transmit power from the crankshaft to the output shaft. The drive is disposed internal to the engine. A driveshaft coupling is disposed on the output shaft for operatively coupling a driveshaft of a propulsion unit.

In an additional aspect, at least two auxiliary units are selected from a group consisting of a counter-balance shaft, the output shaft, a water pump, a hydraulic pump, a first oil pump, a second oil pump, and a supercharger. The at least two auxiliary units are gear driven from the crankshaft.

In a further aspect, the drive includes a first gear disposed on the crankshaft, and a second gear disposed on the output shaft. The first gear engages the second gear to transmit power from the crankshaft to the output shaft.

In an additional aspect, a flywheel is disposed on the crankshaft. The flywheel has a diameter. The diameter of the flywheel is less than a sum of a diameter of the first gear and a diameter of the second gear.

In a further aspect, a starter ring gear is disposed on the crankshaft adjacent the flywheel. The starter ring gear has a diameter. The diameter of the starter ring gear is less than a sum of the diameter of the first gear and the diameter of the second gear.

In an additional aspect, a protective cover is disposed over a bottom portion of the flywheel.

In a further aspect, a flywheel is disposed on a first end portion of the crankshaft, and a rotating mass is disposed on a second end portion of the crankshaft opposite the first end.

In an additional aspect, a pair of cylinder banks are disposed at an angle relative to each other.

For purposes of this application, the terms related to spatial orientation such as front, rear, top, bottom, above, below, horizontal, and vertical, to name a few, are as they would normally be understood from looking at the enclosed figures. This means that when discussing a boat these should be understood as the front corresponding to the bow of the boat, the back corresponding to the transom of the boat, and horizontal corresponding to a water level when the boat is at rest in water. For a boat, the other terms related to spatial orientation should be understood as related to these orientations. When discussing an engine, the horizontal corresponds to a rotation axis of the crankshaft, the top corresponds to a location of a cylinder head, and the back corresponds to a side of the engine where the driveshaft coupling is located. For an engine, the other terms related to spatial orientation should be understood as related to these orientations. It should also be understood that should the engine be oriented differently than what is shown in the figures, with the crankshaft oriented transversely to the hull of the boat for example, that the spatial terms should be still be understood as the horizontal corresponding to a rotation axis of the crankshaft, the top corresponding to a location of a cylinder head, and the back corresponding to a side of the engine where the driveshaft coupling is located, irrespective of an actual orientation of the engine. For example, if a component is described as being near a front of the engine when the engine is oriented as shown herein (i.e. with a horizontal crankshaft in a longitudinal direction of the boat), the same component would be to a side of the of the engine when the engine is oriented with the crankshaft transversely to the longitudinal direction of the boat. However since the spatial orientations are to be understood as being relative to what is being described herein, the component in the engine having the transversely oriented crankshaft would meet the description of the component as given herein.

Also for purposes of this application, the terms "deck floor" refer to the portion of a boat intended for the passengers of the boat to walk on. It should be understood that an access panel disposed above the engine that is level with the other portions of the deck floor is to be considered as being part of the deck floor. The deck floor is usually made of moulded fiberglass. A deck floor is not intended to describe portions of a boat on which passengers may walk but which are not specifically intended for that purpose, such as seats, gunnels, or sun decks to name a few. The terms "top of the engine" refer to the vertically highest point of the engine excluding the exhaust conduits which are connected to the engine and any component located remotely from the engine. The terms "auxiliary unit" refer to components of the engine which are driven directly or indirectly by the crankshaft. Auxiliary units include, but are not limited to, a counter-balance shaft, an output shaft, mechanically actuated pumps, and a supercharger. Auxiliary units exclude the drive unit and its components. The term "drive", used as a noun, refers to a mechanism to transmit mechanical power from one component to another, such as a gear arrangement or a sprockets and chain assembly.

Embodiments of the present invention each have at least one of the above-mentioned objects and/or aspects, but do not necessarily have all of them. It should be understood that some aspects of the present invention that have resulted from attaining the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE INVENTION

Figure 3:
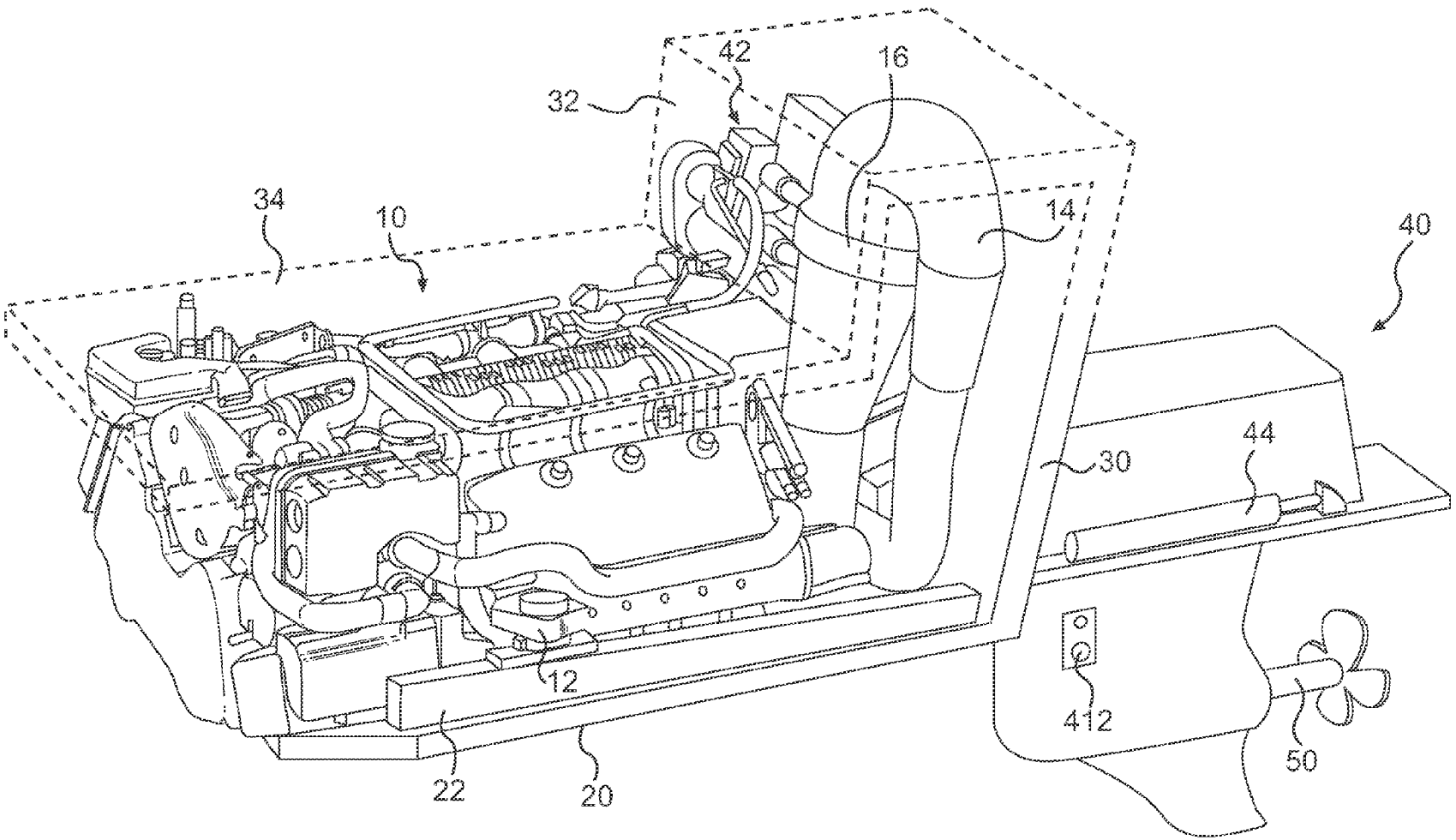
FIG. 3 is a perspective view, taken from the front, left side, of a section of a boat hull having a stern drive using an engine in accordance with the present invention installed therein.
Figure 4:
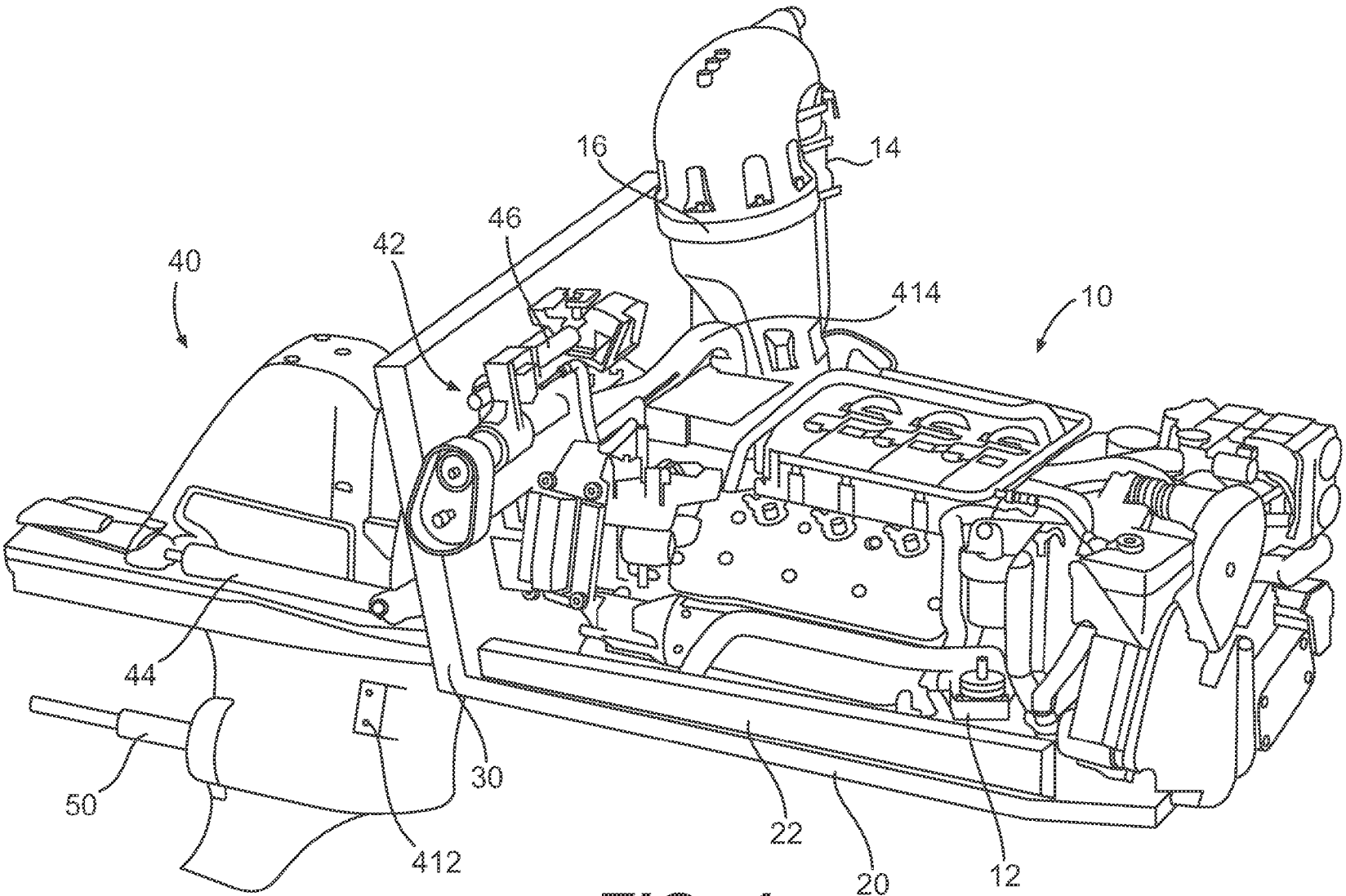
FIG. 4 is a perspective view, taken from the front, right side, of the section of the boat hull and stern drive of FIG. 3.
Figure 5:
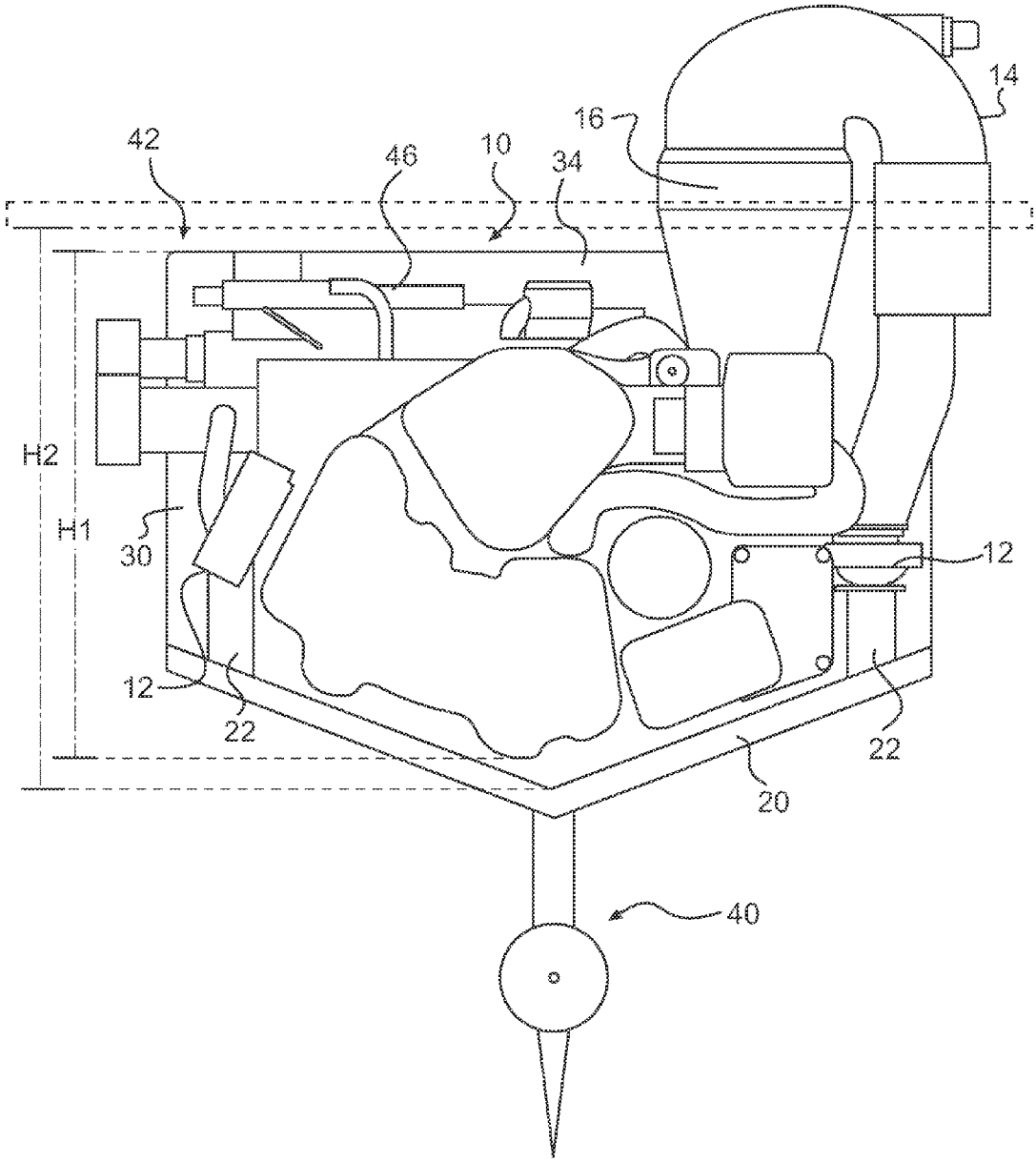
FIG. 5 is front elevation view of the section of the boat hull and stern drive of FIG. 3.

Turning now to the drawings and referring first to FIGS. 3 to 5, an engine 10 in accordance with the present invention is mounted to the hull 20. The engine 10 turns a driveshaft (not shown) which is connected through the transom 30 to a drive unit 40. The drive unit 40 has a propeller shaft 50 which turns a propeller (FIG. 3) to provide thrust to the boat.

An exhaust pipe 14 collects exhaust gases from the engine's exhaust system 300. The exhaust pipe 14 extends upwardly from the exhaust system 300, then downwardly to create what is known as a gooseneck. The purpose of the gooseneck is to prevent the water in which the boat is operating from entering the engine 10. The exhaust pipe 14 then extends through the transom 30 and inside the drive unit 40. The exhaust gases then travel through the drive unit 40 to finally go in the water by going above or through the propeller. Alternatively, the exhaust pipe 14 could extend through the transom 30 or the bottom of the hull 20 to exhaust the exhaust gases directly in the water. An expansion chamber 16 is defined by a portion of the exhaust pipe 14. The expansion chamber 16 is configured to receive a catalyst (not shown) therein. Although the exhaust pipe 14 extends above the engine 10, the fact that it occupies a relatively small amount of space along a longitudinal length of the boat combined with its location near the transom 30 of the hull 20 allows the exhaust pipe 14 to fit in the space provided between the transom 30 and the back wall 32 of the deck, thus not compromising the interior design of the deck.

The drive unit 40 is connected to the transom 30 of the boat, preferably via a gimbal ring assembly (not shown) which allows it to be steered. A hydraulic unit 42 is attached to the transom 30 on the inside of the hull 20. A plurality of electrical or mechanical pumps are provided on the hydraulic unit 42 or the engine 10 for pressurizing hydraulic fluid which will be used to steer, tilt, and/or trim the drive unit 40. One such pump is hydraulic pump 41 which is provided on the back of the engine 10. The hydraulic pump 41 is mechanically driven by the engine 10. The hydraulic pump 41 pumps hydraulic fluid from hydraulic fluid reservoir 43, which is also located on the back of the engine 10 in an easily accessible position so as to allow easy filling of the reservoir 43. A pair of tilt/trim hydraulic cylinders 44 are provided on either side of the drive unit 40. The tilt/trim hydraulic cylinders 44 use hydraulic power from the hydraulic unit 42 to tilt and trim the drive unit 40. A steering hydraulic cylinder 46 is connected to a steering arm (not shown), which extends from the drive unit 40 though the transom 30, and uses hydraulic power from the hydraulic unit 42 to cause the drive unit 40 to swivel, thereby steering the boat.

The engine 10 is mounted inside the hull 20 by using four engine mounts. Two front engine mounts 12 located on either side of the forward half of the engine 10 sit on a pair of engine support portions 22 extending from the hull 20. The engine support portions 22 are beams extending longitudinally along the hull 20 on either side of the engine. The engine support portions 22 can be integrally formed with the hull 20 or attached thereto. Alternatively, the engine support portions 22 could be in the form of posts extending from the hull. Two rear engine mounts 13 (FIG. 6) are located on the rear side of the engine on either side of a longitudinal center line of the engine. The two rear engine mounts 13 also sit on structures extending from the hull 20 similar to the engine support portions 22. Preferably, the engine mounts 12, 13 are provided with dampers to reduce the transmission of vibrations from the engine 10 to the hull 20. The dampers can be in the form of elastomer pieces, such as rubber, sandwiched between the engine mounts 12, 13 and the support portions 22.

Figure 1:
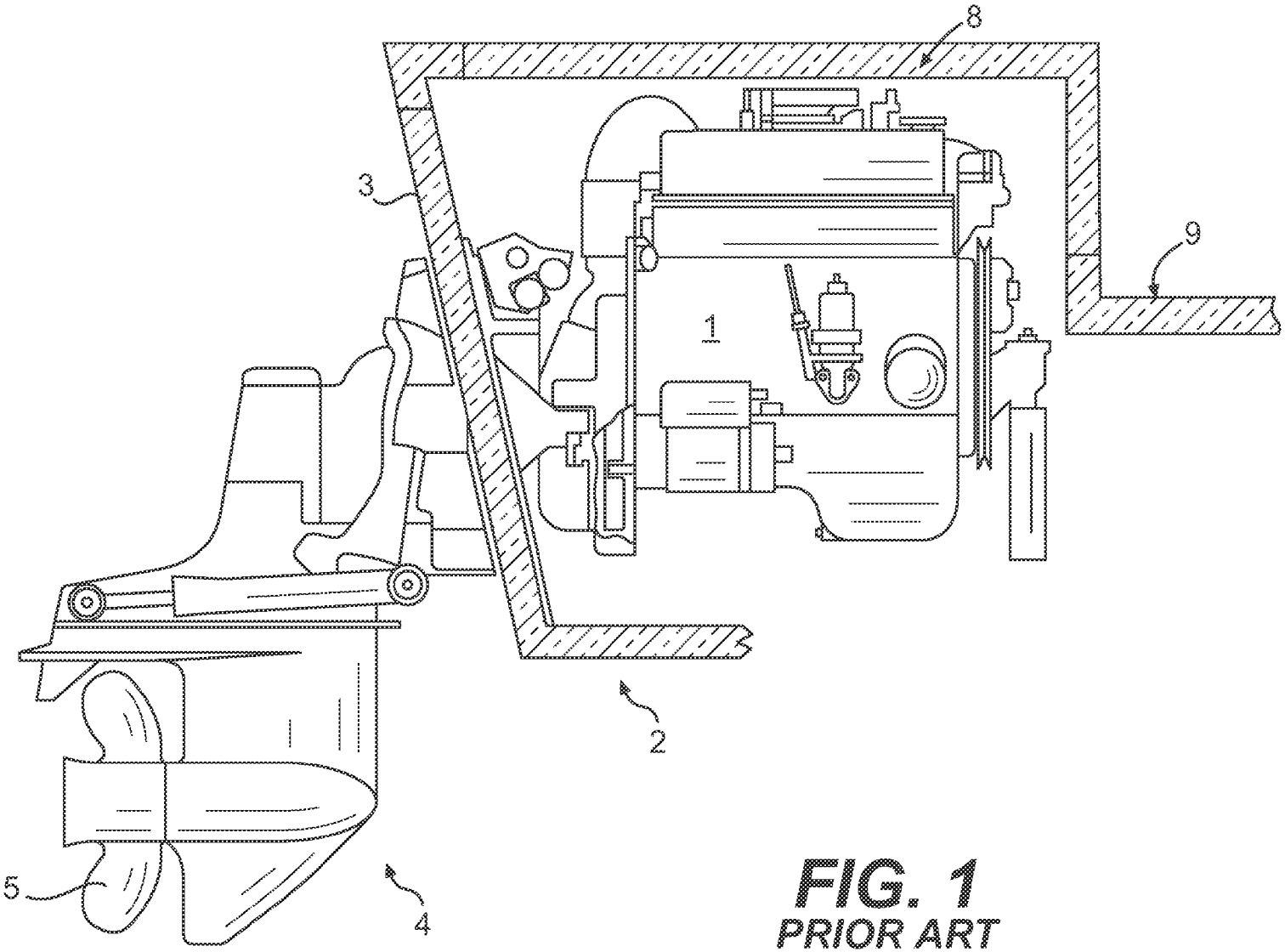
FIG. 1 PRIOR ART
FIG. 1 is a partial cross-section of a prior art stern drive arrangement.
Figure 2:
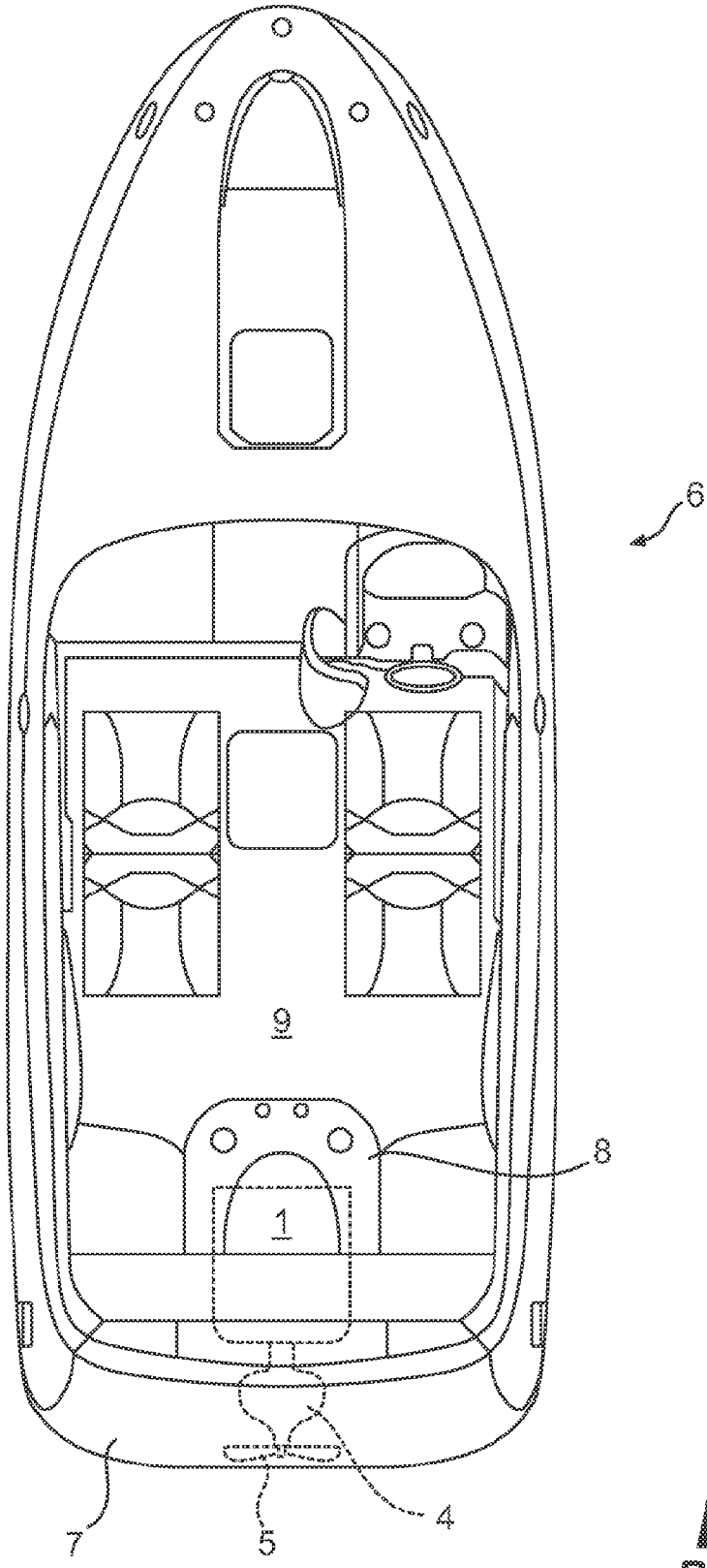
FIG. 2 PRIOR ART
FIG. 2 is a top plan view of a boat employing the prior art stern drive arrangement of FIG. 1.

As seen in FIG. 5, the distance H1 from the bottom of the engine 10 to the top of the engine 10 is less than the distance H2 from the bottom of the interior of the lateral center of the hull 20 to the inner side of the deck floor 34. Preferably, H1 is less than 510 mm. In a preferred embodiment, H1 is approximately 475 mm, while H2 is approximately 545 mm, thus leaving a clearance of approximately 35 mm between the top of the engine 10 and the inner side of the deck floor 34 and a clearance of approximately 35 mm between the bottom of the engine 10 and the bottom of the interior of the hull 20. Since the engine 10 of the present invention can fit under the deck floor 34 of a boat, the design of the passenger area of the boat no longer needs to be compromised by the presence of an engine cover 8 as in FIG. 2. The features of the engine 10 which permit such an arrangement will be described below.

Turning now to FIGS. 6 to 13, the engine 10 is a V-type engine, which means that it has a pair of cylinder banks 52 disposed at an angle $\alpha$ (FIG. 12) relative to each other. Angle $\alpha$ corresponds to the angle between a line passing through a center of a cylinder 54 in one cylinder bank 52 and the center of the crankshaft 66 and a line passing through a center of a cylinder 54 in the other cylinder bank and the center of the crankshaft 66. To obtain an engine 10 having a relatively short height, the angle $\alpha$ should be as large as possible. Preferably, the angle $\alpha$ should be more than 90°. Preferably, the angle $\alpha$ should be less than 150°, otherwise the engine 10 may be too wide to be accommodated in the boat. In the illustrated embodiment, the angle $\alpha$ is about 105°.

Each of the cylinder banks 52 has three cylinders 54, thus forming what is known as a V-6 engine. It is contemplated that a greater or fewer number of cylinders 54 could be used. All of the cylinders 54 are formed in a unitary cylinder block 56, which sits atop the crankcase 64. Each cylinder bank 52 has a cylinder head assembly 58A, 58B sitting atop the cylinders 54. Preferably, the cylinder head assemblies 58 are of the type described in U.S. Pat. No. 6,626,140, issued on Sep. 30, 2003, entitled "Four Stroke Engine Having Power Take Off Assembly", which is incorporated herein by reference. An ignition coil 59 per cylinder 54 is provided on the cylinder head assemblies 58. A piston 60 is housed inside each cylinder 54 and reciprocates therewithin. For each cylinder 54, the walls of the cylinder 54, the cylinder head assembly 58 and the top of the piston 60 form a combustion chamber 62.

Figure 13:
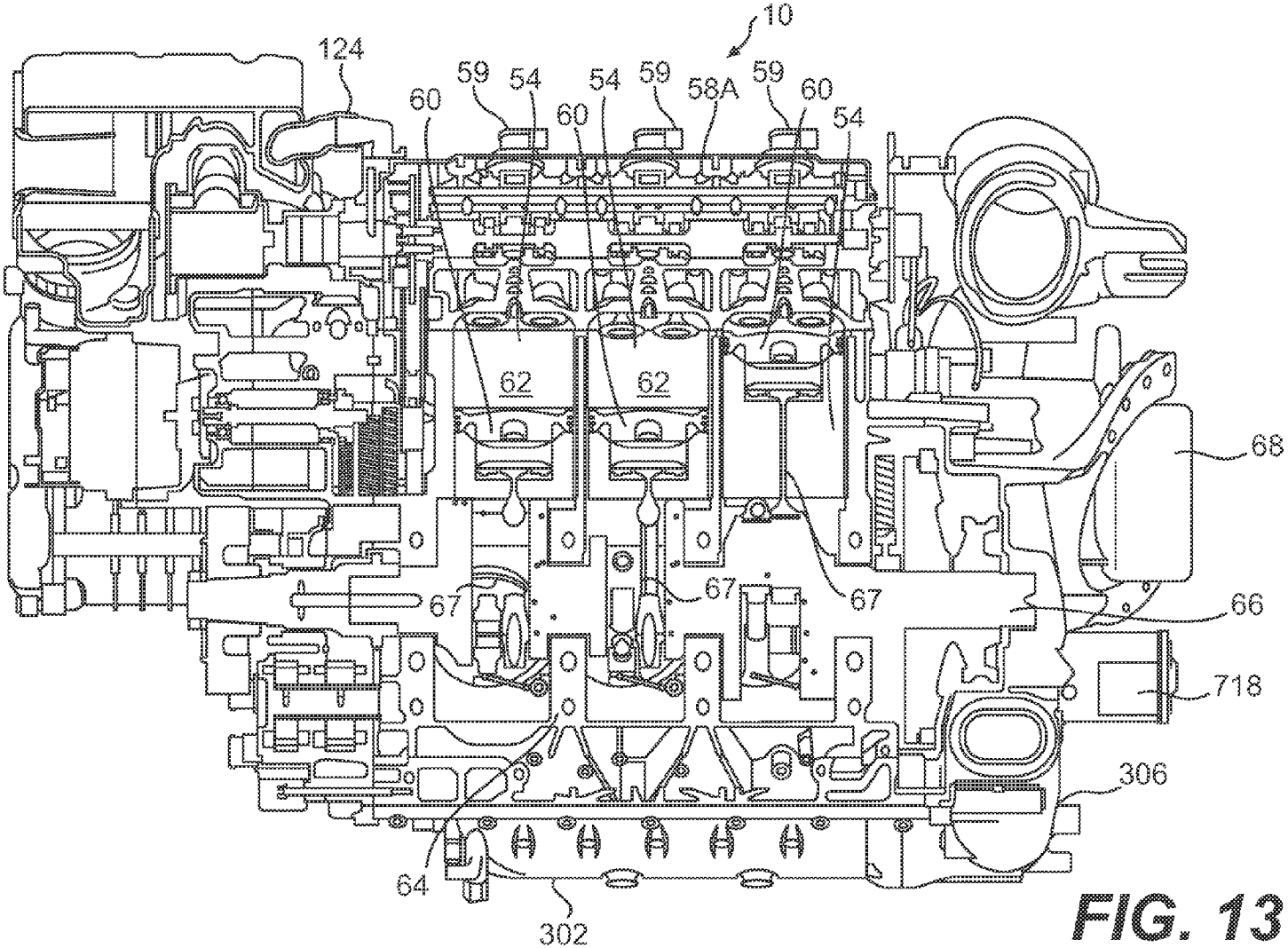
FIG. 13 is a partial longitudinal cross-section taken through the right cylinder bank of the engine of FIG. 6.
Figure 14:
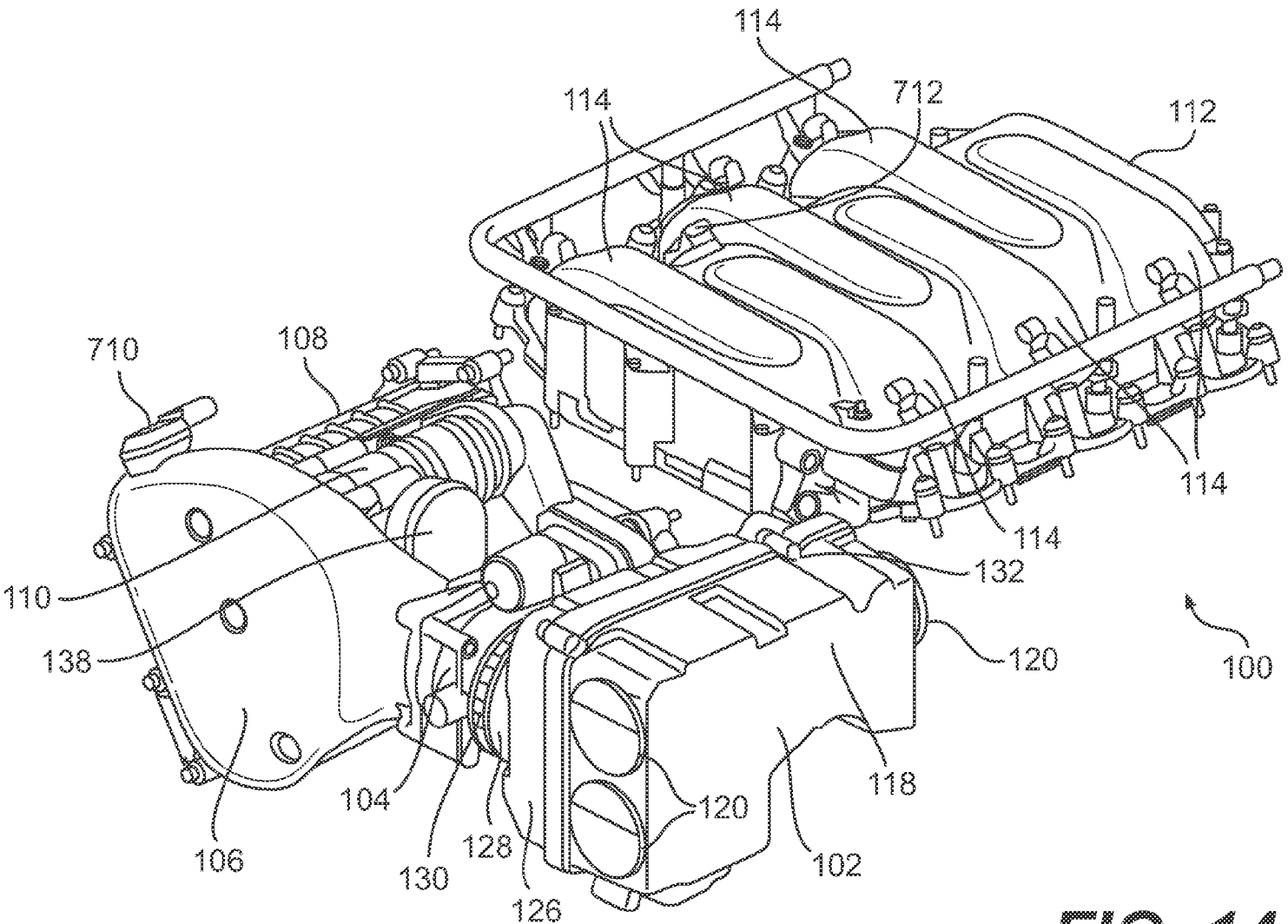
FIG. 14 is a perspective view, taken from a front, left side, of an air intake system of the engine of FIG. 6.
Figure 15:
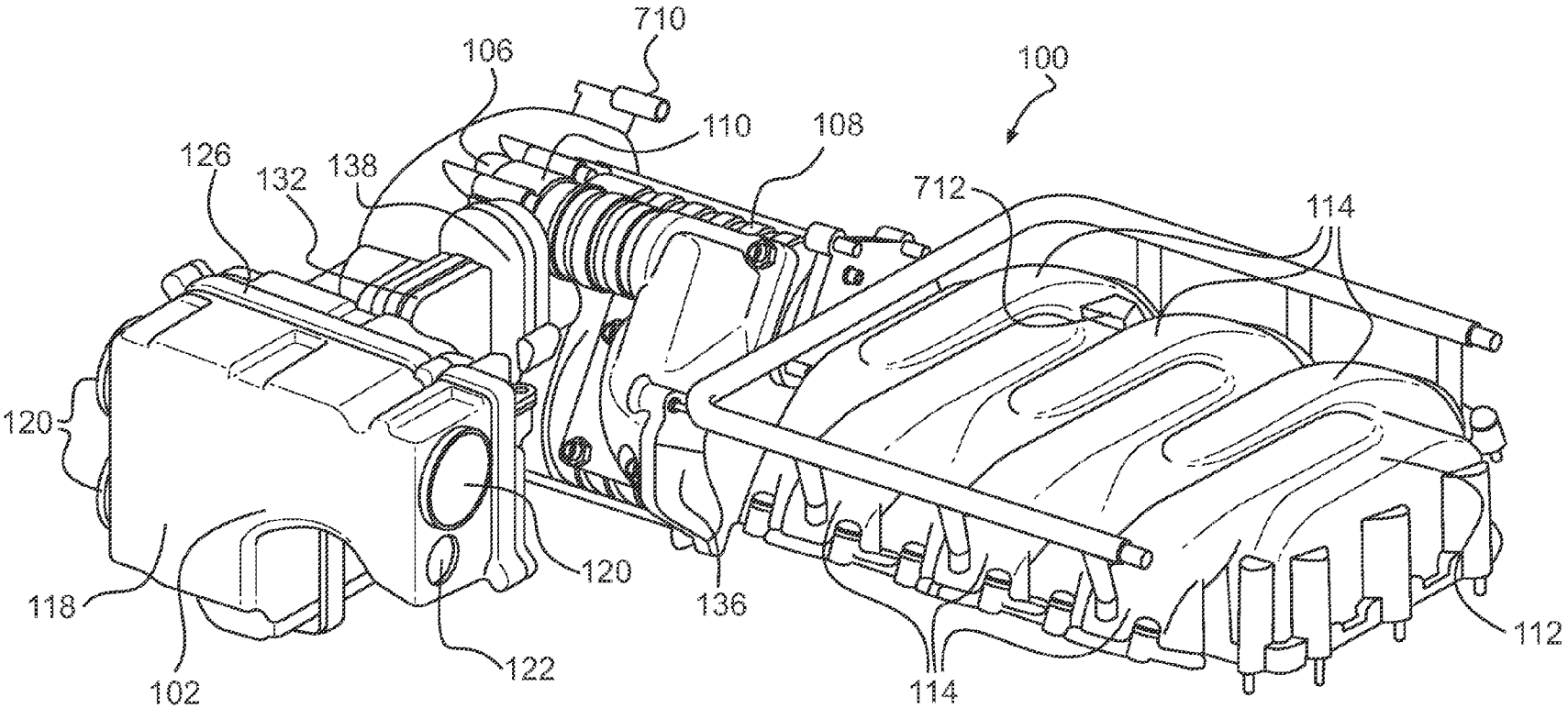
FIG. 15 is a perspective view, taken from a rear, left side, of the air intake system of FIG. 14.
Figure 16:
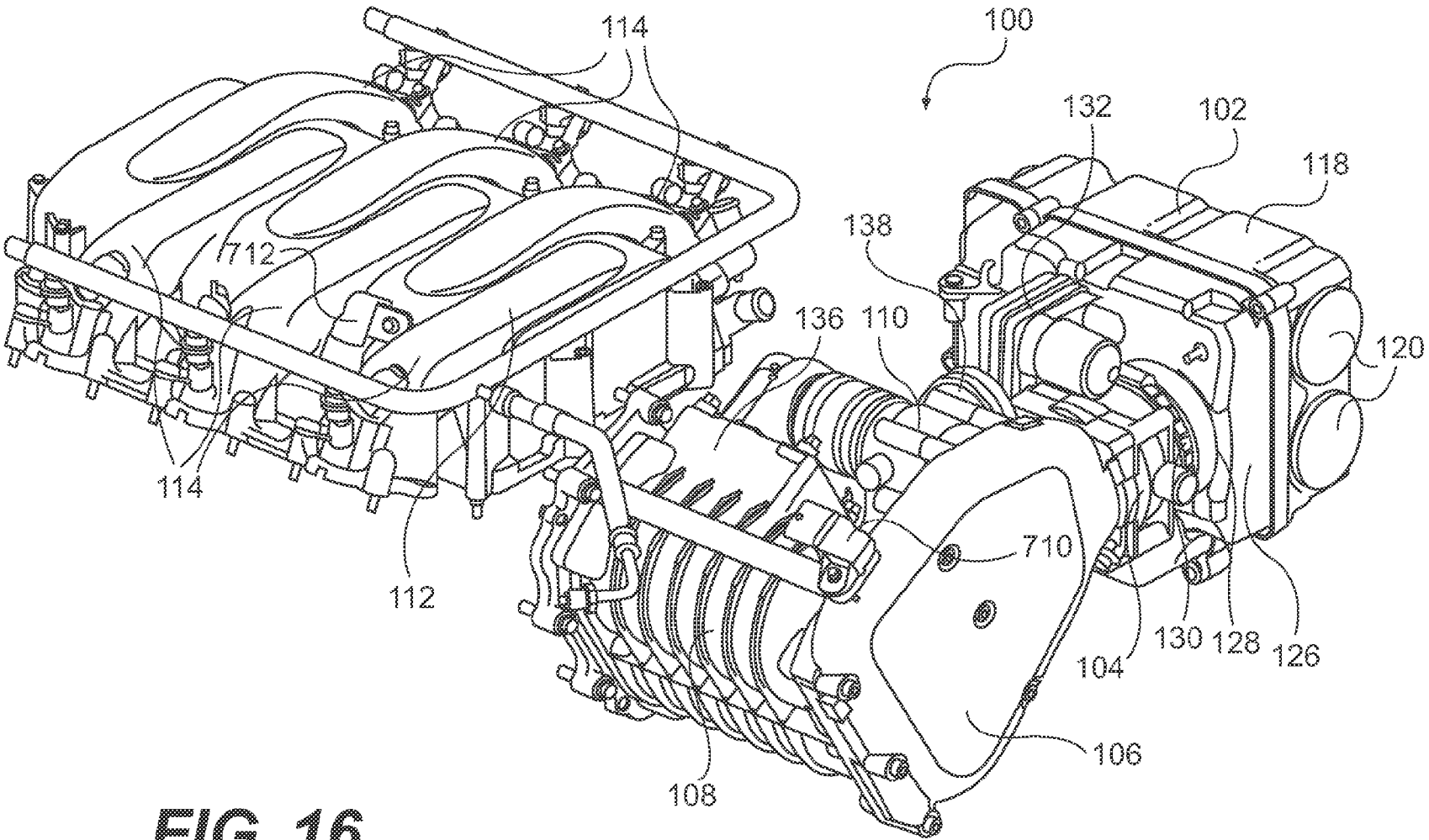
FIG. 16 is a perspective view, taken from a front, right side, of the air intake system of FIG. 14.
Figure 17:
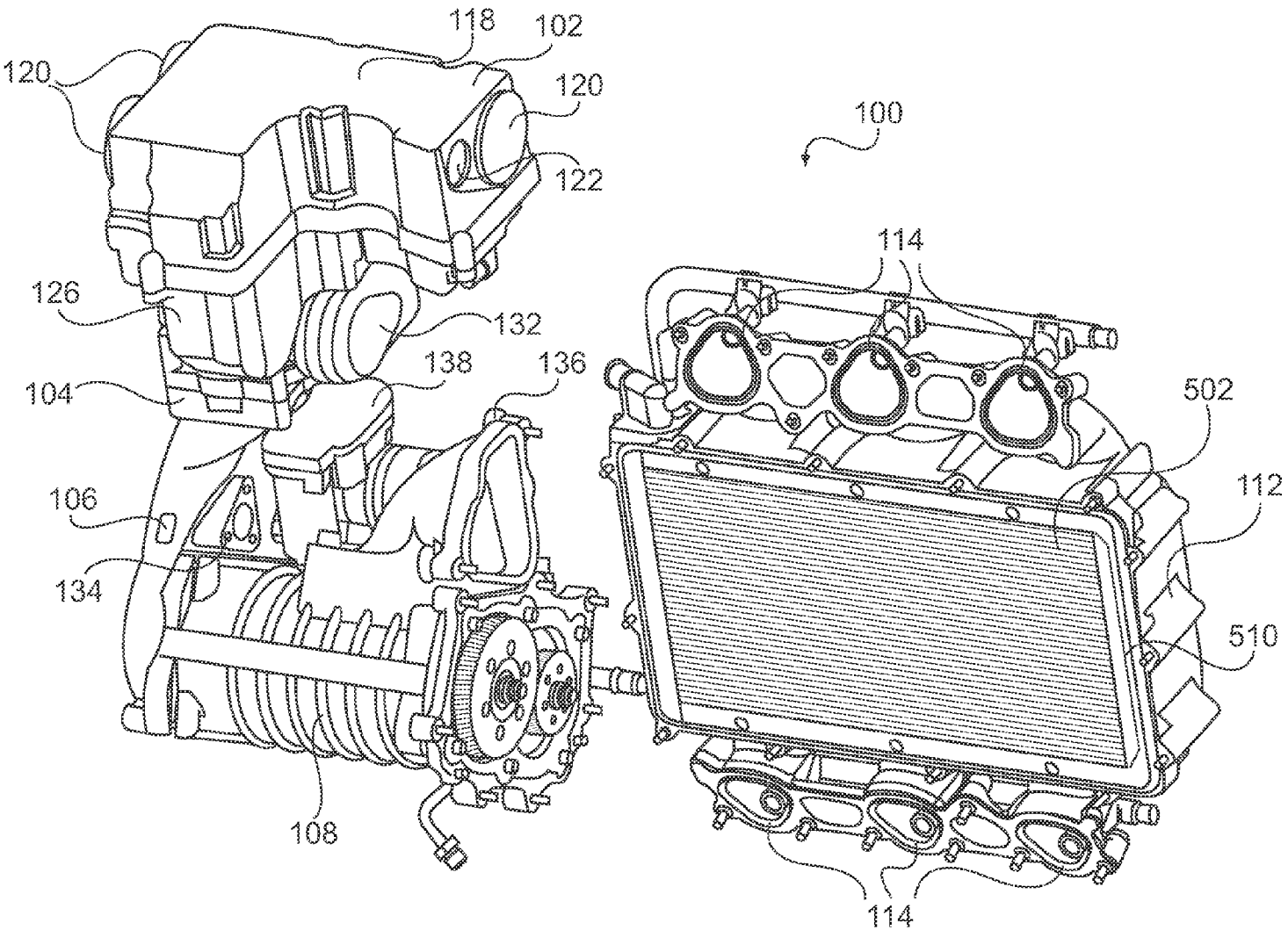
FIG. 17 is a bottom perspective view, taken from a rear, left side, of the air intake system of FIG. 14.

The pistons 60 are linked to the crankshaft 66, which is housed in the crankcase 64, by connecting rods 67 (FIG. 13). Combustion of an air/fuel mixture inside the combustion chambers 62 makes the pistons 60 reciprocate inside the cylinder and causes the crankshaft 66 to rotate inside the crankcase 64, as is well known in the art. The crankshaft 66 drives the driveshaft coupling 68 in a manner described in more detail below. The driveshaft coupling 68 couples the driveshaft (not shown) of the drive unit 40 to engine 10 to transmit the power from the engine 10 to the drive unit 40. It should be noted that the driveshaft coupling 68 rotates about an axis which is located higher than the axis of rotation of the crankshaft 66. By having such an arrangement, the engine 10 can be disposed low in the hull 20, such that a top of the engine 10 is below the deck floor 34 of the boat, and drive the stern drive unit 40.

Alignment brackets 70 are provided on the back of the engine 10 on either side of the driveshaft coupling 68. The alignment brackets 70 have apertures 72 therethrough to permit the engine 10 to be fastened to the transom 30 of the hull 20. Although not shown, it is contemplated that elastomeric dampers could be disposed between the brackets 70 and the transom 30. The alignment brackets 70 ensure that the drive-shaft coupling 68 and driveshaft are properly aligned with the drive unit 40.

The engine 10 is also provided with various systems attached to or integrated with it to permit it to operate properly. These systems are: the air intake system 100 (FIGS. 14 to 21), the fuel system 200 (FIGS. 22 to 24), the exhaust system 300 (FIG. 25), the open-loop cooling system 400 (FIG. 26), the closed-loop cooling system 500 (FIGS. 27 to 30), the lubrication system 600 (FIGS. 31 to 34), the electrical system, and the internal gearing system 800 (FIGS. 35 to 47) of the engine 10.

Although each system will be described in greater detail below, the main components of the air intake 100, fuel 200, exhaust 300, open-loop cooling 400, closed-loop cooling 500, and lubrication 600 systems will first be identified with reference to FIGS. 6-11.

Most of the components of the air intake system 100 are located on the forward upper portion of the engine 10. During operation of the boat, the forward portion of the hull 20, in which the engine 10 is located, is vertically higher than the rear portion of the hull 20, causing water which may have accumulated at the bottom of the hull 20 to gather at the rear portion of the hull 20. Therefore, by locating the components of the air intake system 100 on the forward upper portion of the engine 10, the likelihood of water being ingested by the engine 10 through the air intake system 100 is reduced.

Air first enters the airbox 102. It then flows through the throttle body 104 which controls the flow of air to the engine 10. Next, the air enters the supercharger intake housing 106. From there, air flows either through supercharger 108 or through bypass passage 110, the reasons for which will be discussed in greater detail below. The air then enters the air intake manifold 112. The air intake manifold 112 is located atop the engine 10 between the two cylinder banks 52. Finally, the air intake manifold 112 distributes the air to each engine cylinder 54 via intake runners 114. Each intake runner 114 communicates with an intake passage 116 corresponding to a single cylinder 54.

A fuel system 200 is provided to supply fuel to the combustion chambers 62. Fuel located in one or more fuel tanks (not shown) that are separate from the engine 10. The fuel is first pumped through a fuel pumping unit 202. The fuel pumping unit 202 is made up of various components, the details of which will be discussed below. The fuel pumping unit 202 is attached to the engine 10 via brackets 204. Fuel then goes to the fuel rail 206. The fuel rail 206 is C-shaped, as viewed from the top (FIG. 6), so as to provide both cylinder banks 52 with fuel. Finally, fuel is transferred from the fuel rail 206 to fuel injectors 208. There is one fuel injector 208 per cylinder 54. The fuel injectors 208 are installed on the intake runners 114 and pass therethough to inject fuel inside the intake passages 116 of the cylinders 54. Once a mixture of air and fuel is present in a combustion chamber 62, it is ignited, thus powering the engine 10.

Once the air and fuel are combusted in the combustion chamber 62, they are exhausted to the body of water via exhaust system 300. Alternatively, they could be exhausted to the atmosphere. An exhaust manifold 302 is provided on each cylinder bank 52. Each exhaust manifold 302 fluidly communicates with the exhaust passage 304 (FIG. 12) of each cylinder 54 present in its corresponding cylinder bank 52. The exhaust gases then flow to an exhaust collector 306. The exhaust collector 306 is integrated into the flywheel cover 74 located at the rear of the engine 10. The exhaust gases then flow to the exhaust pipe 14 and finally to the body of water, as previously described. An exhaust gas recirculation system 308 is also provided to recirculate a portion of the exhaust gases from the exhaust collector 306 into the air intake system 100.

The engine 10 is provided with two cooling systems. The first system is an open-loop cooling system 400, which means that water is taken from the body of water in which the boat operates, runs through the system 400, and is then returned to the body of water. This system is used to cool components that are attached to the engine 10, such as the exhaust manifolds 302 and the exhaust collector 306, by running water through water jackets integrated in these components. The water of the open-loop cooling system 400 also passes through a heat exchanger box 402, which contains heat exchangers 520, 522, 524, 526 (FIG. 29) to cool the fluid used in the closed-loop system 500 described below. The water of the open-loop system 400 also runs through an hydraulic fluid cooler 404 used to cool the hydraulic fluid used by the hydraulic unit 42, and through portions of the fuel pumping unit 202 to cool the fuel.

Salt-water may cause corrosion of elements exposed to it, therefore a closed-loop cooling system 500 is also provided to cool portions of the engine 10 which would be more sensitive to corrosion. This is especially true for portions of the engine 10 which cannot be easily replaced such as the cylinder block 56. A coolant reservoir 504 is provided to hold the coolant (fresh water for example). The coolant reservoir 504 is located on the front upper right portion of the engine 10 so as to be easily accessible for re-filling of the reservoir 504. In addition to cooling the engine 10 itself, the coolant of the closed-loop cooling system 500 is used in an exhaust gas cooler 506 used in the exhaust gas recirculation system 308, to cool the exhaust gas before it is returned to the air intake system 100, and in an oil cooler 508. The coolant selectively runs through heat exchangers 520, 522, 524, 526 (FIG. 29) to reduce its temperature.

The lubrication system 600 provides lubricant to the various moving parts of the engine 10 to prevent premature wear of these parts, which would otherwise be caused by friction and the resulting heat. Although the lubrication system 600 will be described in greater detail below, some the components thereof can be seen externally of the engine 10. An oil pan 602 is attached to the bottom of the crankcase 64 to create a volume to receive oil therebetween. The oil pan 602 has a oil drain 604 which permits draining of the oil present in the lubrication system 600 when performing an oil change, as required by the maintenance schedule of the engine 10. Alternatively, oil can also be sucked out of the filling opening of an oil tank 606 (described below) to perform an oil change. A plurality of oil vapour vents 605 are provided on either side of the crankcase 64 in order to vent out any oil vapour that may be present in the volume between the oil pan 602 and the crankcase 64. An oil tank 606 is attached to the front bottom left portion of the engine 10. Although the oil tank 606 is located at the bottom of the engine 10, a portion of the oil tank 606 extends upwardly therefrom such that the filling opening of the oil tank 606, closed by oil cap 608, is located near the top of the engine 10. This allows for easy filling of the oil tank 606. Similarly, the oil filter 610, which needs occasional replacement, is located adjacent to the oil cap 608 near the top of the engine so as to be easily accessible. In automotive engines, the oil filter is normally located under the engine which is appropriate for automotive applications since one can easily slide under the vehicle to access it. However, this cannot be done in marine applications. A dipstick 612 is also provided so that a user may determine a level of oil in the system 600. As previously mentioned, an oil cooler 508 is provided adjacent to the oil tank 606.

Each system will now be discussed in greater detail.

Air Intake System

Turning now to FIGS. 14 to 21, the air intake system 100 has an airbox 102 made of two portions. The first airbox portion 118 has three air inlets 120 thereon. The inlets 120 are designed according to the diffuser principle so as to reduce the intake noise. Two of the inlets 120 are located on a front of the first airbox portion 118. The third air inlet 120 is located on the back of the first airbox portion 118. A blow-by gas inlet 122 is also located on the first airbox portion 118 below the third air inlet 120. The blow-by gas inlet 122 is connected to blow-by gas tube 124 (FIGS. 6 and 7) which carries blow-by gases (combustion gases that blow by the pistons) from the left cylinder head assembly 58A of the engine 10. This recirculates the blow-by gases into the air intake system 100 to be combusted again, as opposed to venting the blow-by gases to the atmosphere. The second portion of the airbox 126 is fastened to the first portion of the airbox 118. The second portion of the airbox 126 has the outlet of the airbox 102 which is connected to a flexible rubber coupling 128. An air filter (not shown) is disposed inside the airbox 102.

Figure 8:
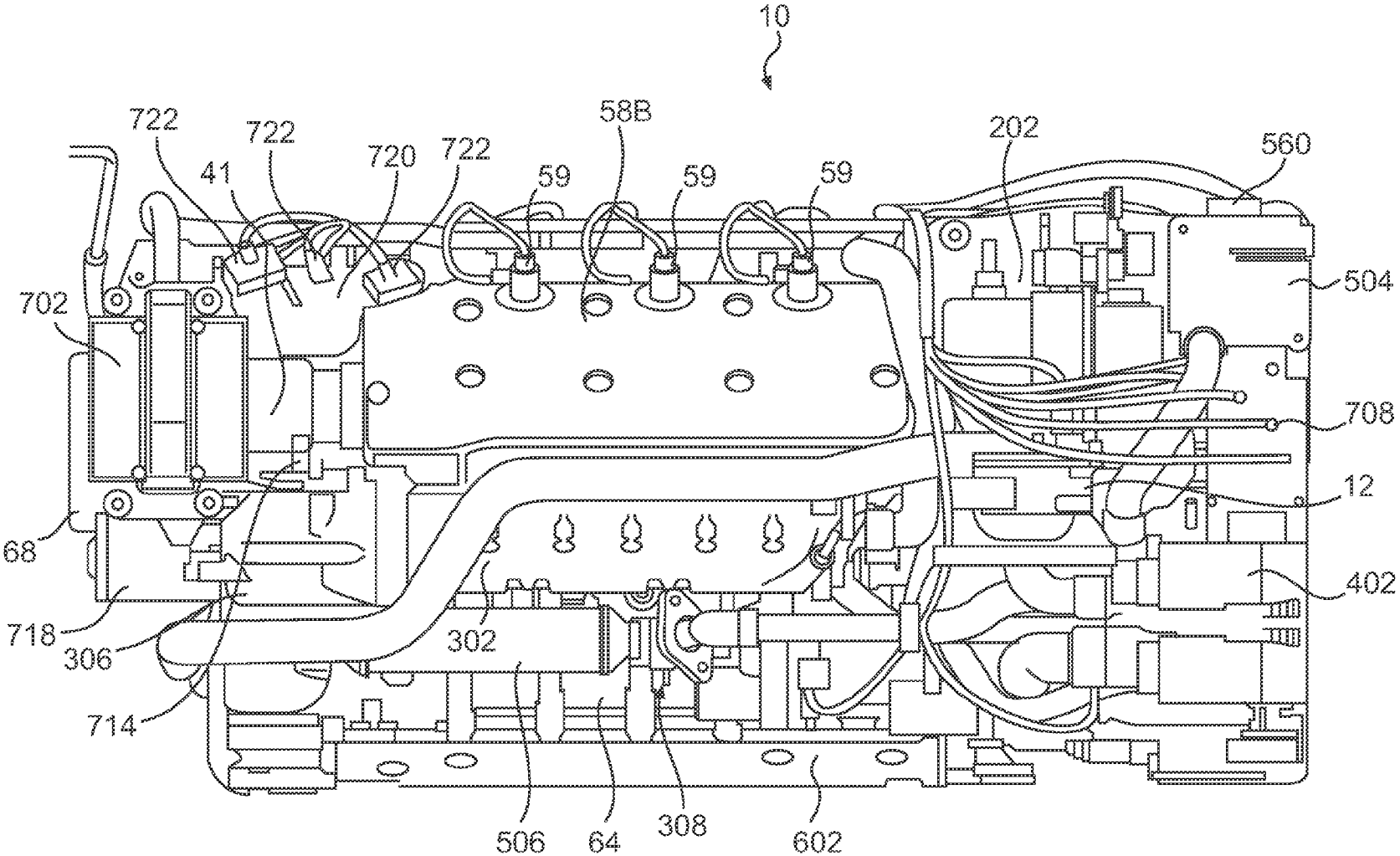
FIG. 8 is a right side elevation view of the engine of FIG. 6.

The rubber coupling 128 is clamped onto the throttle body 104 by clamp 130. The throttle body 104 has a throttle plate (not shown) therein which can be pivoted to vary the internal cross-section of the throttle body 104, thus controlling the quantity of air that will flow to the engine 10. The throttle plate is actuated by a throttle actuator 132. The throttle actuator 132 is an electric motor that receives control signals as to the desired position of the throttle plate from the electronic control unit (ECU) 702 (FIG. 8).

The throttle body 104 is connected to the supercharger intake housing 106, which acts as an expansion chamber. The supercharger intake housing 106 has two inlets. The first inlet receives air from the throttle body 104, as previously mentioned. The second supercharger intake housing inlet 134 (FIG. 17) is in fluid communication with the exhaust gas recirculation system 308 to receive exhaust gases therefrom. These exhaust gases enter the supercharger intake housing 106 and flow through the remainder of the air intake system 100 to be combusted once again in the combustion chambers 62.

The supercharger intake housing 106 is connected, as the name suggests, to the supercharger 108. The supercharger 108 pressurizes the air coming from the supercharger intake housing 106 to improve the performance of the engine 10. Once the air is pressurized, it enters the supercharger outlet 136. The supercharger 108 is a twin-screw supercharger which is driven by gears by the counter-balance shaft 802, as will be explained in greater detail below with respect to the internal gearing system 800.

Since the supercharger 108 is driven by the counter-balance shaft 802, the rate at which the supercharger 108 pressurizes the air is directly proportional to the speed of the engine 10. However, under certain conditions, it may be desirable to reduce the pressure of the air entering the engine 10. For this reason, an air bypass passage 110 allows air in the supercharger intake housing 106 to bypass the supercharger 108 and enter the supercharger outlet 136 directly. The quantity of air which bypasses the supercharger 108 is controlled by a bypass valve (not shown) disposed inside the air bypass passage 110. The bypass valve is actuated by a bypass valve actuator 138. The bypass valve actuator 138 is an electric motor that receives control signals as to the desired position of the bypass valve from the electronic control unit (ECU) 702.

Figure 18:
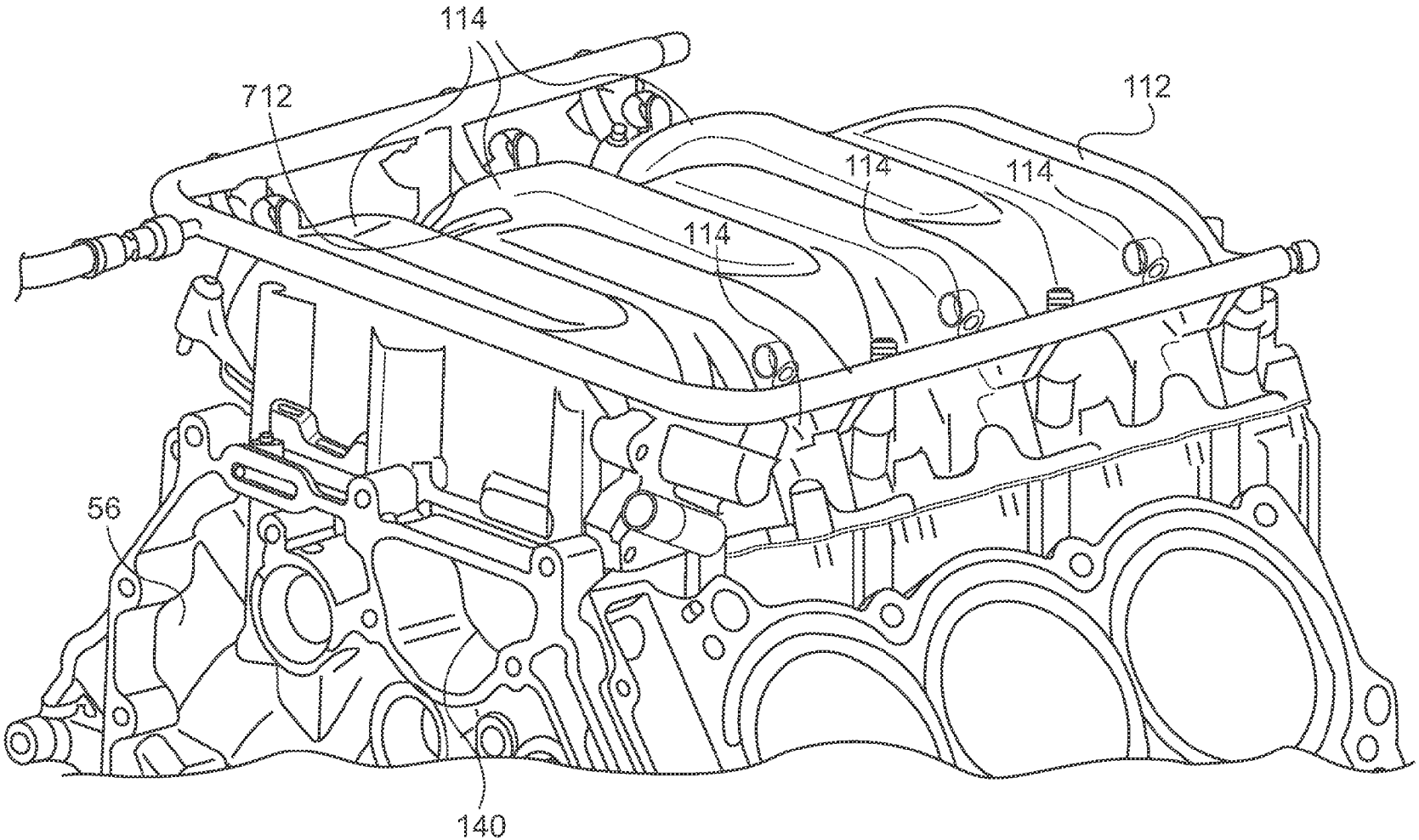
FIG. 18 is a perspective view, taken from a front, left side, of the air intake manifold mounted onto the cylinder block of the engine of FIG. 6.

The supercharger outlet 136 is connected to the cylinder block 56 so as to fluidly communicate with the cylinder block air inlet 140 (FIG. 18). Air passes through the cylinder block air inlet 140 to enter the volume 142 (FIG. 19) formed between the cylinder block 56 and the air intake manifold 112. It is contemplated that the cylinder block air inlet 140 could extend inside volume 142 for acoustic and performance tuning, should it be required. Having the supercharger 108 communicating air through a side of the volume 142 permits the supercharger 108 to be located beside the air intake manifold 112 so as to not extend above the air intake manifold 112. This contributes to the relatively short height of the engine 10.

Figure 19:
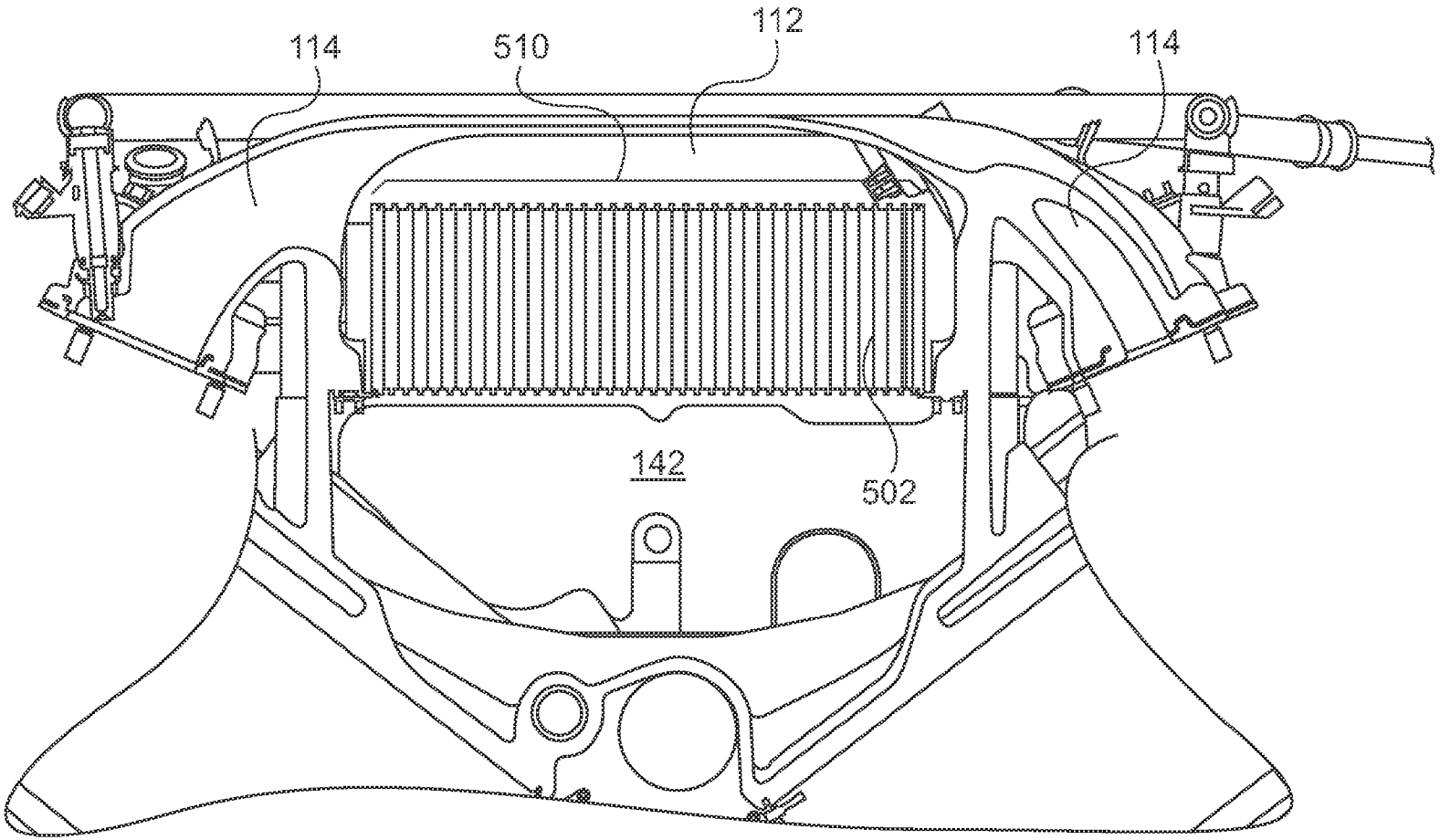
FIG. 19 is a lateral cross-section of the air intake manifold and cylinder block of FIG. 18.
Figure 20:
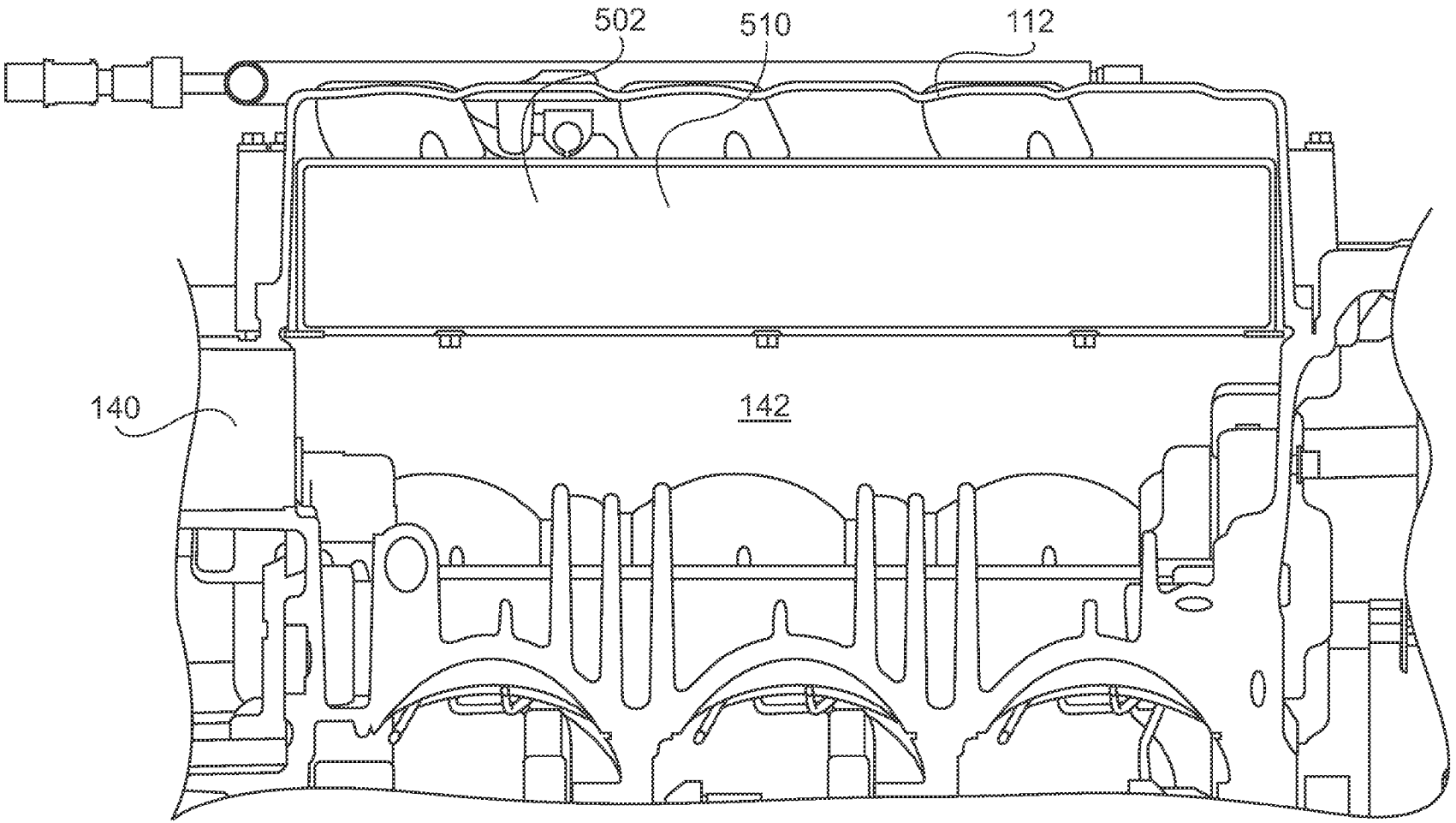
FIG. 20 is a longitudinal cross-section of the air intake manifold and cylinder block of FIG. 18.

As seen in FIGS. 19 and 20, the air intake manifold 112 is attached to the top portion of the cylinder block 56, thus forming the volume 142 therebetween. An intercooler 502 is attached to the air intake manifold 112 so that the two can be attached to the top portion of the cylinder block 56 as a unit (see FIG. 17). The intercooler 502 is present to cool the air which while being pressurized by the supercharger 108, also gets heated. This improves the efficiency of the engine 10.

The intercooler 502 consists of a plurality of vertical plates 510 aligned with a longitudinal axis of the engine 10. The air flows up through the plates 510 which take away the heat from the air. Coolant from the closed-loop cooling system 500 is circulated transversely to the plates 510 to remove the heat accumulated in the plates 510. Once the air passes the intercooler 502, it enters the various intake runners 114 to finally enter the intake passages 116 and combustion chambers 62 where it will be mixed with fuel to be combusted, thus powering the engine 10.

Figure 21:
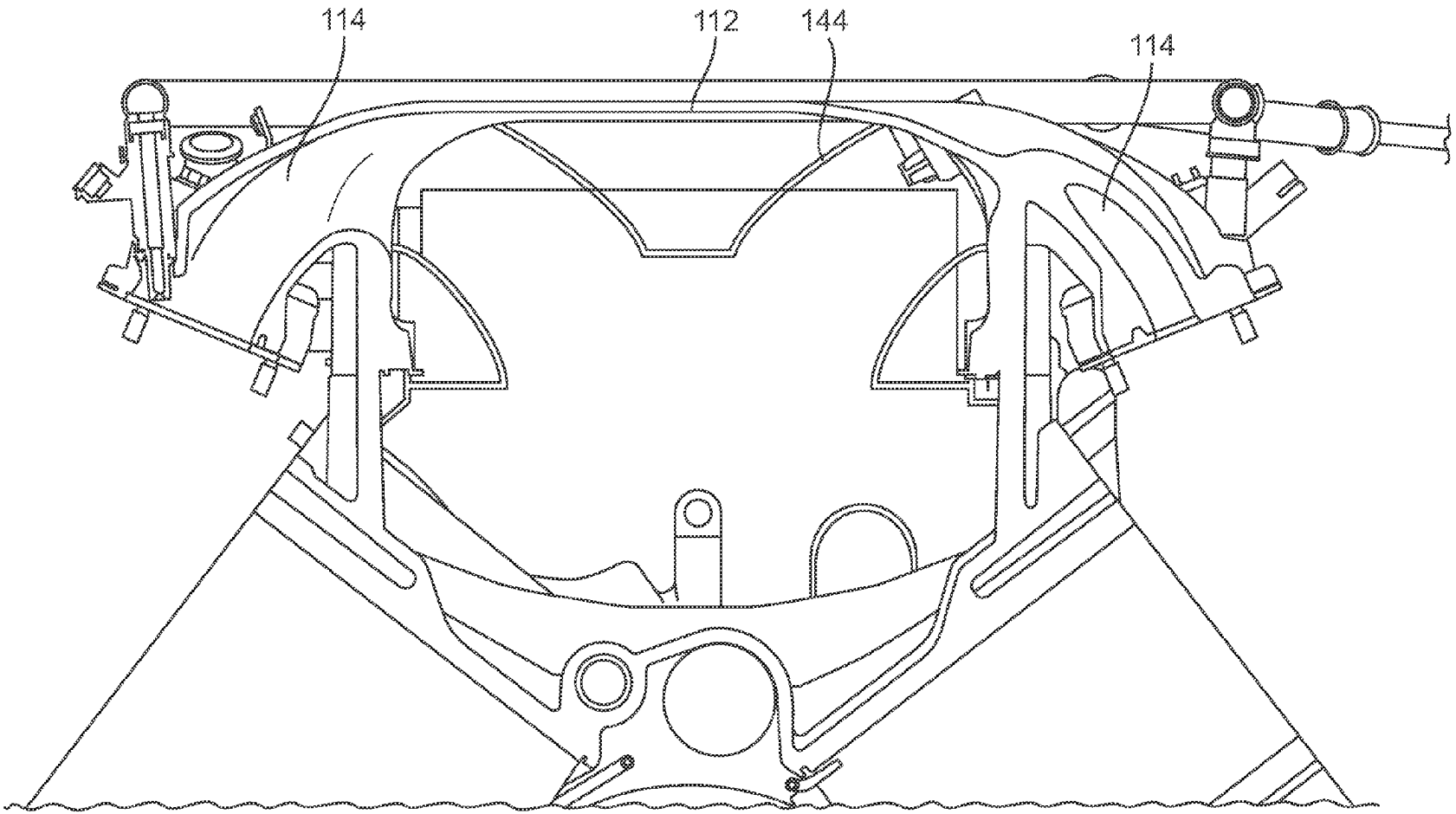
FIG. 21 is a lateral cross-section of an alternative embodiment of the air intake manifold and cylinder block of FIG. 18.

A naturally aspirated version of the engine 10 is also contemplated. In this version, there would be no supercharger 108. Instead, the throttle body 104 would fluidly communicate directly with the cylinder block air inlet 140 to then enter the volume 142. Since there is no supercharger 108, the intercooler 502 is no longer necessary. An air intake manifold adapter 144 is attached to the air intake manifold 112 in its place, as seen in FIG. 21. The air intake manifold adapter 144 lengthens each intake runner 114 to make them more effective in view of the reduced air pressure.

Fuel System

Figure 22:
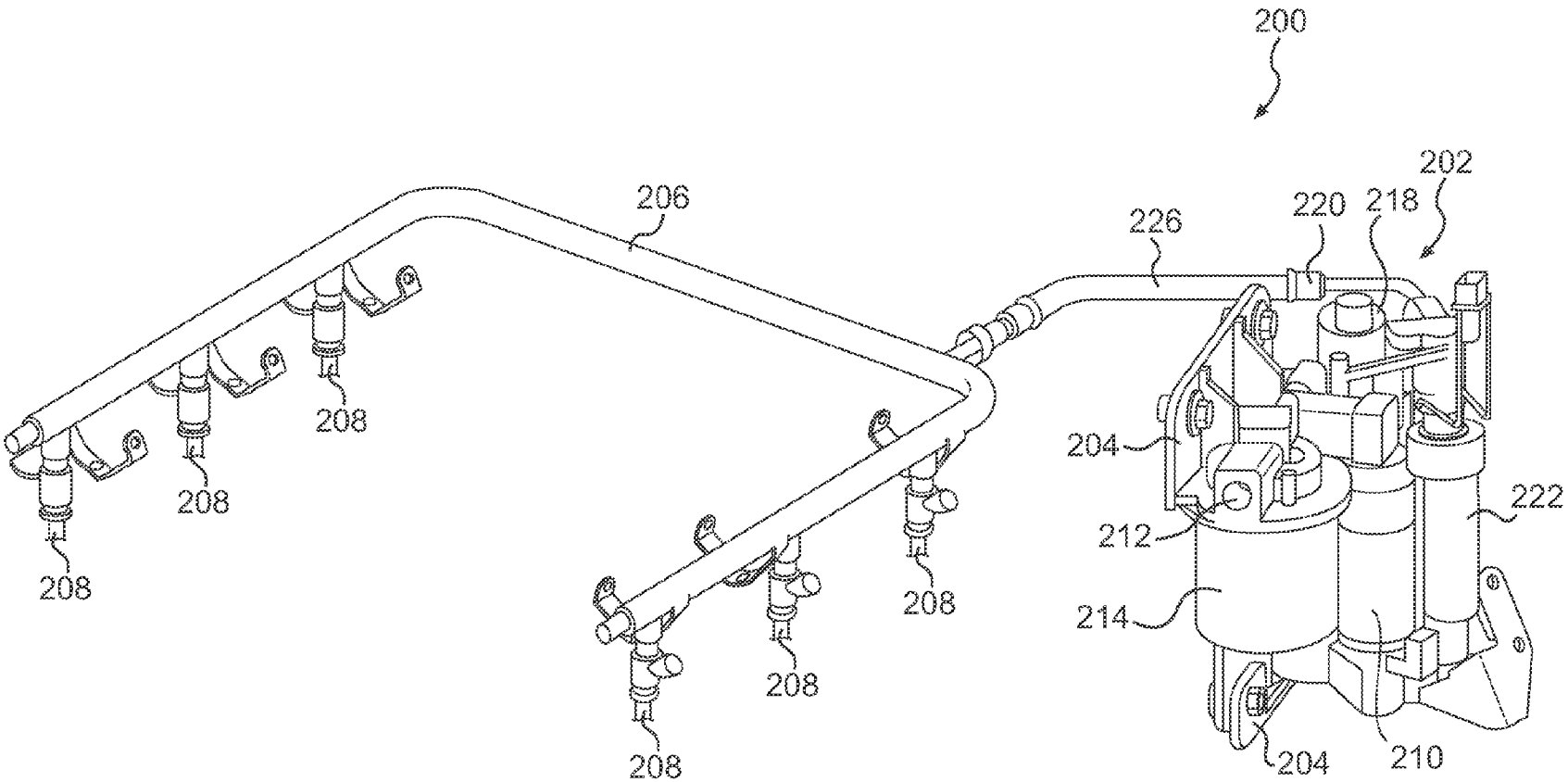
FIG. 22 is a perspective view of a fuel system of the engine of FIG. 6.
Figure 23:
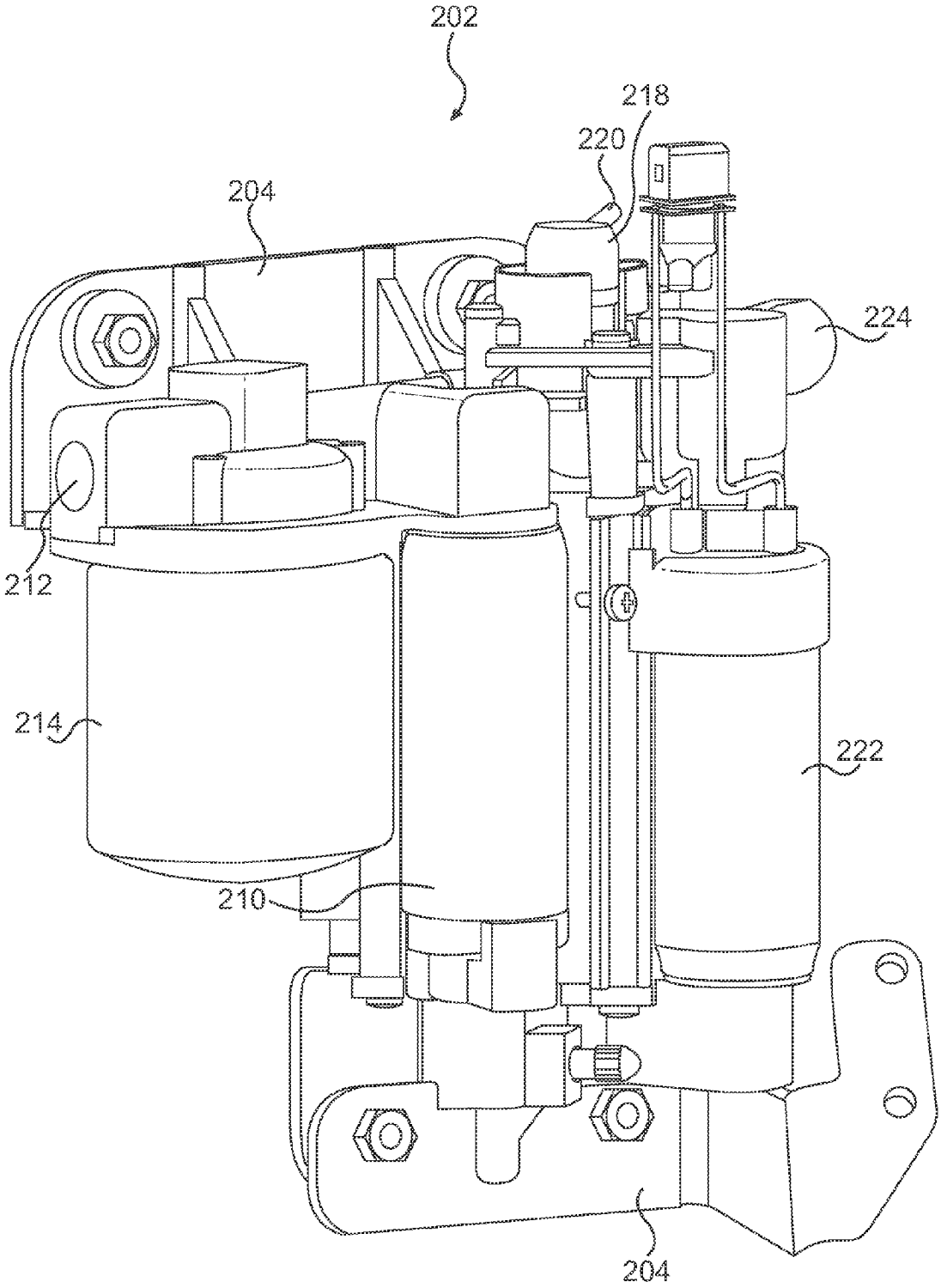
FIG. 23 is a front perspective view of a fuel pumping unit of the fuel system of FIG. 22.
Figure 24:
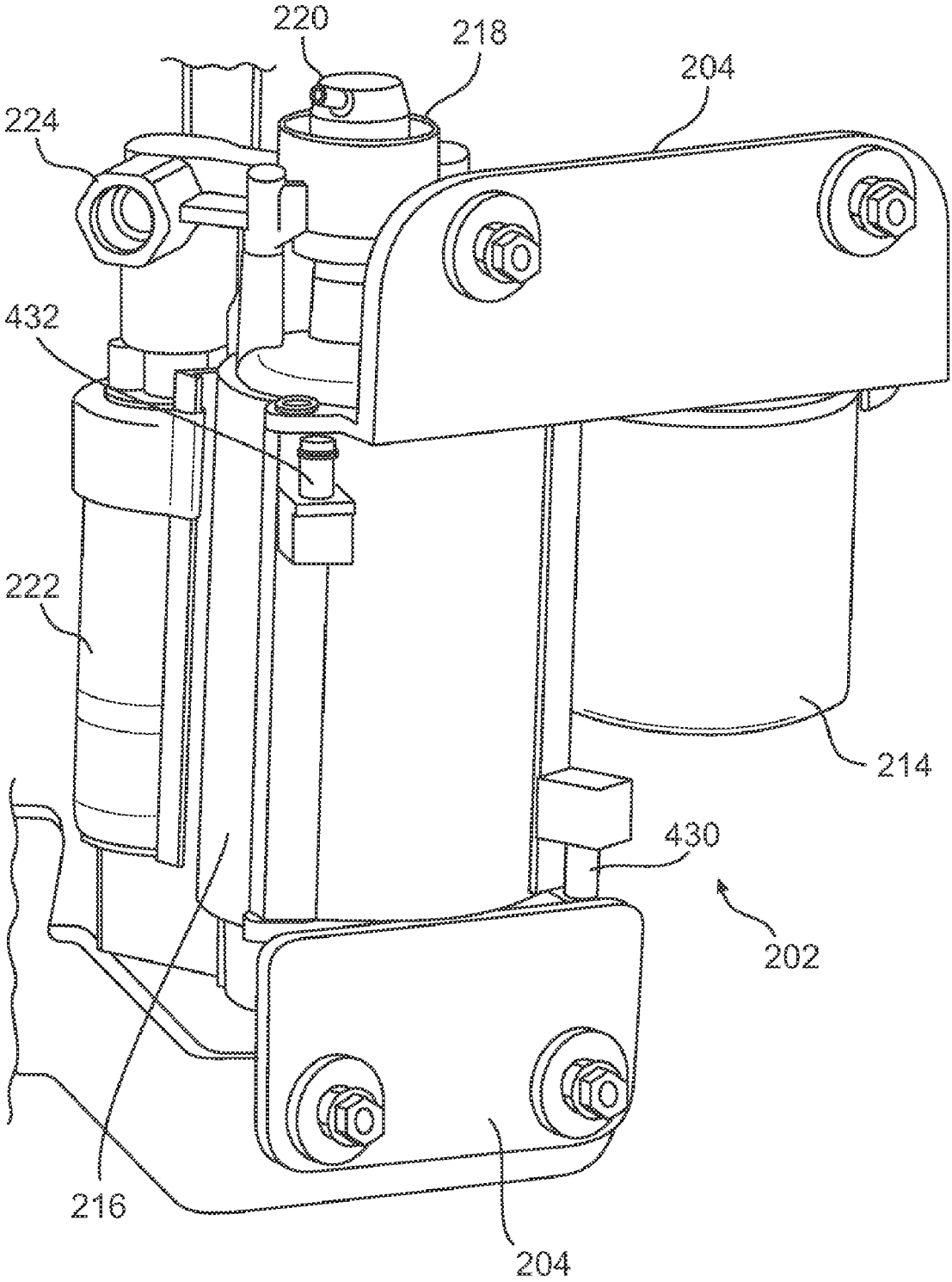
FIG. 24 is a rear perspective view of a fuel pumping unit of the fuel system of FIG. 22.

Turning now to FIGS. 22 to 24, the fuel system 200 has two main components: the fuel pumping unit 202 and the fuel rail 206. A suction pump 210 of the fuel pumping unit pumps the fuel from the fuel tank (not shown). From the fuel tank, the fuel enters the fuel pumping unit 202 at the inlet 212. It then runs through the fuel filter 214 which filters out impurities that may be present in the fuel. The fuel then goes through the fuel suction pump 210 to a reservoir 216. The reservoir 216 is associated with a pressure regulator 218. The pressure regulator 218 communicates with the air intake manifold 112 via a line (not shown) connected to connector 220. The fuel pressure regulator 218 uses the air pressure in the air intake manifold 112 as a reference pressure to regulate the fuel pressure. Fuel is then pumped from the reservoir 216 by a high pressure fuel pump 222 to the outlet 224 of the fuel pumping unit 202. Fuel then flows from the outlet 224 to the fuel line 226. From there, fuel finally flows to the fuel rail 206 and the fuel injectors 208, as previously mentioned.

Exhaust System

Figure 25:
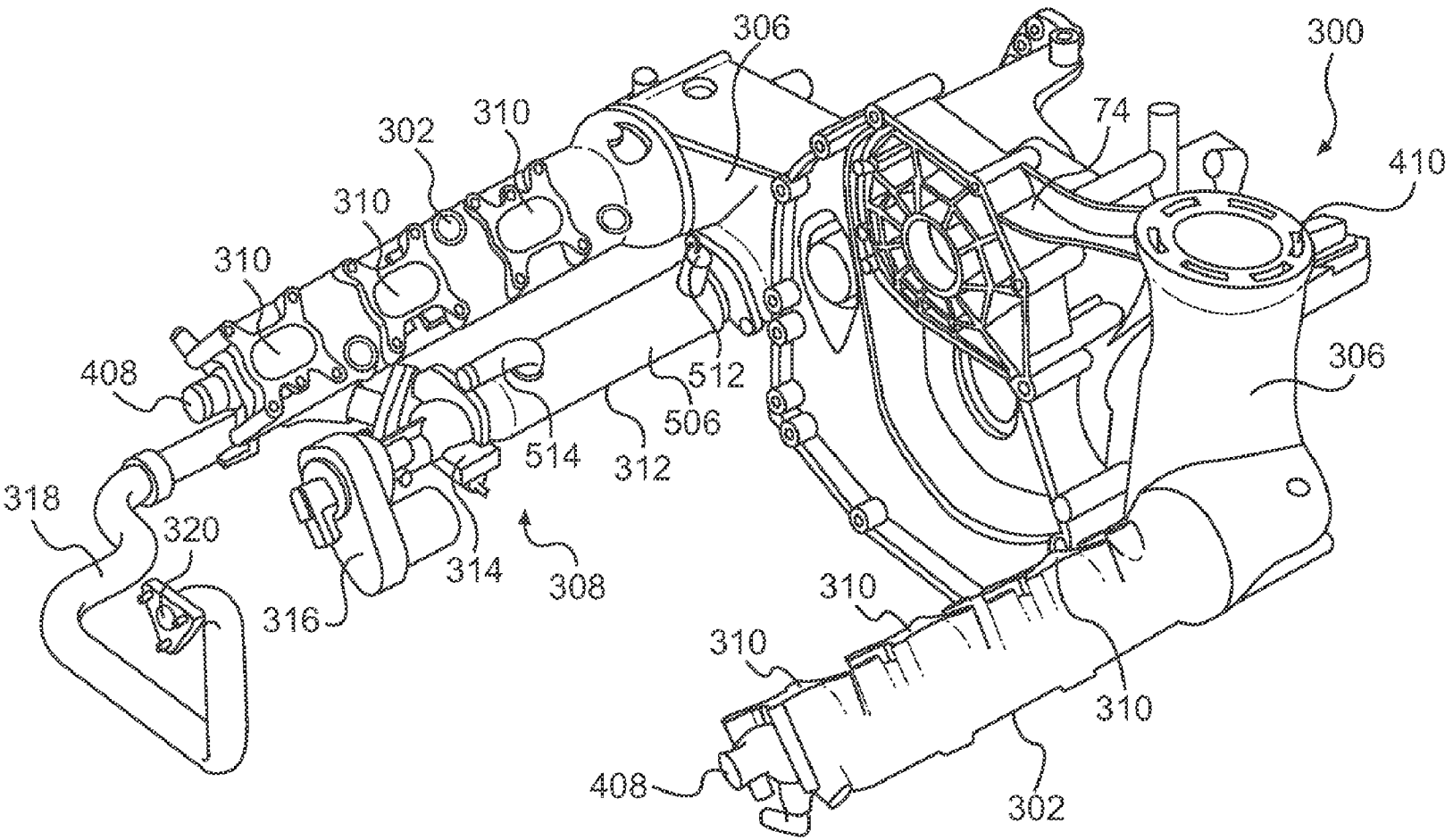
FIG. 25 is a perspective view of an exhaust system of the engine of FIG. 6.

As seen in FIG. 25, the exhaust system 300 has a pair of exhaust manifolds 302. One exhaust manifold 302 is provided per cylinder bank 52. Each exhaust manifold 302 has three exhaust manifold inlets 310. Each exhaust manifold inlet 310 is associated with the exhaust passages 304 of one of the three cylinders 54 of the corresponding cylinder bank 52. The exhaust manifolds 302 each have a water jacket 406 (FIG. 26), having an inlet 408, through which water is circulated, as will be described in greater detail below with respect to the open-loop cooling system 400. Cooling the exhaust gases reduces the formation of oxides of nitrogen in the exhaust gases which are harmful to the environment.

Figure 10:
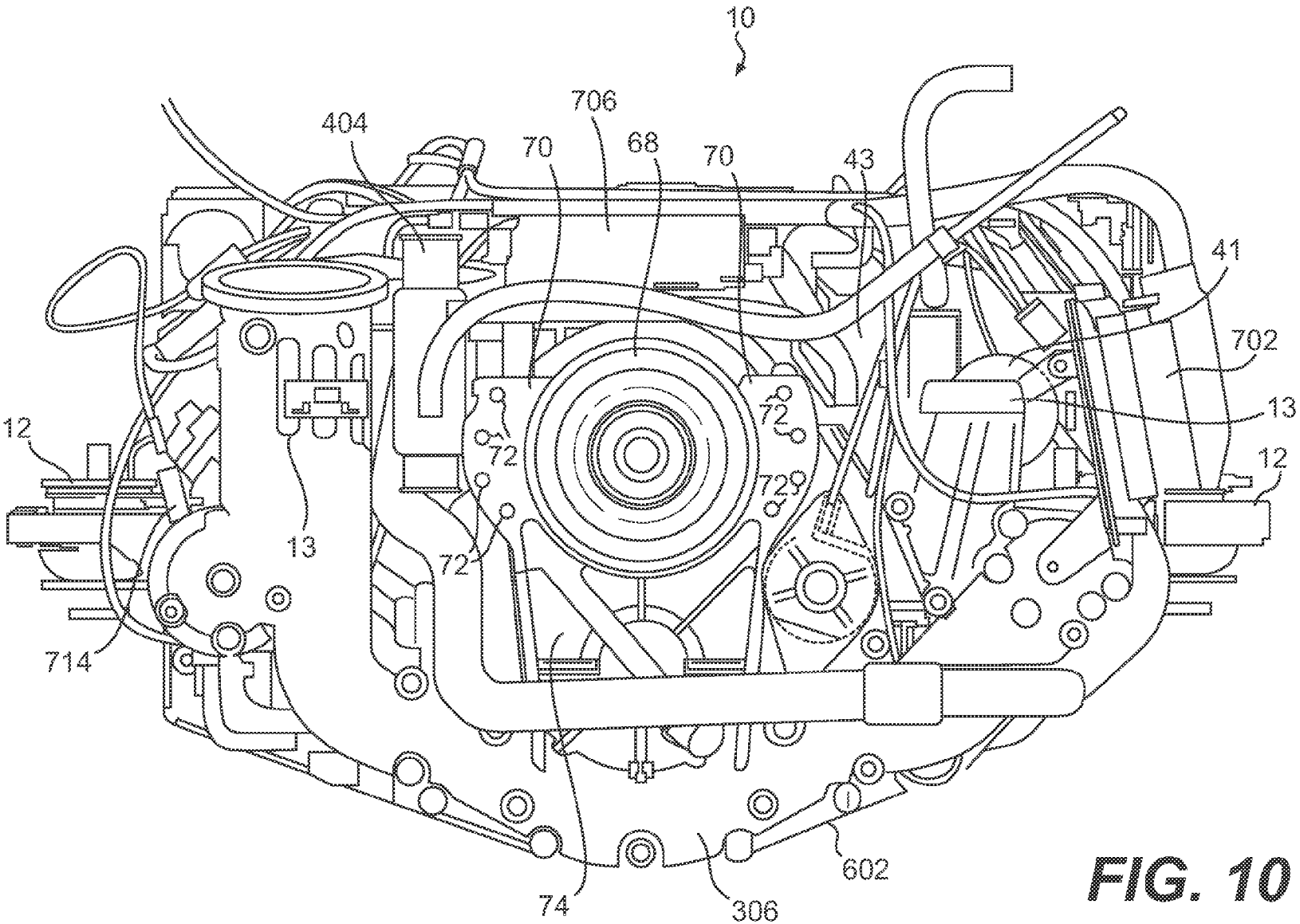
FIG. 10 is a rear elevation view of the engine of FIG. 6.
Figure 11:
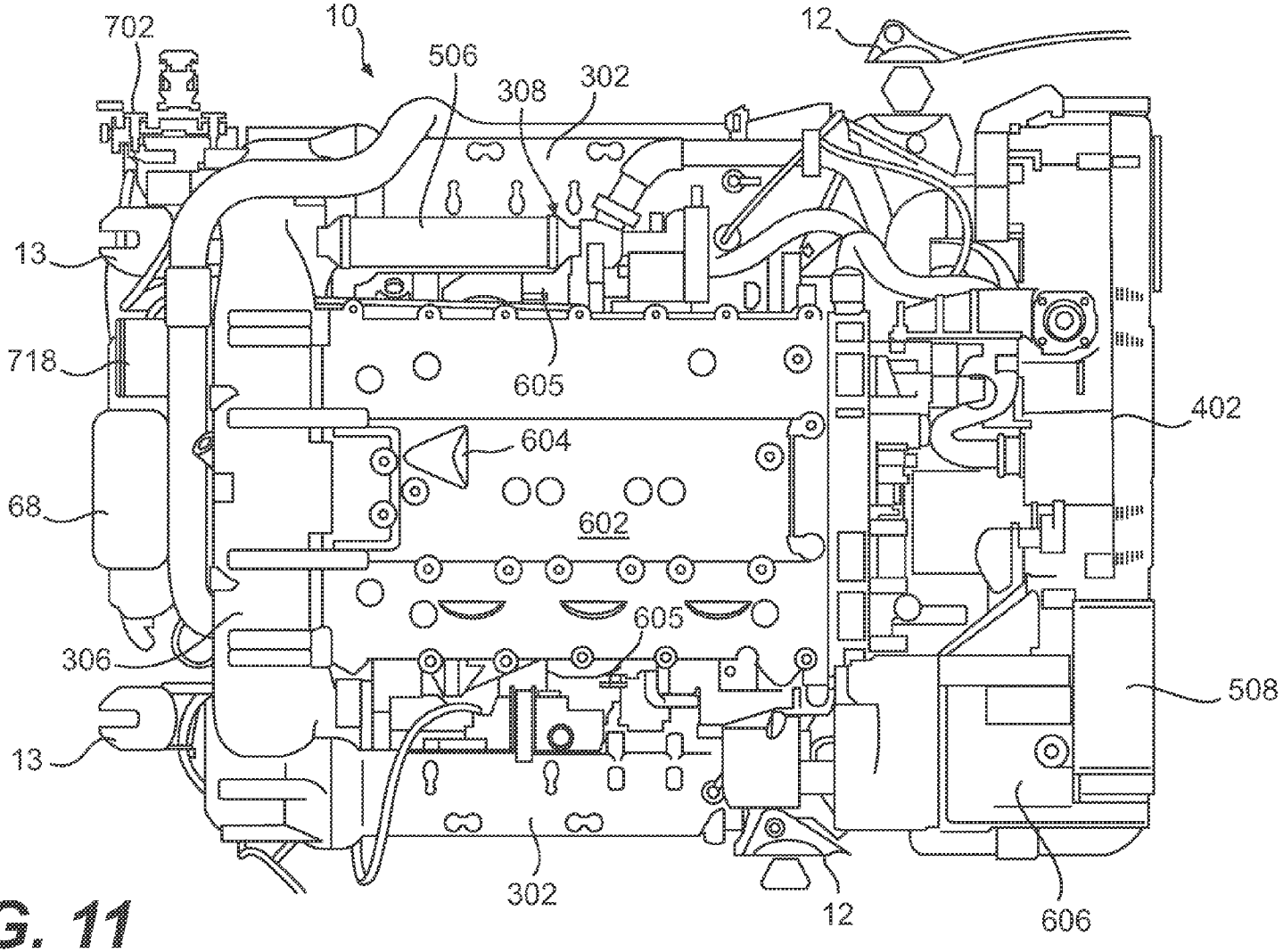
FIG. 11 is a bottom plan view of the engine of FIG. 6.

Each of the exhaust manifolds 302 fluidly communicates with a different end, located on either side of the engine 10, of the exhaust collector 306. The exhaust collector 306 is integrally formed with the flywheel cover 74 to reduce the number of parts, as best seen in FIG. 10. The exhaust collector 306 is shaped so as to follow a lower profile of the engine 10 so as to take as little space as possible. For the same reasons as those mentioned above with respect to the exhaust manifolds 302, the exhaust collector 306 also has a water jacket 410. The water jacket 410 of the exhaust collector 306 fluidly communicates with the water jacket 406 of the exhaust manifolds 302, as will be described in greater detail below with respect to the open-loop cooling system 400.

As explained above, the exhaust collector 306 is connected to the exhaust pipe 14 which then extends through the transom 30 and inside the drive unit 40. The exhaust gases then travel through the drive unit 40 to finally go in the water by going above or though the propeller.

The exhaust system 300 has an exhaust gas recirculation (EGR) system 308. The EGR system 308 takes a portion of the exhaust gases from the exhaust collector 306 and reintroduces them in the air intake system 100 at the second supercharger intake housing inlet 134 so as to dilute the air/fuel mixture being fed to the combustion chambers 62. Doing this reduces the combustion temperature which helps to control the formation of oxides of nitrogen in the exhaust gases.

The EGR system 308 has a first EGR tube 312 connected to the exhaust collector 306. The first EGR tube has an exhaust cooler 506 in the form of a water jacket, having an inlet 512 and an outlet 514, which is part of the closed-loop cooling system 500 described in greater detail below. This cooling of the gases being recirculated by the EGR system 308 permits the introduction of a greater mass of exhaust gases into the air intake system 100. An EGR valve 314 controls the flow of recirculated gases to the air intake system 100. At engine speeds at or below idle, the EGR valve 314 is normally closed. The EGR valve 314 is actuated by an EGR valve actuator 316. The EGR valve actuator 316 is a solenoid actuator that receives control signals to open or close the EGR valve 314 from the electronic control unit (ECU) 702. A second EGR tube 318 fluidly communicates with the EGR valve 314 at one end and with the EGR system outlet 320 at the outer. The EGR system outlet 320 is connected to the second supercharger intake housing inlet 134.

Open-Loop Cooling System

Figure 26:
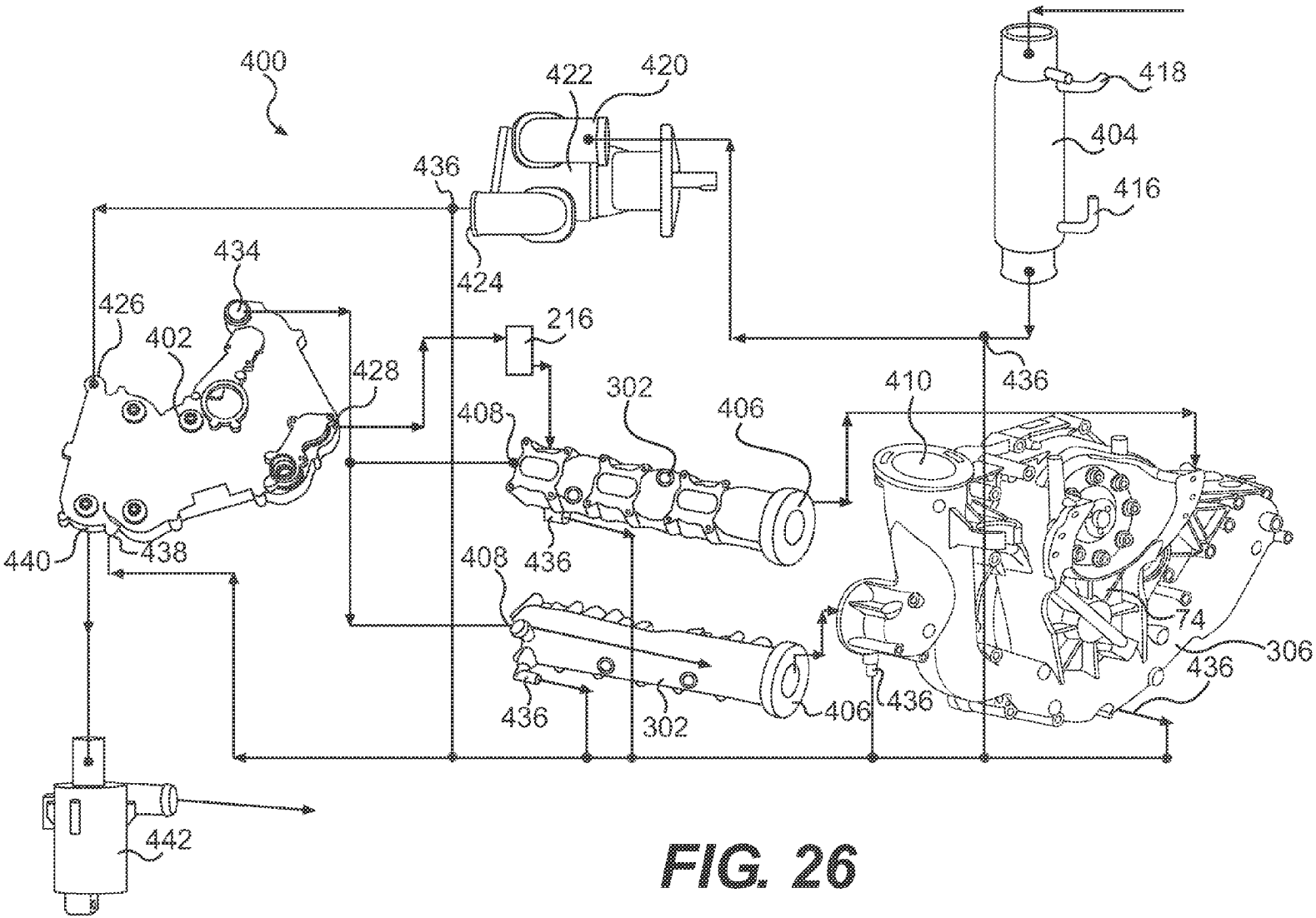
FIG. 26 is a schematic representation of an open-loop cooling system of the engine of FIG. 6.

The open-loop cooling system 400, schematically shown in FIG. 26, uses water from the body of water in which the boat sits to cool some of the elements of the engine 10. Water first enters the water inlets 412 (FIGS. 3 and 4) located on either side of the drive unit 40. A pump (not shown) driven by the propeller shaft 50 pumps the water up through the drive unit 40, through the transom 30, to a water intake pipe 414 (FIG. 4) located inside the hull 20. The pump is preferably an impeller pump disposed on the propeller shaft 50 so as to rotate therewith.

The water intake pipe 414 is connected to the hydraulic fluid cooler 404. Water flows from the intake pipe 414 through the center of the hydraulic fluid cooler 404. Hydraulic fluid from the hydraulic unit 42 enters the hydraulic fluid cooler 404 through an inlet 416 located near the bottom of the hydraulic fluid cooler 404, flows upwardly inside a fluid jacket on the outside of the hydraulic fluid cooler 404 to be cooled, exits the hydraulic fluid cooler 404 through outlet 418, enters the hydraulic fluid reservoir 43, and is finally pumped back to the hydraulic unit 42 by hydraulic pump 41. Since the hydraulic fluid runs upwardly through the hydraulic fluid cooler 404 while the cooling water runs downwardly through the center of the hydraulic fluid cooler 404, the hydraulic fluid cooler 404 is what is known as a counterflow heat exchanger. This type of heat exchanger provides a better heat exchange, and thus cools the hydraulic fluid better than a parallel flow heat exchanger where the hydraulic fluid and water would both run in the same direction. However, it is contemplated that a parallel flow heat exchanger or other types of heat exchanger could be used.

From the hydraulic fluid cooler 404, the cooling water enters an inlet 420 of water pump 422. The water pump 422 is located on the front of the engine 10 (see FIG. 7) and is driven by the camshaft 804 of the left cylinder bank 52. It is contemplated that the water pump 422 could also be driven by the camshaft 806 of the right cylinder bank 52 on the back of the engine 10. Cooling water exits the water pump 422 through outlet 424 and then enters the heat exchanger box 402.

The cooling water enters the heat exchanger box 402 by inlet 426. The cooling water flows through the heat exchanger box 402 and acts as the cooling fluid for the heat exchangers 520, 522, 524, and 526. The heat exchangers 520, 522, 524, 526 are located in the heat exchanger box 402 for cooling the coolant used in the closed-loop cooling system 500, as will be described in greater detail below.

A portion of the cooling water then exits the heat exchanger box 402 via outlet 428. From outlet 428, the water flows to the fuel reservoir 216 of fuel pumping unit 202. The cooling water enters a water jacket disposed around the fuel reservoir 216 by inlet 430 (FIG. 24) to cool the fuel contained in the fuel reservoir 216. The cooling water then exits the water jacket by outlet 432 (FIG. 24) and enters the cooling jacket 406 of the exhaust manifold 302 located on the right side of the engine 10.

The majority of the cooling water exits the heat exchanger box 402 via outlet 434. From outlet 434 the cooling water is divided and flows to each inlet 408 of the water jackets 406 of exhausts manifolds 302. Water flows through the water jackets 406 and enters the water jacket 410 of the exhaust collector 406. From there, the cooling water flows through a water jacket of the exhaust pipe 14 and is injected in the exhaust gases downstream of the gooseneck formed in the exhaust pipe 14. Finally, the cooling water is returned to the body of water with the exhaust gases. As previously mentioned, cooling the exhaust gases helps controlling the formation of oxides of nitrogen in the exhaust gases.

Figure 30:
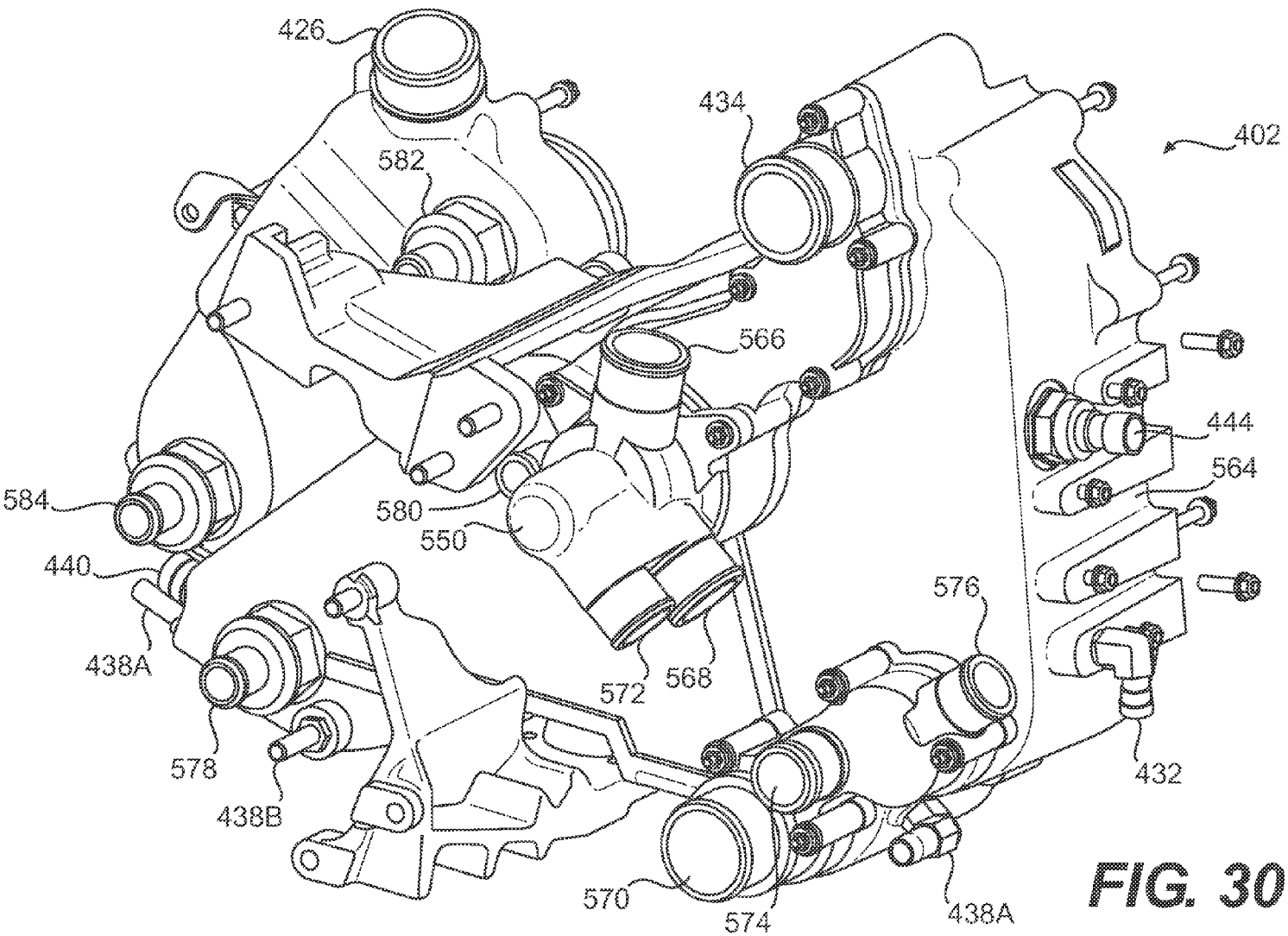
FIG. 30 is a perspective view, taken from a rear, left side, of the heat exchanger box of FIG. 28, with the cover removed.

A plurality of drainage points 436 are provided in the open-loop cooling system 400. The drainage points 436 are provided in points where water would otherwise accumulate in the open-loop cooling system 400 when the engine is stopped, which would cause corrosion. The drainage points 436 are, for example, located at the lowest point of the water tube between the hydraulic fluid cooler 404 and the water pump 422 and at the lowest points of the water jackets 406, 410 of the exhaust manifolds 302 and exhaust collector 306. The drained water enters the heat exchanger box 402 at the drained water inlet 438 (FIG. 30). The water is then drained from the heat exchange box 402 through drain 440 by being pumped by drain pump 442. The drain pump 442 pumps the water to the exhaust pipe 14, and from there the water flows to the body of water. The drain pump 442 is preferably electric and pumps water out of the open-loop cooling system 400 for a certain period of time after the engine 10 is stopped.

Closed-Loop Cooling System

Figure 27:
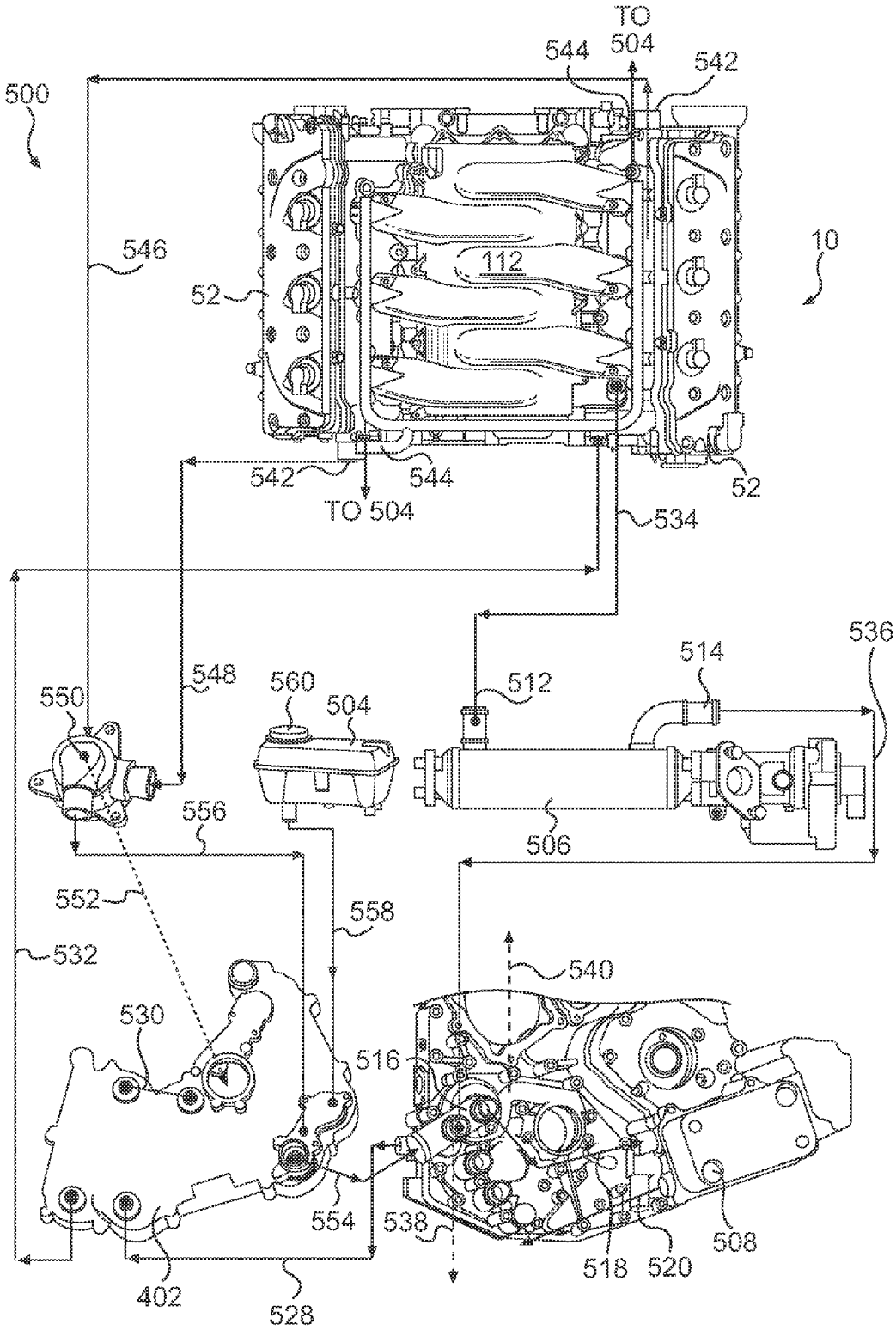
FIG. 27 is a schematic representation of a closed-loop cooling system of the engine of FIG. 6.

As seen in FIG. 27, the closed-loop cooling system 500 is used to cool the cylinder block 56, cylinder head assemblies 58, the EGR system 308, the oil, and the intake air. The coolant used in the closed-loop cooling system 500 is preferably fresh water, however it is contemplated that other coolants, such as glycol, could be used as well.

A coolant pump 516 is disposed on the crankcase 64 behind the heat exchanger box 402. The coolant pump 516 is a rotary pump driven by the crankshaft 66 through a system of gears, as will be described in greater detail below. The coolant pump 516 pumps the coolant to a plurality of locations around the engine 10.

A first portion of coolant is pumped to the oil cooler 508, via path 518 to cool the engine oil. The oil cooler 508 is a plate-type cooler. From the oil cooler 508, the coolant is returned to the coolant pump 516 via path 520.

A second portion of coolant is pumped to a first heat exchanger 520 via path 528. It flows through the first heat exchanger 520, enters the second heat exchanger 522 via path 530 and flows therethrough. The first and second heat exchanger 520, 522 (FIG. 29) are plate-type heat exchangers disposed inside the heat exchanger box 402. The cooling water of the open-loop cooling system 400 flowing inside the heat exchanger box 402 flows between the plates of the heat exchangers 520, 522, thus cooling the coolant flowing inside the heat exchangers 520, 522.

From the heat exchanger 522, the coolant then flows to the intercooler 502 via path 532. The coolant flows through the intercooler 502 cooling the air flowing between the vertical plates 510 of the intercooler. As previously mentioned, this cools the air that was heated while being pressurized by the supercharger 108. By cooling the air prior to combustion, the performance of the engine 10 is improved.

From the intercooler 502, the coolant flows to the inlet 512 of the exhaust gas cooler 506 via path 534, and flows therethrough. As previously mentioned, cooling the exhaust gases flowing inside the first EGR tube 312 increases the mass of exhaust gases that can be recirculated by the EGR system 308. The coolant then flows out of the exhaust gas cooler 506 through outlet 516 and is returned to the coolant pump 516 via path 536.

A majority of the coolant flows from the pump 516 to the left and right cylinder banks 52 via paths 538 and 540 respectively. From the paths 538, 540, the coolant first flows around the cylinders 54 of the corresponding cylinder bank 52 in passages formed in the cylinder block 56, thus cooling the cylinders 54. The coolant then flows up inside the cylinder head assemblies 58 to cool them. The coolant then flows out of the cylinder head assemblies 58 via an engine coolant outlet 542 on each cylinder bank 52. A vent 544 is provided at the highest point of the coolant passage inside each cylinder head assembly 58 to prevent the formation of an air barrier which would cause overheating. The air barrier could be formed by coolant which evaporated inside the coolant passage or air bubbles trapped inside the closed-loop system 500 when it is being filled with coolant. The vents 544 fluidly communicate with the coolant reservoir 504 to return the air or coolant vapours thereto.

From the outlets 542 of the left and right cylinder banks 52, the coolant flows via paths 546 and 548 respectively to thermostat 550. When the temperature of the coolant exceeds a predetermined temperature, the thermostat 550 opens and the coolant flows to heat exchangers 524, 526 via path 552. Heat exchangers 524, 526 are connected in parallel, which means that part of the coolant from the thermostat 550 flows through heat exchanger 524 and part of the coolant flows through heat exchanger 526. Heat exchangers 524, 526 are plate-type heat exchangers, like heat exchangers 520, 522, and are disposed inside the heat exchanger box 402. As with heat exchangers 520, 522, the cooling water of the open-loop cooling system 400 flowing inside the heat exchanger box 402 flows between the plates of the heat exchangers 524, 526, thus cooling the coolant flowing inside the heat exchangers 524, 526. From heat exchangers 524, 526, the coolant flows back to the coolant pump 516 via path 554.

When the temperature of the coolant is below the predetermined temperature, such as at engine start-up, the thermostat 550 closes and the coolant bypasses the heat exchangers 524, 526 via path 556 and returns to the pump 516 via path 554.

A coolant reservoir 504 fluidly communicates with the outlet of heat exchanger 526 via path 558. The coolant reservoir 504 contains coolant and adjusts for the expansion of coolant in the closed-loop cooling system 500. A filling opening closed by cap 560 permits for refilling of the closed-loop cooling system 500.

Figure 28:
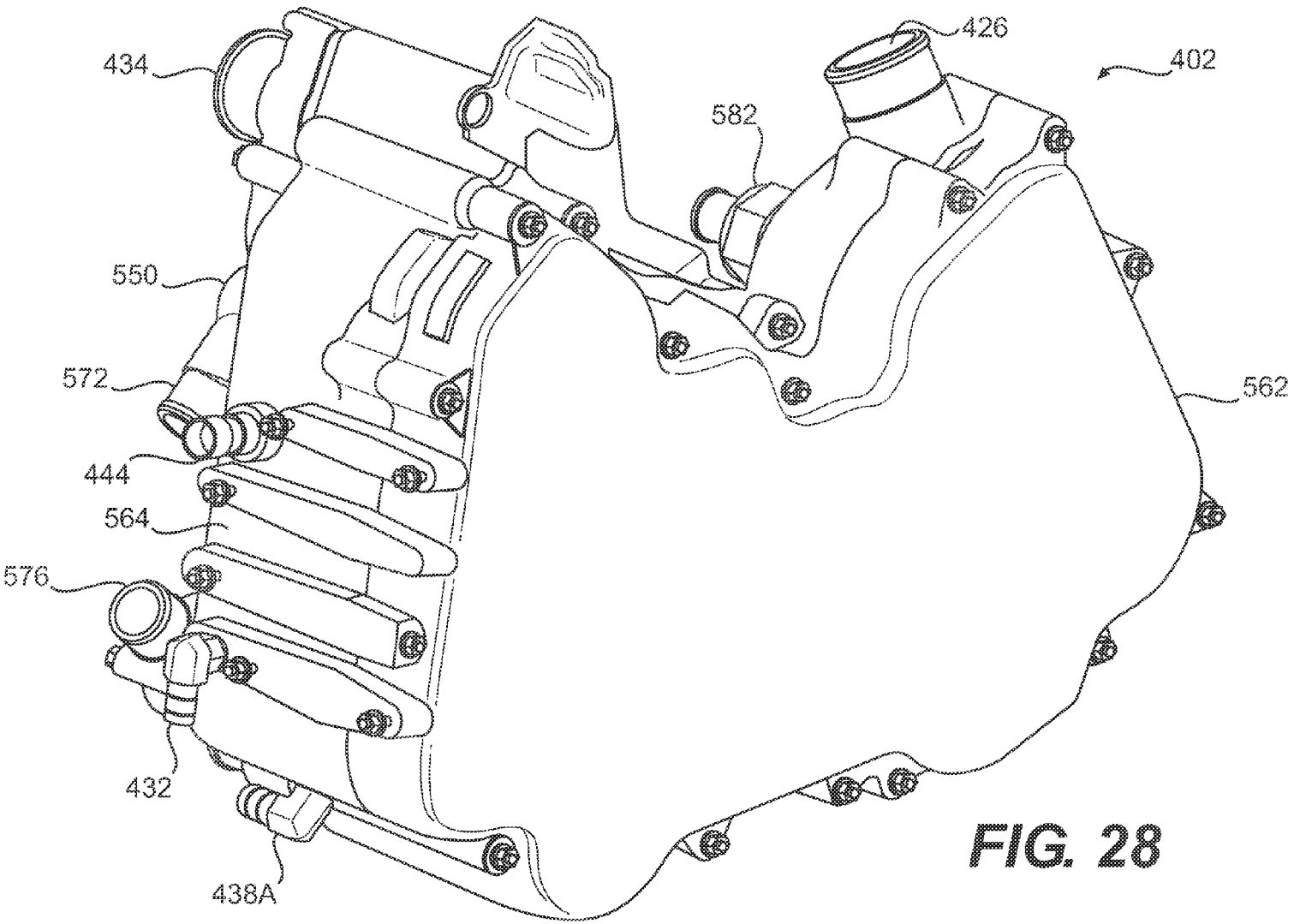
FIG. 28 is a perspective view, taken from a front, left side, of a heat exchanger box of the engine of FIG. 6.
Figure 29:
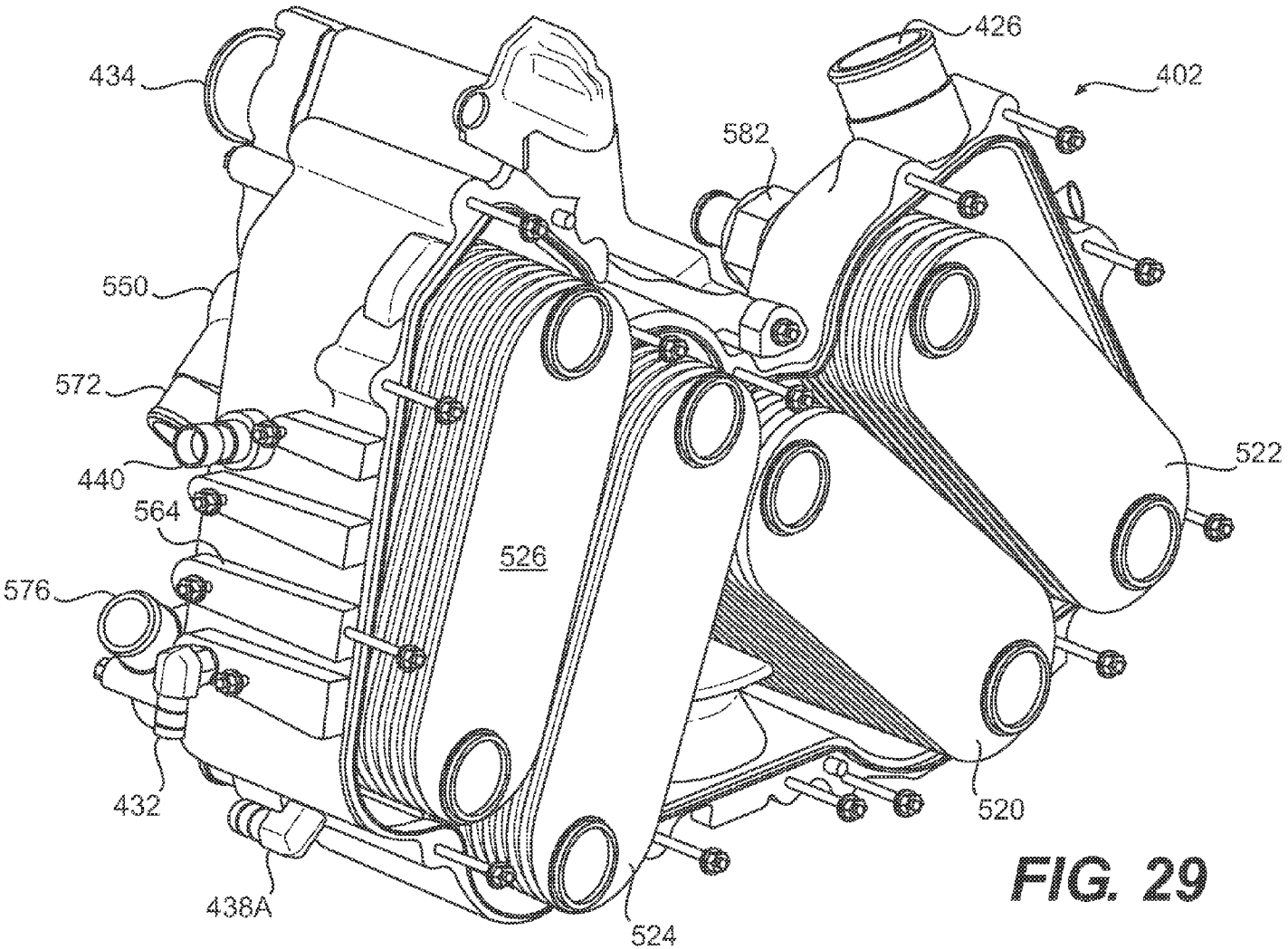
FIG. 29 is a perspective view, taken from a front, left side, of the heat exchanger box of FIG. 28, with the cover removed.

FIGS. 28 to 30 show the details of the heat exchanger box 402. As seen in FIG. 28, the heat exchanger box 402 has a front cover 562 and a back cover 564. The front cover 562 is fastened onto the back cover 564. Since water from the open-loop cooling system 400 flows inside the heat exchanger box 402, the joint between the front and back covers 562, 564 is sealed. This is achieved by placing a rubber seal between the front and back covers 562, 564.

The heat exchangers 520, 522, 524, 526 are supported inside back cover 564, as best seen in FIG. 29. The various inlets and outlets to and from the heat exchanger box 402 and to and from the heat exchangers 520, 522, 524, 526 are also supported by the back cover 564, as best seen in FIG. 30.

As best seen in FIG. 30, the inlet 426 to and the outlet 434 from the heat exchanger box 402 of the open-loop cooling system 400 are disposed on the upper portion of the back cover 564. The water outlet 432 to the fuel reservoir is located on the side of the back cover 564. Drain water inlets 438A receive the drained water from the drainage points 436 located on the exhaust manifolds 302. Drain water inlet 438B receives the drained water from the drainage points 436 located on the exhaust collector 306. The water is drained from the heat exchanger box 402 via drain 440 located at the bottom of the heat exchanger box 402. The drain 440 is fluidly connected to the drain pump 442 as previously mentioned. Water outlet 444 is connected to a water pressure sensor (not shown) which determines the water pressure inside the heat exchanger box 402. A low water pressure inside the heat exchanger box 402 would indicate that the open-loop cooling system 400 is not operating properly.

As best seen in FIG. 30, the thermostat 550 is disposed on the back cover 564 so as to be aligned and in fluid communication with heat exchanger 524. Coolant from the left cylinder bank 52 flowing through path 546 enters the thermostat 550 at inlet 566. Coolant from the right cylinder bank 52 flowing through path 548 enters the thermostat 550 at inlet 568.

When the thermostat 550 is opened, as defined above, coolant flows directly from the thermostat 550 to the heat exchangers 524, 526. From heat exchangers 524, 526, coolant exits through outlet 570 to return to the coolant pump 516 via path 554.

When the thermostat 550 is closed, as defined above, coolant exits the thermostat 550 via thermostat outlet 572, flows through a pipe (not shown), re-enters the heat exchanger box 402 via inlet 574, and then exits through outlet 570 to return to the coolant pump 516 via path 554.

A connector 576 connects the heat exchanger box 402 with the coolant reservoir 504 via path 558.

Coolant from the coolant pump 516 flowing through path 528 enters the first heat exchanger 520 at inlet 578. The coolant then flows out of the first heat exchanger 520 at outlet 580, flows through a pipe (not shown), and enters the second heat exchanger 522 at inlet 582. The coolant flows out of the second heat exchanger 522 at outlet 584 and flows to the intercooler 502 via path 532.

Lubrication System

The lubrication system 600 of the engine 10 is used to lubricate the various internal components of the engine 10, thus preventing wear and excessive heating of these components.

Figure 6:
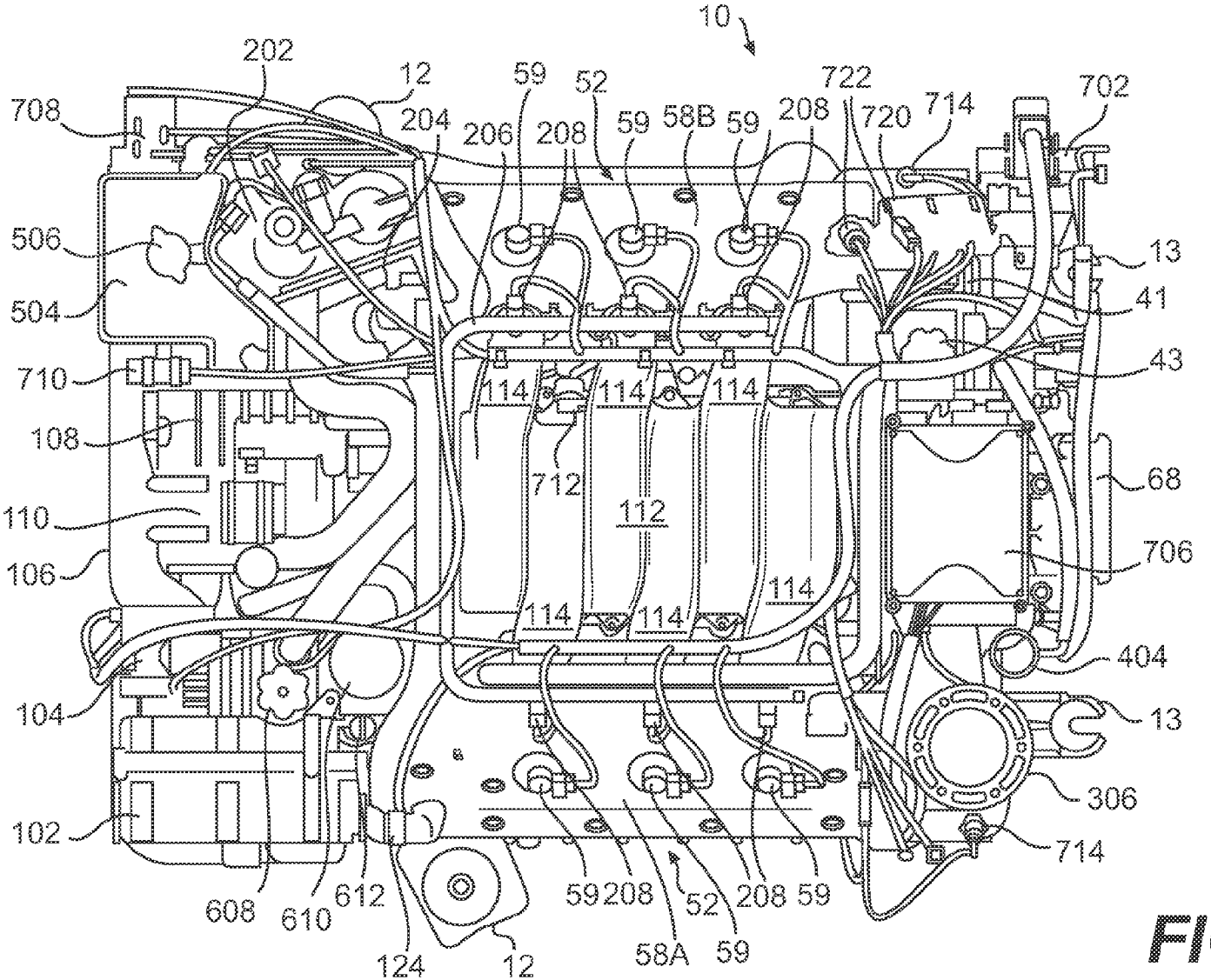
FIG. 6 is a top plan view of an engine in accordance with the present invention.
Figure 7:
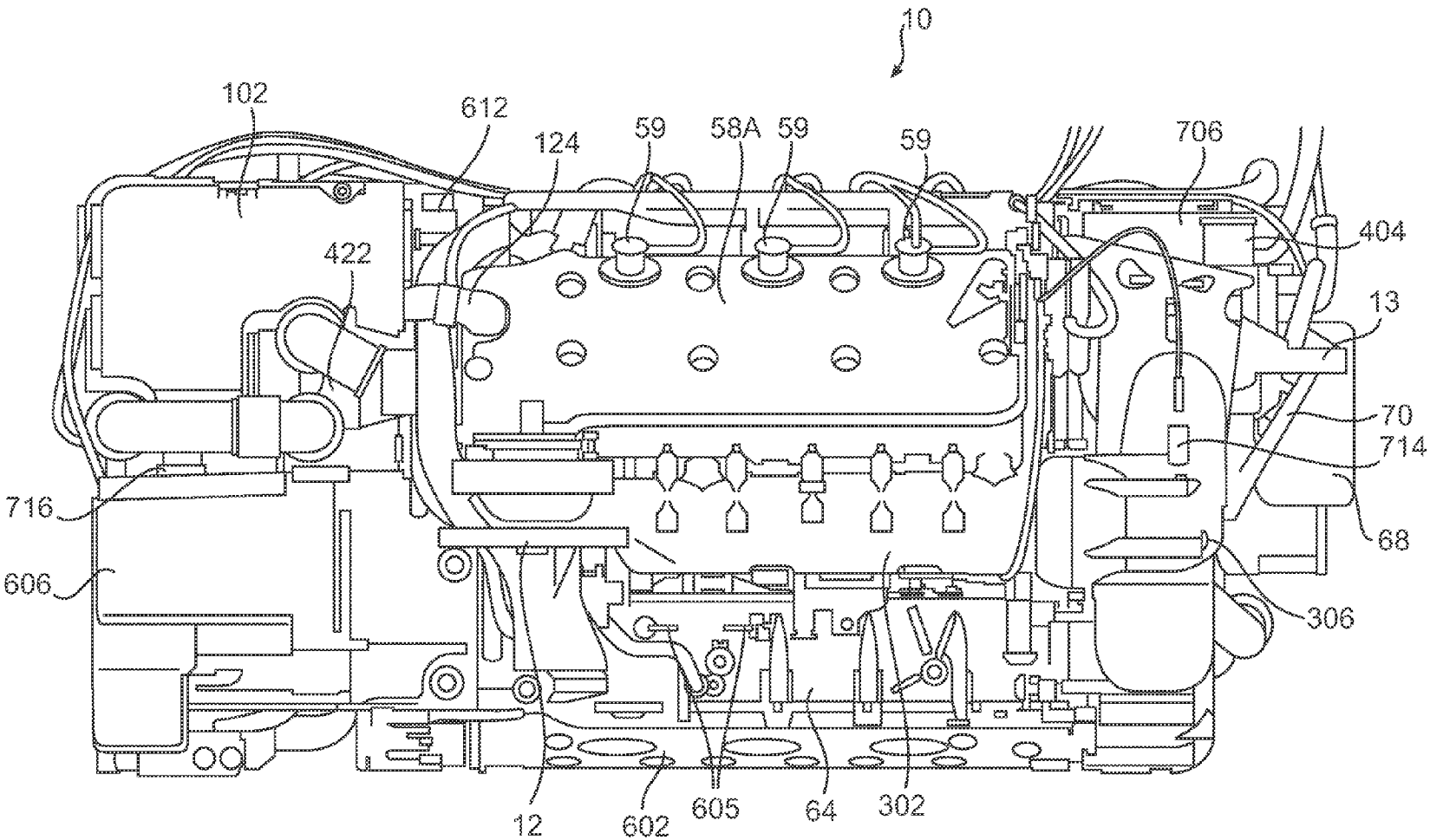
FIG. 7 is a left side elevation view of the engine of FIG. 6.
Figure 31:
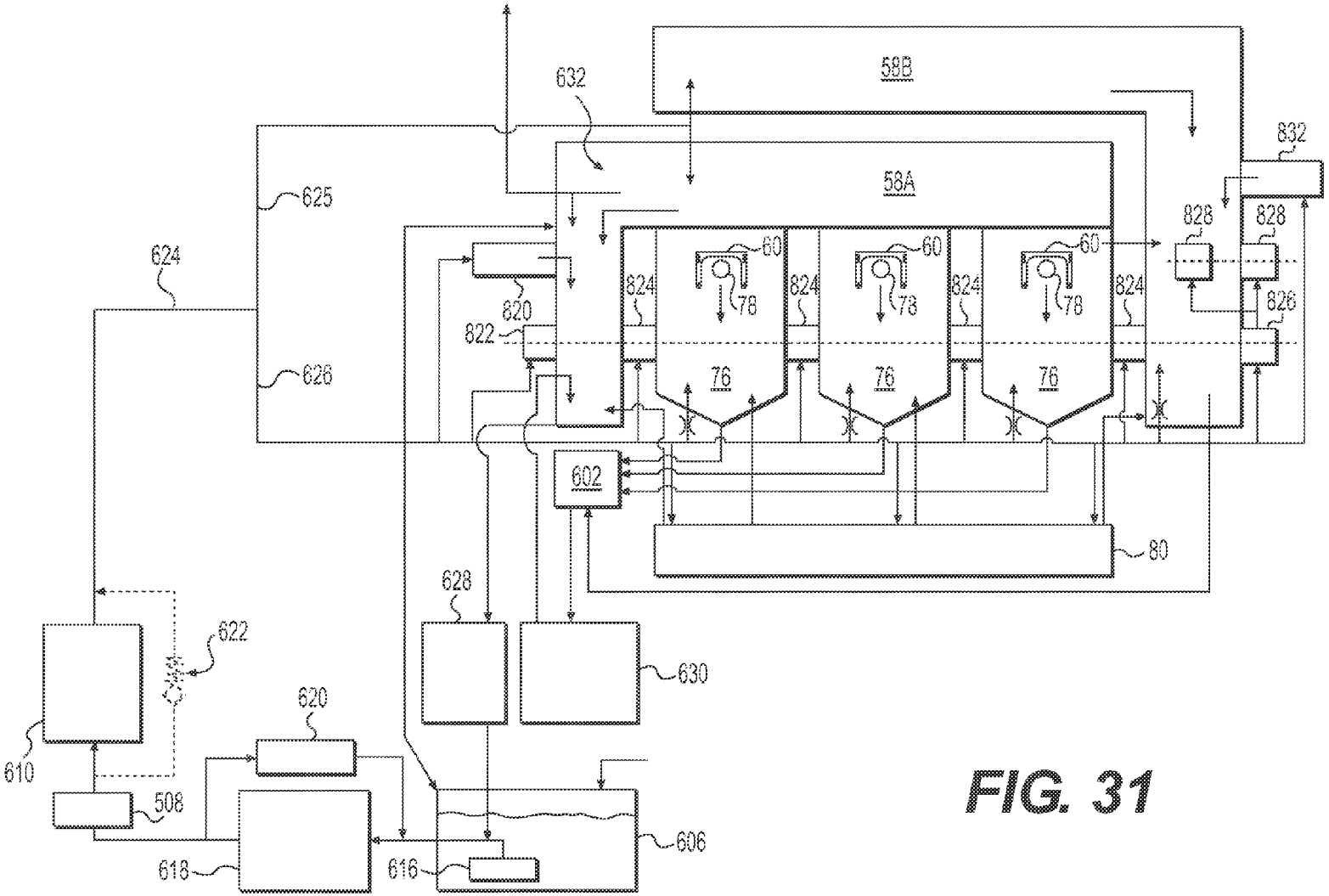
FIG. 31 is a schematic representation of a lubrication system of the engine of FIG. 6.
Figure 32:
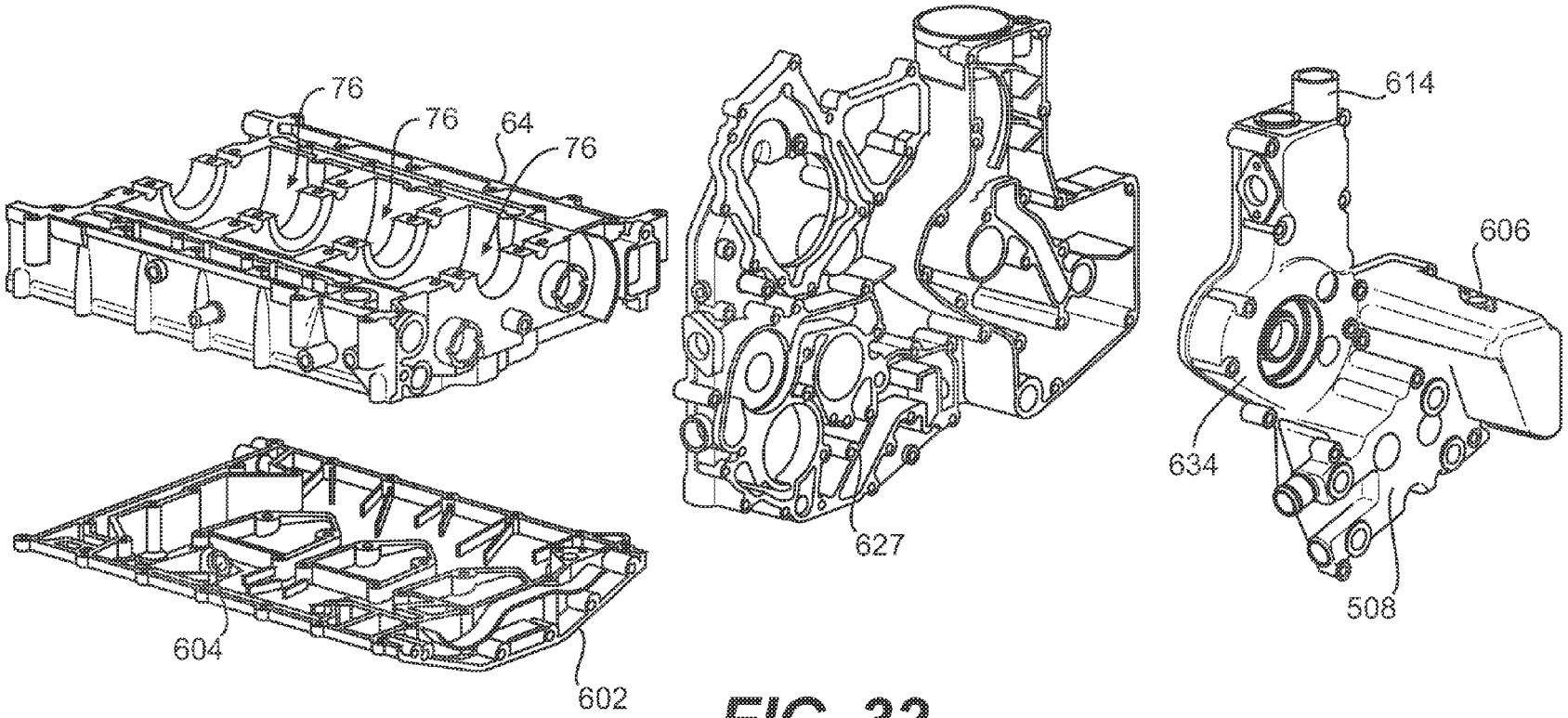
FIG. 32 is an exploded view of an oil pan, crankcase, front engine cover, and oil tank assembly of the engine of FIG. 6.

As seen in FIG. 31, the oil is stored in the oil tank 606. The oil tank 606 can be filled up by pouring oil inside the oil filler neck 614 (FIG. 32). The oil filler neck 614 is closed by oil cap 608 (FIG. 6). The oil is pumped out of the oil tank 606 through a suction screen 616 by oil pump 618. The oil pump 618 is driven by the crankshaft 66 through a system of gears, as will be discussed in greater detail below. The oil pump 618 is what is known as a gear pump. A pressure regulating valve 620 is provided downstream of the oil pump 618. The pressure regulating valve 620 will open to return the oil upstream of the oil pump 618 should the pressure inside the lubrication system 600 become too high.

When going through the engine lubrication system 600, the oil gets heated by the engine. At high temperatures, the viscosity of the oil is reduced which reduces its lubricating properties since it does not adhere to the engine components as well. Therefore, from the oil pump 618, the oil flows through an oil cooler 508. The oil cooler 508 removes at least a portion of the heat that has been accumulated inside the oil from a previous passage through the lubrication system 600, thus maintaining the lubricating properties of the oil. It is contemplated that it may not be necessary to include an oil cooler 508 should the engine 10 not generate sufficient heat to affect the lubricating properties of the oil.

From the oil cooler 508, the oil flows through the oil filter 610. The oil filter 610 filters out debris and impurities from the oil. An oil filter bypass valve 622 may be provided. The oil filter bypass valve 622 would open if oil pressure builds up at the inlet of the oil filter 610, such as if the oil filter becomes clogged, thus permitting oil to continue to flow inside the lubrication system 600. It is contemplated that the oil filter bypass valve 622 could be integrated with the oil filter 610.

From the oil filter 610, the oil flows to the main oil gallery 624, and from there it gets separated into two main paths. The oil flowing through the first main path 625 is further separated between oil flowing to the left cylinder head assembly 58A and the right cylinder head assembly 58B. The oil flowing inside the left cylinder head assembly 58A lubricates the bearings (not shown) of the camshaft 804. From the left cylinder head assembly 58A, the oil flows down inside the front engine cover 627 to lubricate the components found, at least partially, therein. These components are the timing chain 812 for the camshaft 804, the front gear train 814, and the supercharger 108. Once the oil reaches the bottom of front engine cover 627, it is pumped back to the oil tank 606 by oil pump 628. The oil pump 628 is driven by the crankshaft 66 through a system of gears, as will be discussed in greater detail below. The oil pump 628 is what is known as a gear pump.

The oil flowing inside the right cylinder head assembly 58B lubricates the bearings (not shown) of the camshaft 806. From the right cylinder head assembly 58B, the oil flows down inside the flywheel cover 74 to lubricate the components found, at least partially, therein. These components are the timing chain 816 for the camshaft 806, and the rear gear train 818. Once the oil reaches the bottom of the flywheel cover 74, it is pumped to the oil pan 602 and from there to the bottom of the front engine cover 627 by a suction oil pump 630. The suction oil pump 630 is driven by the crankshaft 66 through a system of gears, as will be discussed in greater detail below, and is actuated by the same shaft as oil pump 628. The suction oil pump 630 is what is known as a gear pump. Once the oil reaches the bottom of front engine cover 627, it is pumped back to the oil tank 606 with the oil from the left cylinder head assembly 58A by oil pump 628.

A portion of the oil flowing through the second main path 626 is used to lubricate the front chain tensioner 820. From there, the oil flows down to the bottom of the front engine cover 627. Once the oil reaches the bottom of front engine cover 627, it is pumped back to the oil tank 606 by oil pump 628, as previously described.

Another portion of the oil flowing through the second main path 626 is used to lubricate the front crankshaft bearing 822, the central crankshaft bearings 824, and the rear crankshaft bearing 826. The oil lubricating the front crankshaft bearing 822 then flows down to the bottom of the front engine cover 627. Once the oil reaches the bottom of front engine cover 627, it is pumped back to the oil tank 606 by oil pump 628, as previously described. The oil lubricating the four central crankshaft bearings 824 then flows to the bottom of the crank chambers 76. From there, the oil flows down inside the oil pan 602 where it is pumped to the bottom of the front engine cover 627 by the suction oil pump 630. Once there, it is pumped back to the oil tank 606 by oil pump 628, as previously described. The oil lubricating the rear crankshaft bearing 826 then flows to the output shaft bearings 828 of the output shaft 830, to which the driveshaft coupling 68 is connected, to lubricated them. From the output shaft bearings 828, the oil flows down to the bottom of the flywheel cover 74. From there, the oil flows to the oil pan 602 where it is pumped to the bottom of the front engine cover 627 by the suction oil pump 630. Once there, it is pumped back to the oil tank 606 by oil pump 628, as previously described.

Yet another portion of the oil flowing through the second main path 626 is used to lubricate the rear chain tensioner 832. From there, the oil flows down to the bottom of the flywheel cover 74. From there, the oil flows to the oil pan 602 where it is pumped to the bottom of the front engine cover 627 by the suction oil pump 630. Once there, it is pumped back to the oil tank 606 by oil pump 628, as previously described.

A further portion of the oil flowing through the second main path 626 is sprayed inside the crank chambers 76 so as to spray the bottom of the pistons 60. By doing this, the oil both cools the pistons 60 and lubricates the piston pins 78.

The oil then falls down to the bottom of the crank chambers 76. From there, the oil flows down inside the oil pan 602 where it is pumped to the bottom of the front engine cover 627 by the suction oil pump 630. Once there, it is pumped back to the oil tank 606 by oil pump 628, as previously described.

Another portion of the oil flowing through the second main path 626 may optionally be sprayed inside the flywheel cover 74 onto the rear gear train 818 to lubricate the components thereof. The oil then flows down to the bottom of the flywheel cover 74. From there, the oil flows to the oil pan 602 where it is pumped to the bottom of the front engine cover 627 by the suction oil pump 630. Once there, it is pumped back to the oil tank 606 by oil pump 628, as previously described.

Yet another portion of the oil flowing through the second main path 626 flows to the balancer shaft chamber 80 where the counter-balance shaft 802 is located. That oil is used to lubricate the counter-balance shaft bearings. From the balancer shaft chamber 80, portion of the oil flows to the bottom of the front engine cover 627 and from there it is pumped back to the oil tank 606 by oil pump 628, as previously described. Another portion of the oil flows from the balancer shaft chamber 80 to the crank chambers 76. From there, the oil flows down inside the oil pan 602 where it is pumped to the bottom of the front engine cover 627 by the suction oil pump 630 and is then pumped back to the oil tank 606 by oil pump 628, as previously described. Yet another portion of the oil flows from the balancer shaft chamber 80 to the bottom of the flywheel cover 74. From there, the oil flows to the oil pan 602 where it is pumped to the bottom of the front engine cover 627 by the suction oil pump 630, and is then pumped back to the oil tank 606 by oil pump 628, as previously described.

As seen in FIG. 32, a cover 634 integrates the front portion of the oil filler neck 614, a portion of the oil cooler 508, and the front portion of the oil tank 606 in a single part. This cover 634 attaches to the front cover 627 which has the back portions of the oil filler neck 614, and oil tank 606. The oil filter 610 (not shown in FIG. 32) is disposed inside the oil filter receiving opening 636 of the front cover 627. The front cover 627 attaches to the front of the cylinder block 56 (not shown in FIG. 32), crankcase 74, and oil pan 602. The cylinder block 56 sit atop the crankcase 74, which itself sits atop the oil pan 602. The bottom portion of the crank chambers 76 can clearly be seen in FIG. 32. The oil drain 604 which permits draining of the oil present in the lubrication system 600 when performing an oil change, can also be seen inside the oil pan 602.

Figure 33:
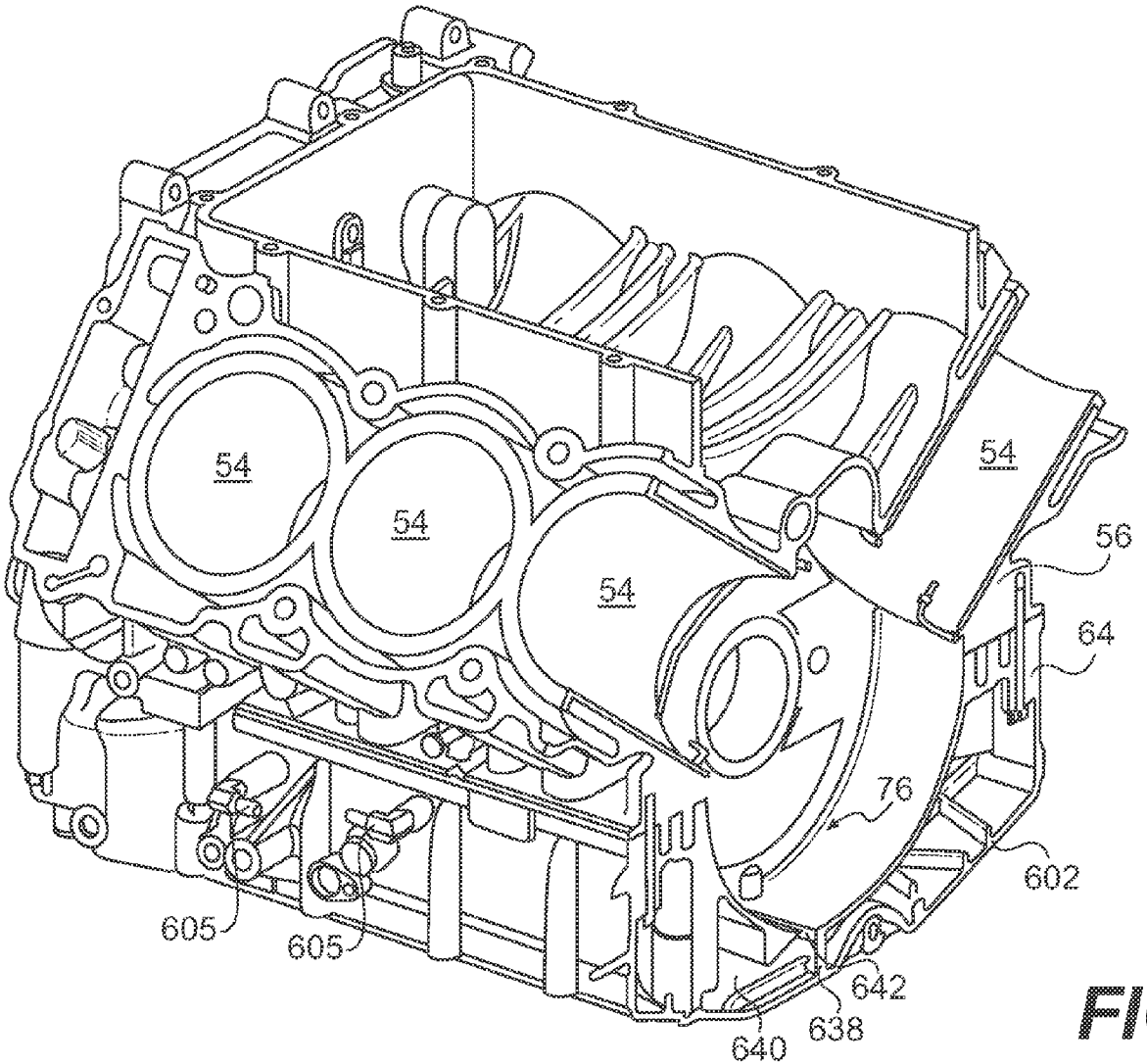
FIG. 33 is a partial cross-section of an oil pan, crankcase, and cylinder block assembly of the engine of FIG. 6.

As seen in FIG. 33, when the cylinder block 56, crankcase 64, and oil pan 602 are attached together, the crankcase 64 and oil pan 602 form a wall 638 spanning almost the entire length of the oil pan 602. This separates the volume formed between the crankcase 64 and oil pan 602 into two portions. The smaller of these portions is referred to herein as the oil suction chamber 640. The suction oil pump 630 pumps the oil from the oil suction chamber 640. The smaller volume of the oil suction chamber 640 facilitates the pumping of the oil found therein. An opening 642 is provided at the bottom of each crank chamber 76 to permit the oil therein to flow to the oil suction chamber 640. Also seen in FIG. 33 are oil vapour vents 605 which permit vapours to be evacuated from the oil pan 602.

It should be noted that the suction oil pump 630 also pumps the blow-by gases found in the crankcase 64 and oil pan 602 along with the oil. These blow-by gases once inside the front engine cover 627 rise to the left cylinder head assembly 58A. Once there, a centrifugal oil separator 632 (FIG. 34) separates the oil particles that may have been entrained in the blow-by gases from the blow-by gases. The separated oil falls down to the bottom of the front engine cover 627. The blow-by gases, free of oil flow through blow-by gas tube 124 to the airbox 112 where they will flow back to the combustion chambers 62 with fresh air to be combusted once again.

Figure 34:
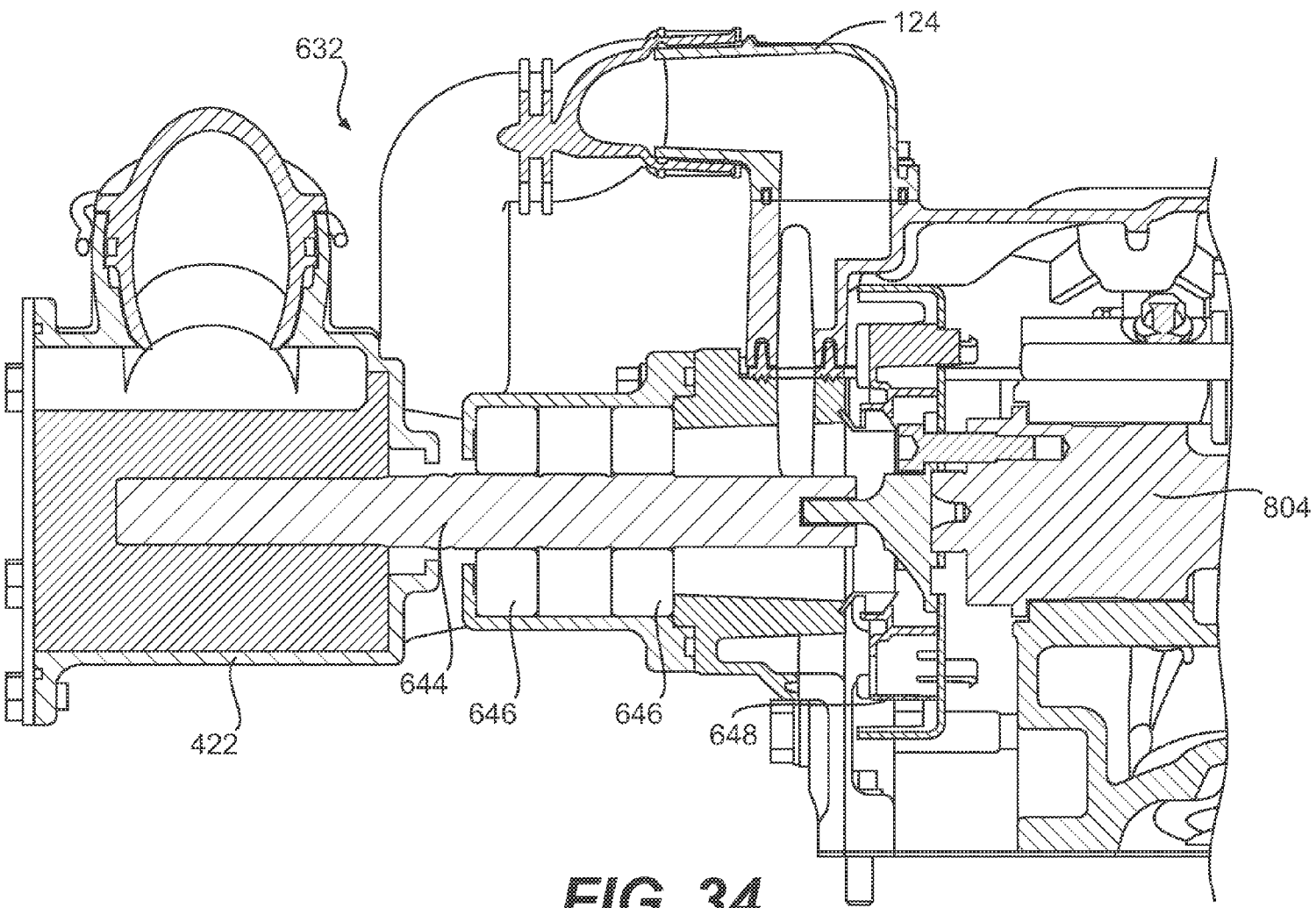
FIG. 34 is a partial cross-section of a centrifugal air-oil separator of the engine of FIG. 6.
Figure 35:
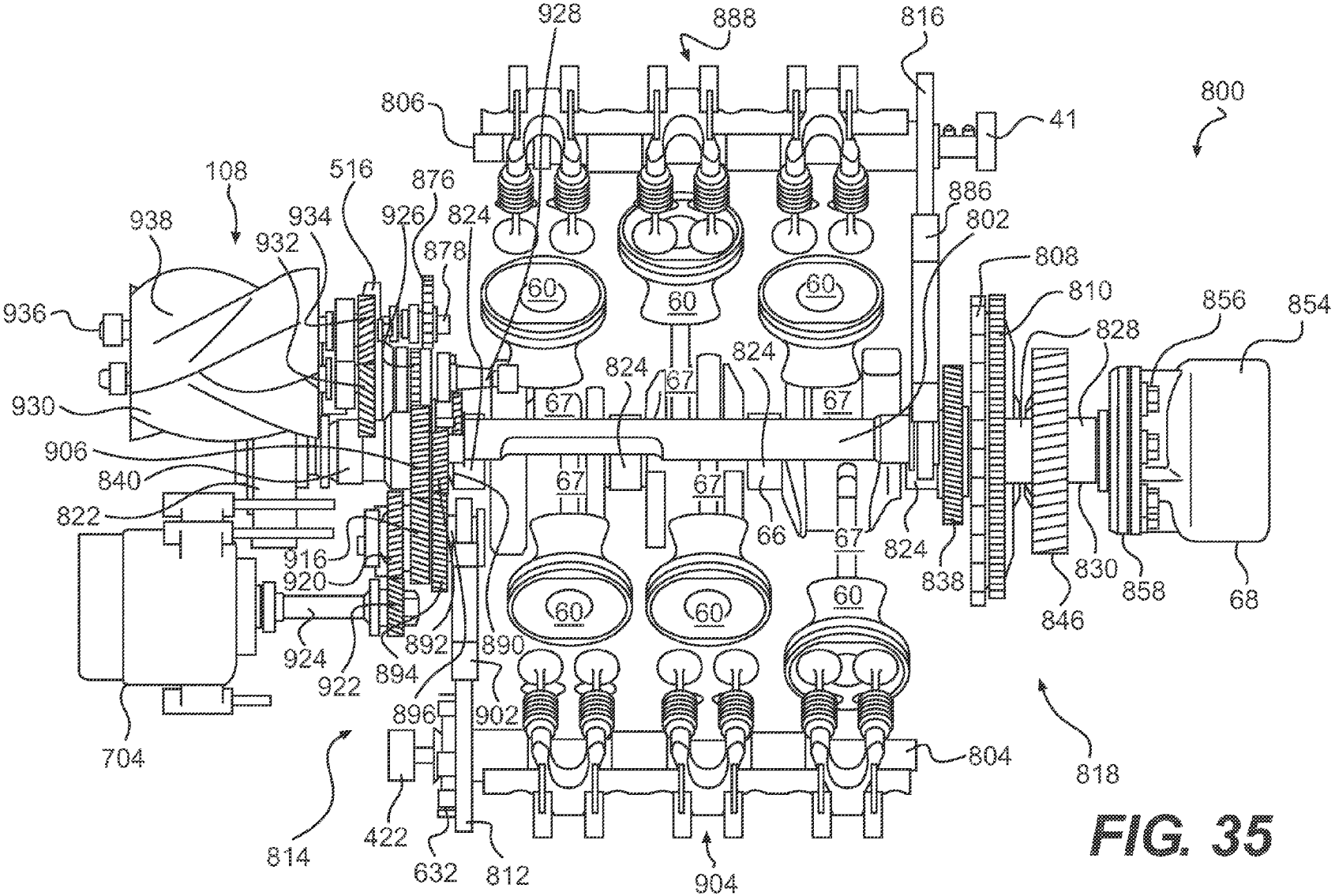
FIG. 35 is a top view of an internal gearing system of the engine of FIG. 6.
Figure 36:
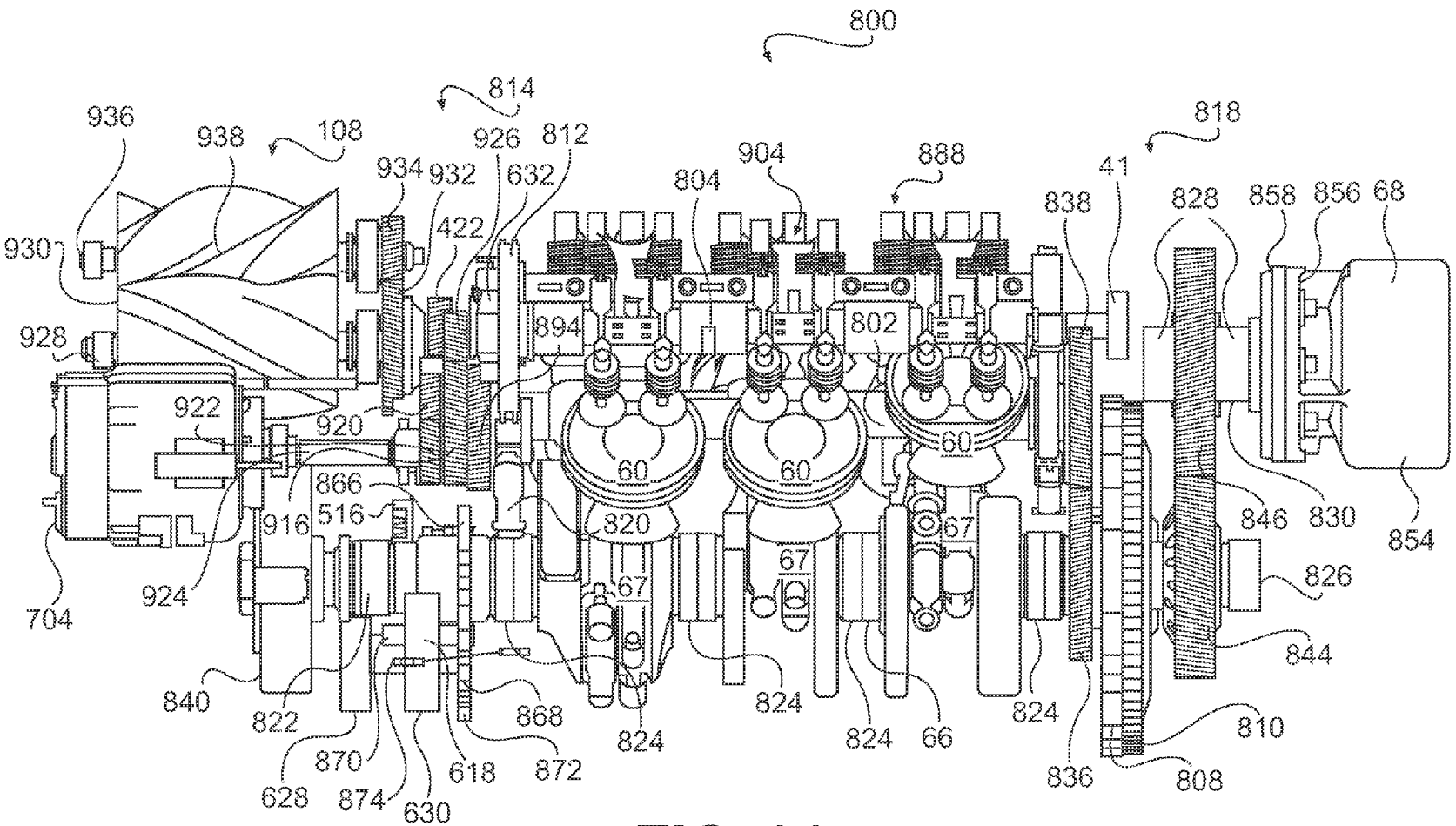
FIG. 36 is a left side elevation view of the gearing system of FIG. 35.
Figure 37:
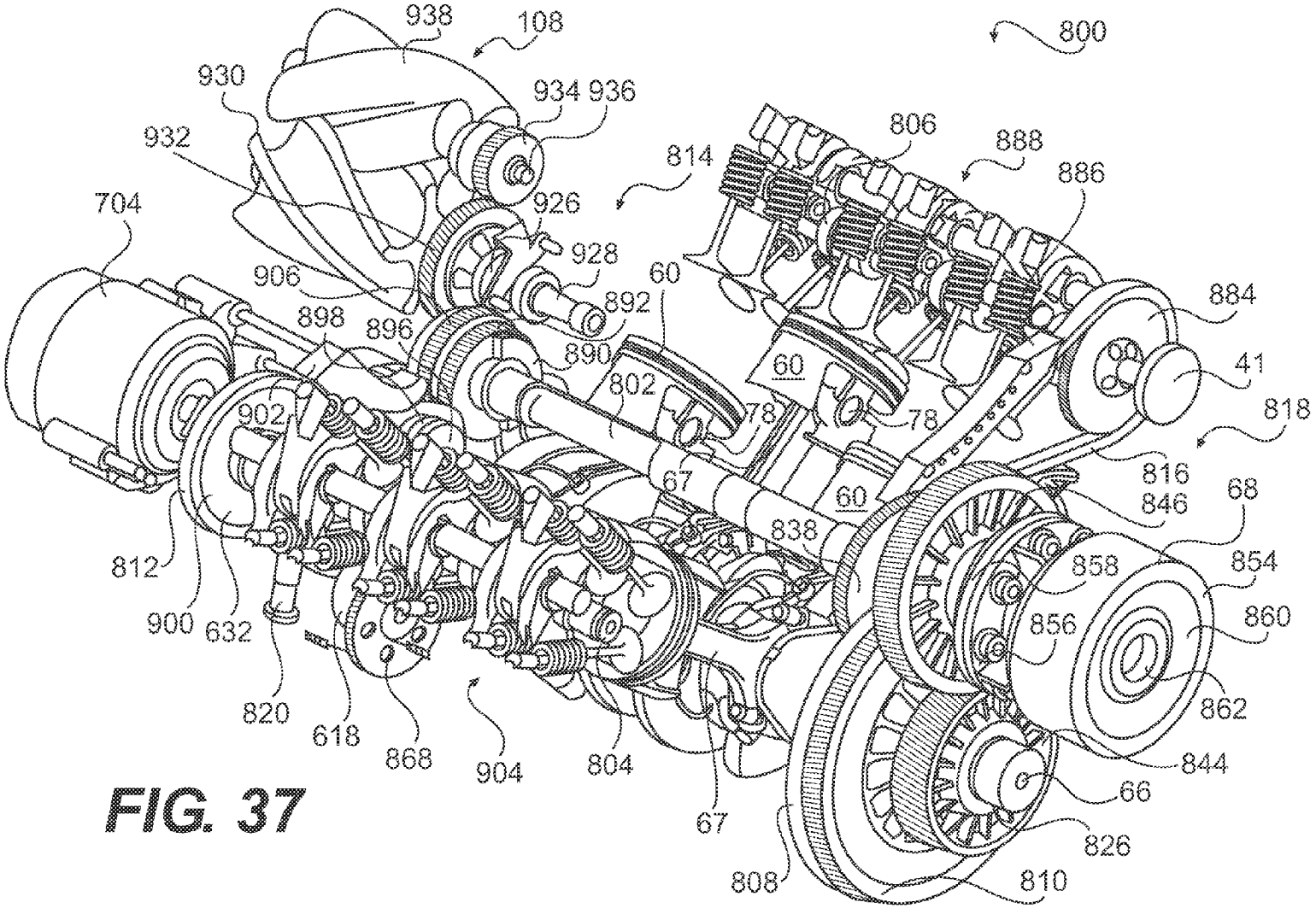
FIG. 37 is a perspective view, taken from a rear, left side, of the gearing system of FIG. 35.
Figure 38:
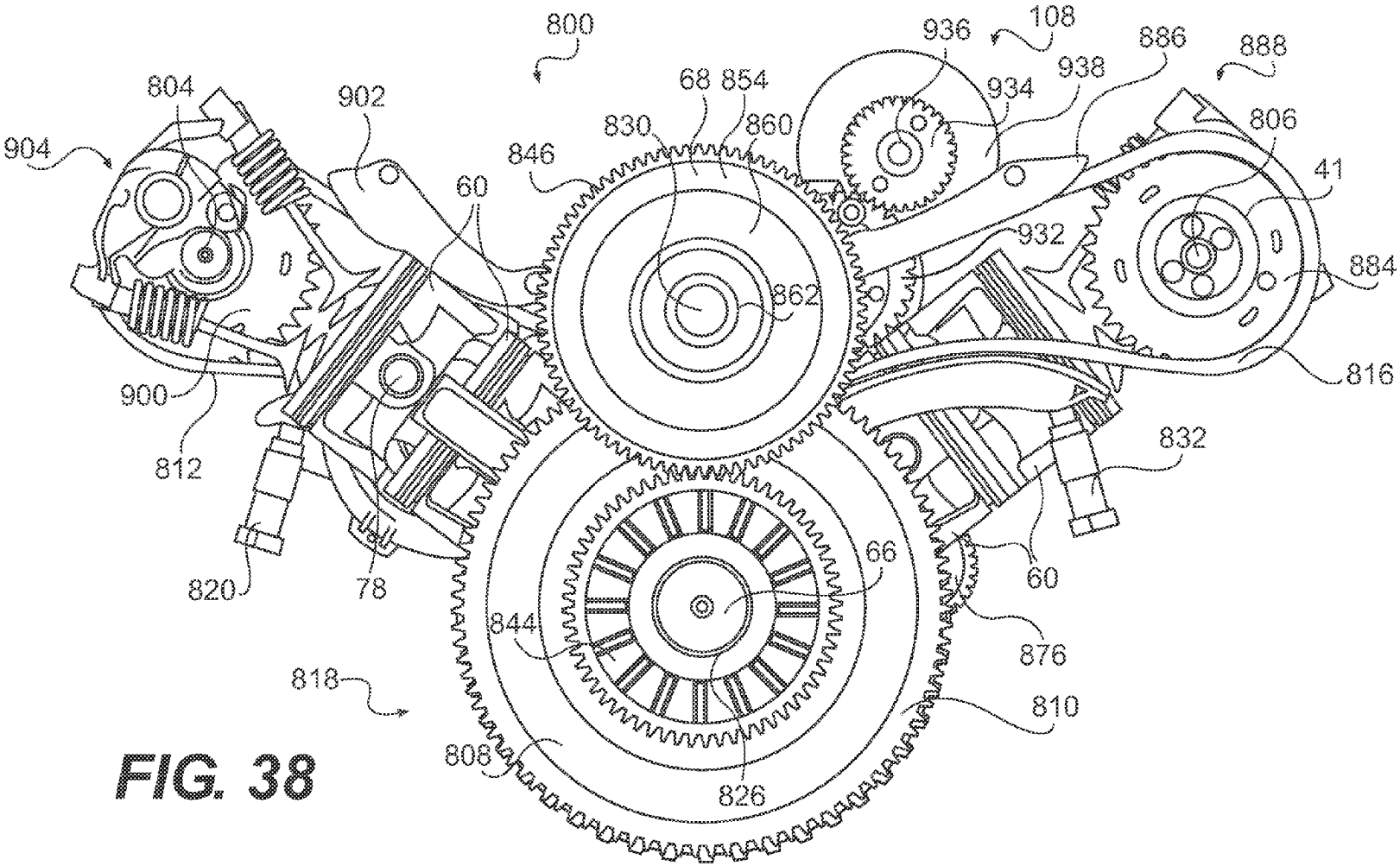
FIG. 38 is a rear elevation view of the gearing system of FIG. 35.
Figure 39:
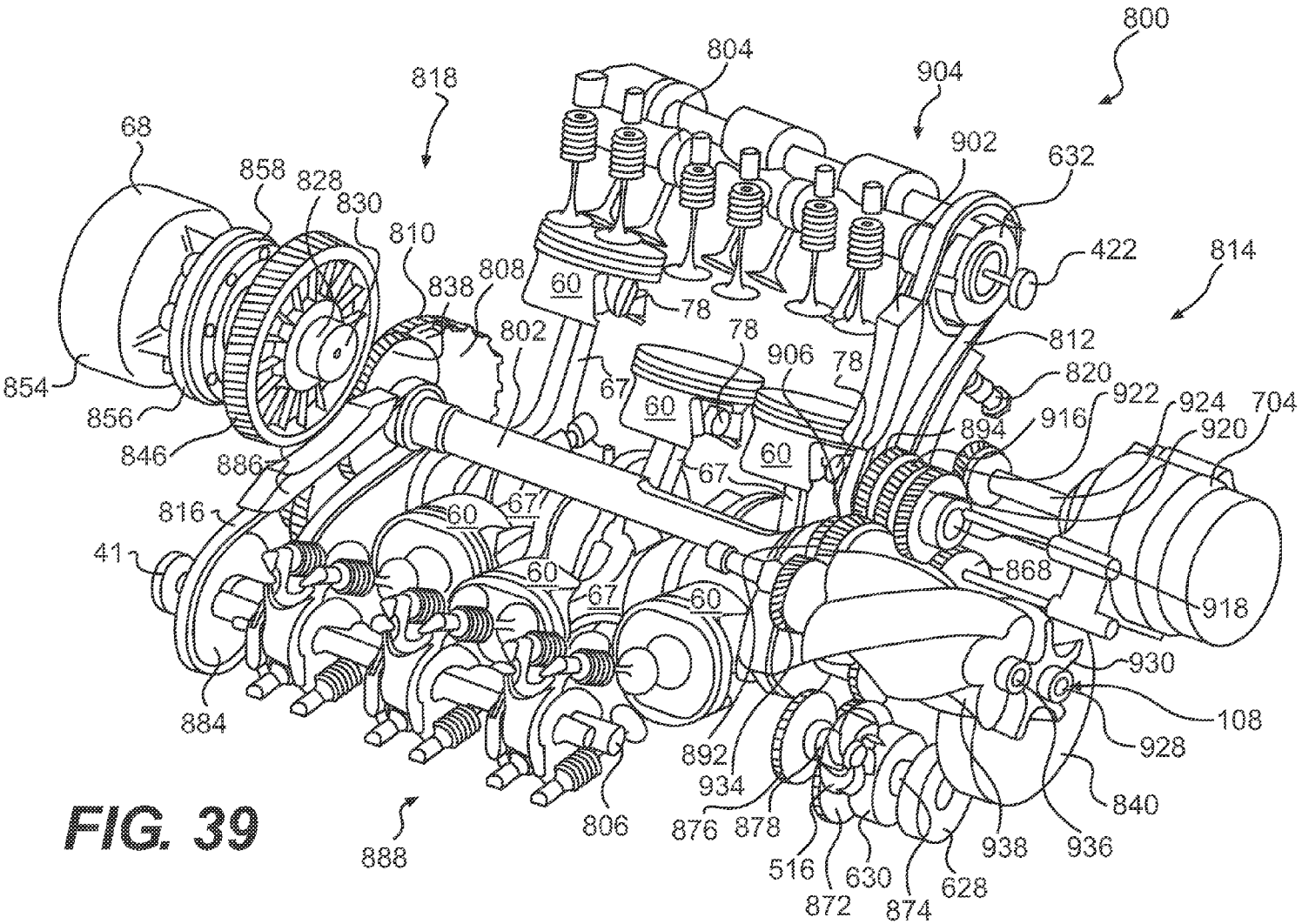
FIG. 39 is a perspective view, taken from a front, right side, of the gearing system of FIG. 35.
Figure 40:
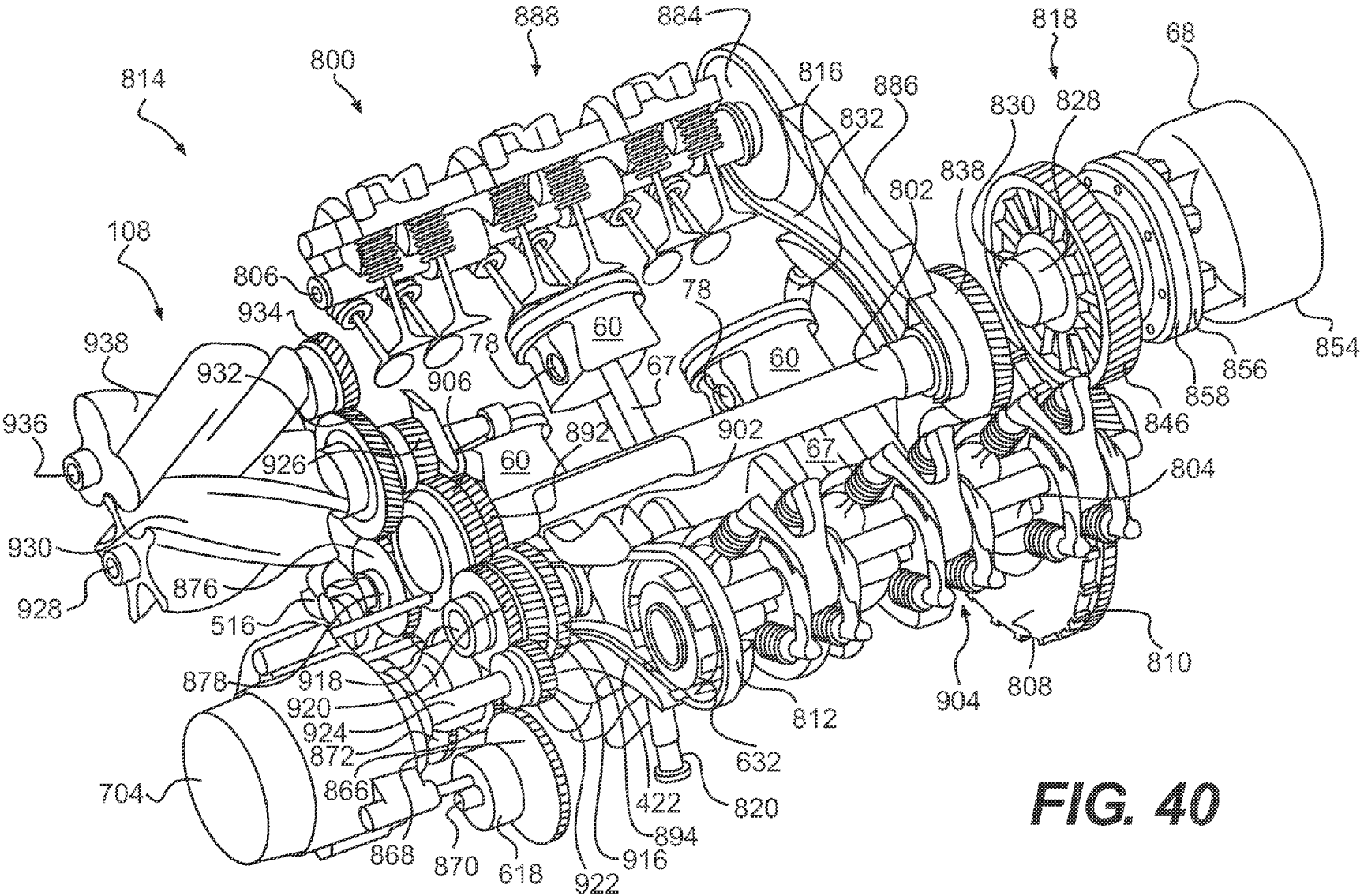
FIG. 40 is a perspective view, taken from a front, left side, of the gearing system of FIG. 35.
Figure 41:
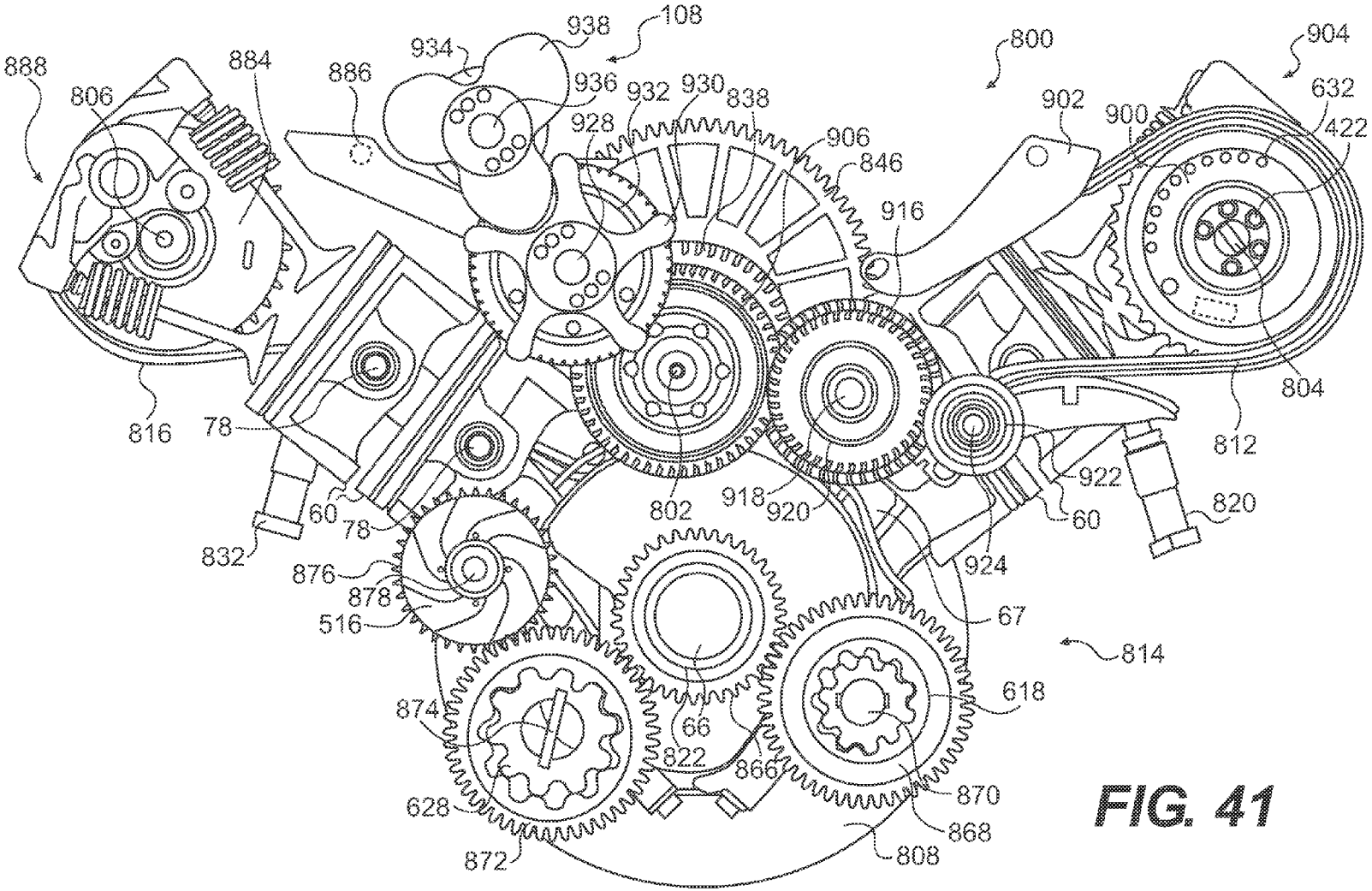
FIG. 41 is a front elevation view of the gearing system of FIG. 35.

As seen in FIG. 34, the centrifugal oil separator 632 has a shaft 644 supported by a pair of bearings 646. A rotor 648 is provided at the end of the shaft 644. The shaft 644 and rotor 648 are connected to the camshaft 804 at the front of thereof and rotate therewith. The rotation of the rotor 648 causes the oil, which is heavier than the blow-by gases, to move to the tips of the rotor 648. This separates the oil from the blow-by gases. As described above, the separated oil flows down to the bottom of the front cover 627. The blow-by gases, free of oil, flow from the rotor 648, through the blow-by gas tube 124, to the airbox 102. Also seen in FIG. 34 is the water pump 422 of the open-loop cooling system 400 which is driven by shaft 644.

Electrical System

Figure 9:
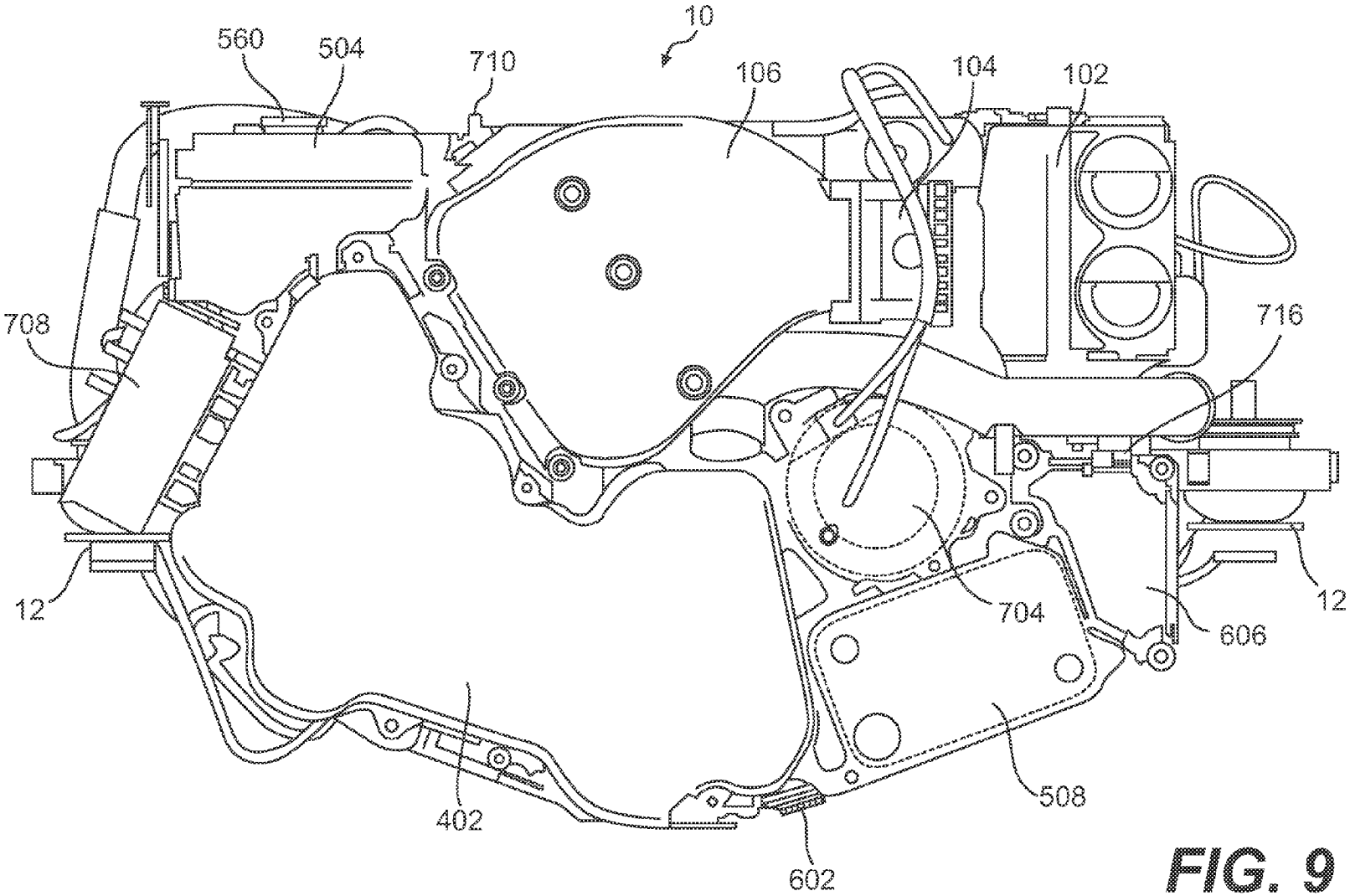
FIG. 9 is a front elevation view of the engine of FIG. 6.

The electrical system is powered by at least two batteries (not shown) disposed in the hull 20 separately from the engine 10 and an alternator 704 (FIG. 9). The alternator 704 disposed at the front of the engine 10 is driven by the counter-balance shaft 802 via a gearing system, as will be discussed in greater detail below. An integrated electronic circuit associated with the alternator 704 generates the direct current to be used by the various components of the electrical system and to recharge the batteries. The electronic box 706 is disposed above the driveshaft coupling 68 and contains multiple fuses and relays to ensure proper current distribution to the components of the electrical system. An electronic battery isolator 708 (FIGS. 8, 9) is provided on the front, right side of the engine 10 to permit the charging of the multiple batteries from the single alternator 704 and also prevents the starter battery from becoming discharged.

A plurality of sensors are disposed around the engine 10 to provide information to the ECU 702. An RPM sensor (not shown) is provided near the flywheel 808 to send signals to the ECU 702 upon sensing teeth disposed on a periphery of the flywheel 808. The ECU 702 can then determine the engine speed based on the frequency of the signals from the RPM sensor. A throttle position sensor (not shown) senses the position of the throttle valve such that the ECU 702 sends signals to the throttle actuator 132 to make adjustments if the actual position of the throttle valve does not correspond to a desired position of the throttle valve. A first air temperature and pressure sensor 710 (FIG. 6) is provided in the air intake system 100 upstream of the supercharger 108. A second air temperature and pressure sensor 712 (FIG. 6) is provided on the air intake manifold 112 to sense the temperature of the air inside volume 142. Two oxygen sensors 714 (FIGS. 7, 8) are provided on the exhaust collector 306, one near the outlet of each exhaust manifold 502, to provide signals indicative of the air/fuel mixture, to help the ECU 702 determine whether the mixture is too lean or too rich. An oil level sensor 716 (FIG. 7) is provided in the oil tank 606 to provide a signal to the ECU 702 indicative of a low oil condition, which will cause the ECU 702 to send a signal to display a low oil warning on a control panel of the boat.

The ECU 702 also receives signals from other sources disposed on the boat. For example, the ECU 702 receives an ignition "on" signal when a boat user desires to start the engine 10, by inserting a key in the ignition switch for example. The ignition "on" signal provides electric current to the ECU 702 and turns the ECU 702 on. When a starting sequence release signal is generated and sent to the ECU 702, by turning the key or pressing a start button for example depending on the specific ignition system, the ECU 702 sends a signal to activate the starter motor 718 (FIG. 10), located on the back of the engine 10, to engage the starter ring gear 810 to start turning the crankshaft 66. The ECU 702 also receives a signal from a throttle sensor associated with a throttle controller controlled by a boat user, such as a throttle lever or a foot pedal, which is indicative of a desired engine speed. Based on the signals from the throttle sensor, RPM sensor, throttle position sensor, first and second air temperature and pressure sensors 710, 712, and oxygen sensors 714, the ECU 702 sends control signals to the throttle actuator 132, bypass valve actuator 138, EGR valve actuator 316, ignition coils 59, and fuel injectors 208 to control the operation of the engine 10.

A bracket 720 having a plurality of electrical connectors 722 thereon is also provided. This allows engine diagnostic tools to be connected to the electrical connectors 722 to run diagnostics on the engine 10.

Internal Gearing System

As can be seen in FIGS. 35 to 41, there are no belts being used in the engine 10 to transmit power from the crankshaft 66 to the other rotating components of the engine 10. Instead, the engine 10 has an internal gearing system 800 having a front gear train 814 and a rear gear train 818. Using gears improves the reliability of the engine 10 and reduces vibrations. Belts tend to wear and loosen, thus requiring more maintenance. Gears are being used for driving all of the rotating components (such as the auxiliary units) except the camshafts 804 and 806 which are driven by timing chains 812 and 816 respectively, due to the distance separating them from the other components.

The rear gear train 818 transmits power from the crankshaft 66 to the counter-balance shaft 802 and the driveshaft coupling 68. The counter-balance shaft 802 is disposed above and slightly to the right of the crankshaft 66 and rotates in the direction opposite to the crankshaft 66. A counter-balance shaft driving gear 836 is disposed on the crankshaft 66 and drives a counter-balance shaft driven gear 838 disposed on the counter-balance shaft 802 (see FIG. 45).

Figure 44:
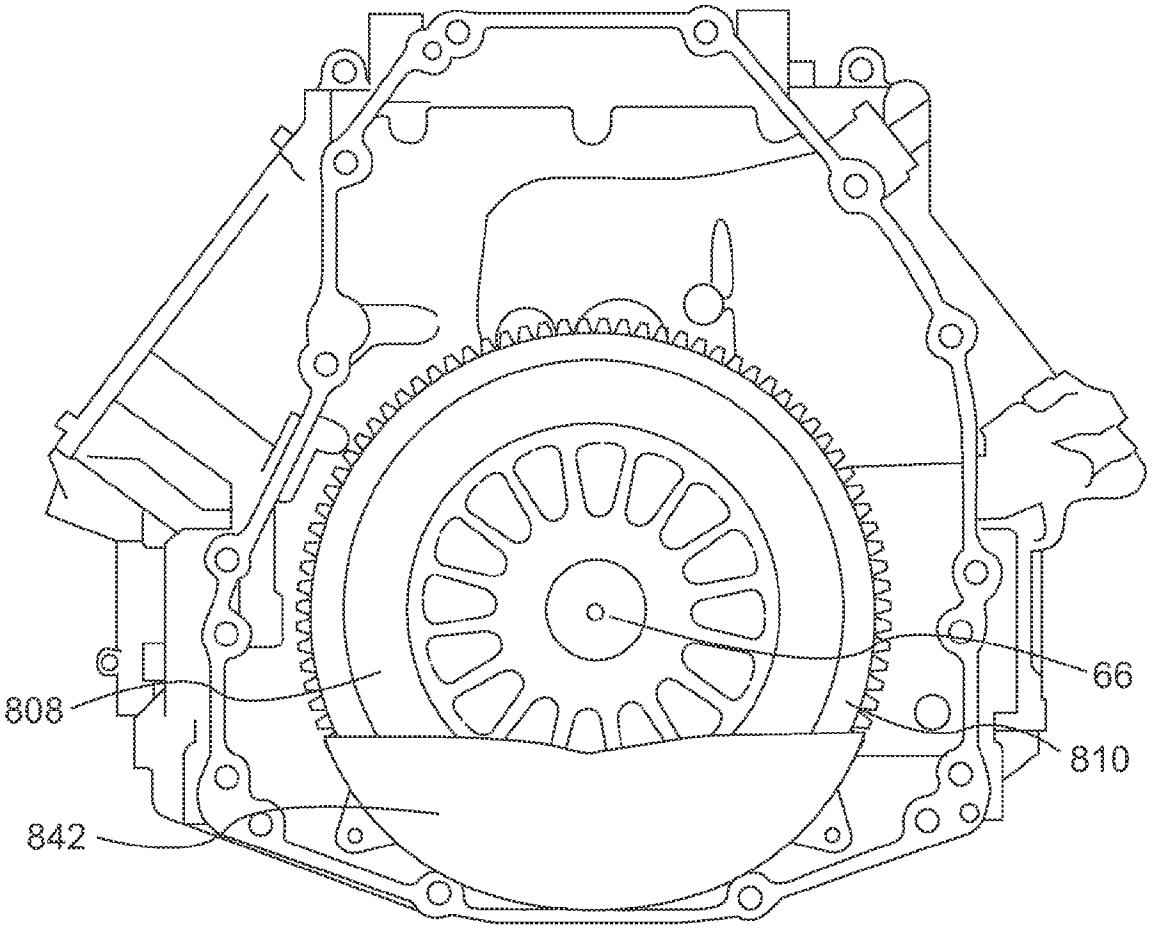
FIG. 44 is a rear plan view of a flywheel of the gearing system of FIG. 35.
Figure 45:
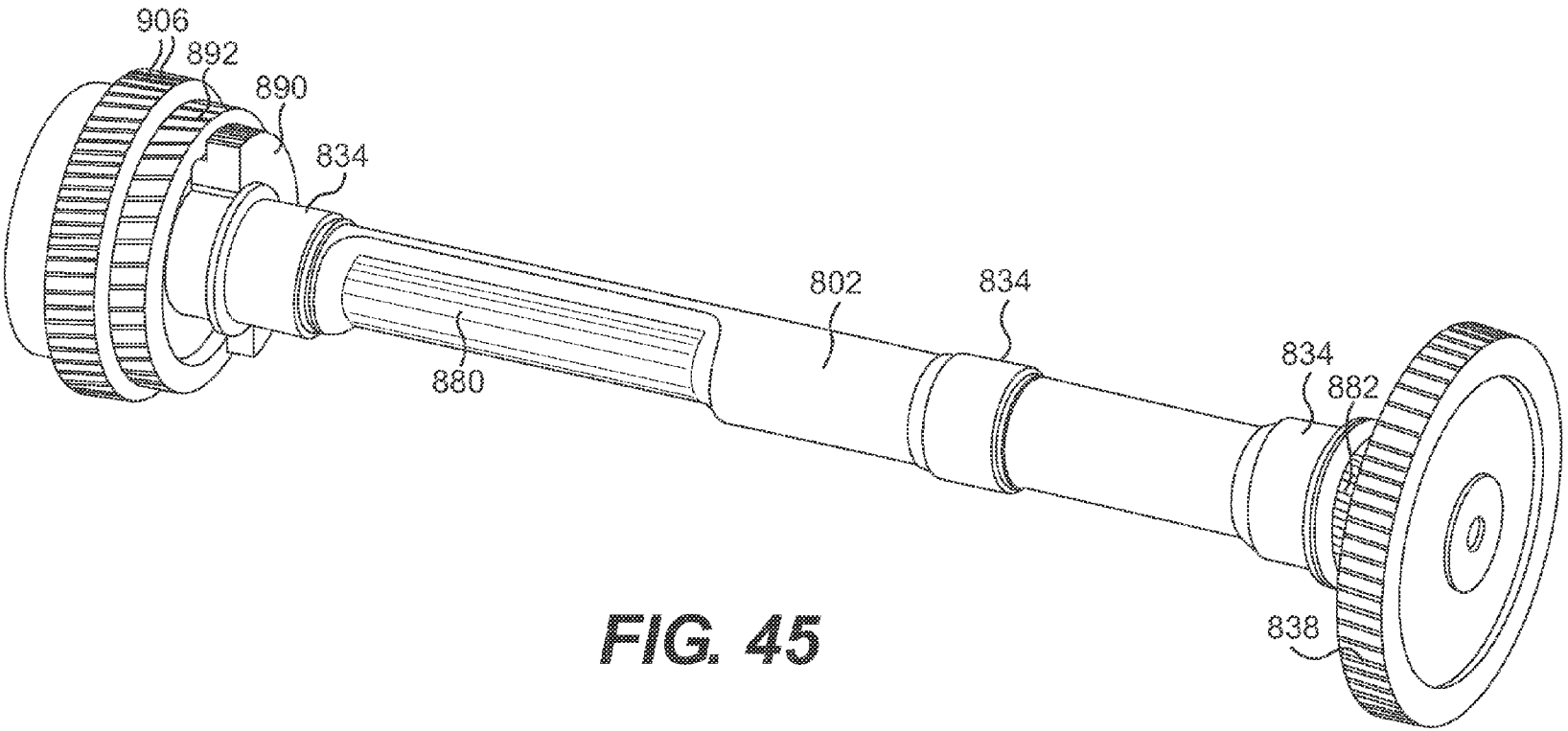
FIG. 45 is a perspective view, taken from a rear, left side of a driveshaft assembly of the gearing system of FIG. 35.

The flywheel 808 is disposed on the crankshaft 66 rearwardly of the counter-balance shaft driving gear 836. The angular momentum of the rotating flywheel 808 reduces variation in the rotational speed of the crankshaft 66. However, in order to have the engine 10 as low as possible in a boat, the diameter of the flywheel 808 has been reduced. As can be seen in FIG. 44, the diameter of the flywheel 808 is less than the width of the crankcase 64. In order to compensate for this reduction in the size of the flywheel 808, a second rotating mass 840 has been disposed on the crankshaft 66 at the front of the engine 10. A plurality of teeth disposed about a periphery of the flywheel 808 are sensed by an RPM sensor (not shown) which generates a signal indicative of engine speed as previously described.

A starter ring gear 810 is disposed on the flywheel 808 rearwardly of the previously described plurality of teeth disposed about the periphery of the flywheel 808 so as to rotate with the flywheel 808. The starter ring gear 810 has substantially the same diameter as the flywheel 808. The starter motor 718 is disposed to the right of the starter ring gear 810 such that a gear (not shown) disposed at the end of the rotating shaft (not shown) of the starter motor 718 can engage the starter ring gear 810 when starting the engine 10. The starter motor 718 is disposed rearwardly of the starter ring gear 810, such that the starter ring gear 810 is disposed between the starter motor 718 and the flywheel 808. The starter motor 718 provides the initial rotation of the crankshaft 66 which is necessary to start the engine 10.

Since the flywheel 808 rotates inside a cavity having oil at the bottom thereof, a protective cover 842 (FIG. 44) surrounding a bottom portion of the flywheel 808 is provided. This protective cover 842 prevents the rotation of the flywheel 808 to spray oil inside the cavity. The protective cover 842 is fastened onto the rear portion of the oil pan 602.

Figure 42:
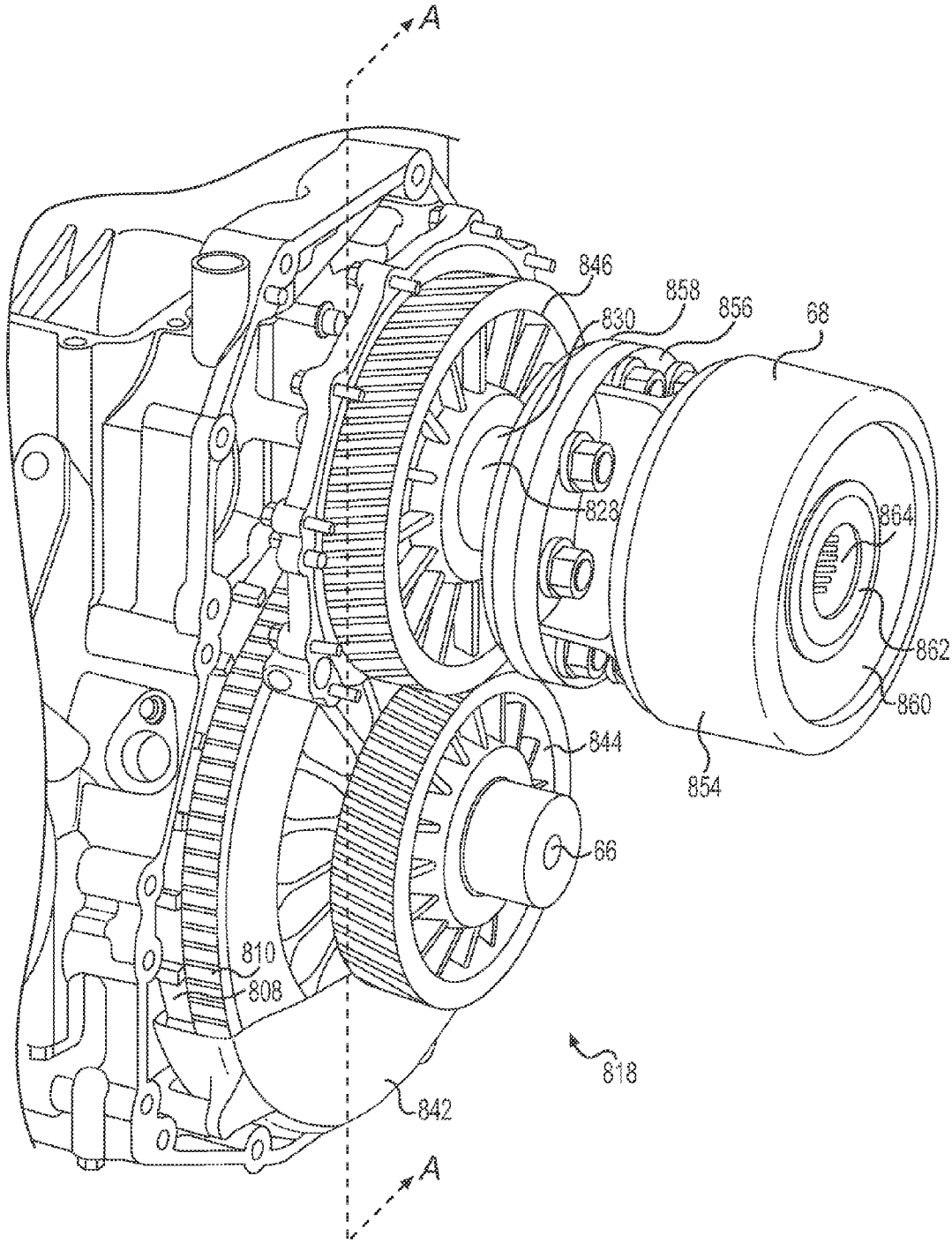
FIG. 42 is a close-up perspective view, taken from a rear, left side, of a rear gear train of the gearing system of FIG. 35.
Figure 43:
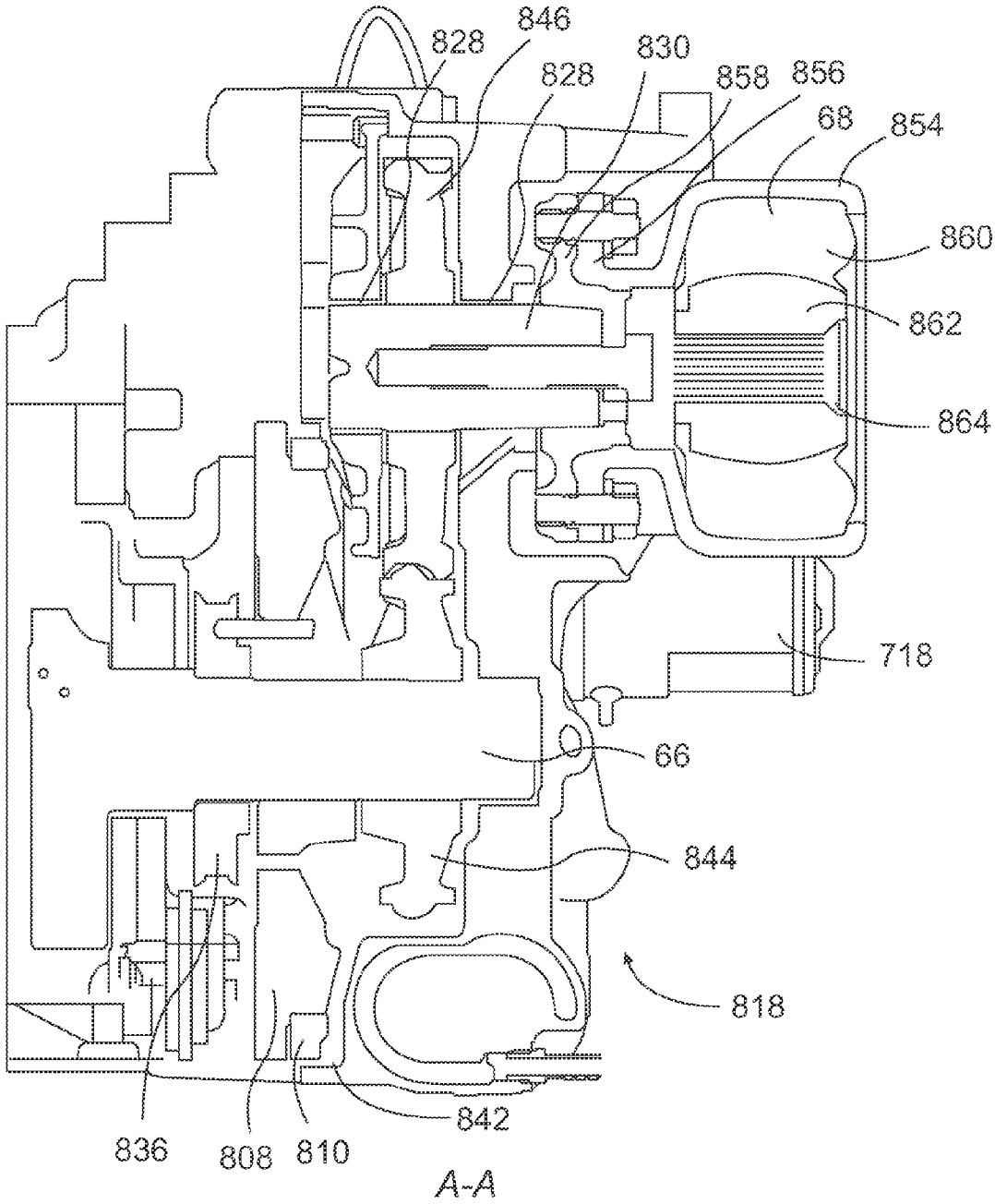
FIG. 43 is a cross-section view, taken through centerline A-A of the rear gear train of FIG. 42.

As best seen in FIGS. 42 and 43, and as previously described, the output shaft 830 and the crankshaft 66 are offset from one another. The axis of rotation of the output shaft 830 is disposed directly vertically above and parallel with the axis of rotation of the crankshaft 66. This allows the engine 10 to be placed low inside the hull 20 while having the output shaft 830 high enough to place the driveshaft coupling 68 in position to receive the driveshaft of the drive unit 40. This contributes to having an engine construction which will permit the engine 10 to fit completely below the deck floor 34 of a boat.

An output shaft driving gear 844 is disposed on the crankshaft 66 and engages an output shaft driven gear 846 disposed on the output shaft 830 in order to drive the output shaft 830. Preferably, the diameters of the flywheel 808, output shaft driving gear 844, and output shaft driven gear 846 are selected such that the diameter of the flywheel 808 is less than the sum of the diameters of the output shaft driving gear 844 and the output shaft driven gear 846.

Figure 48:
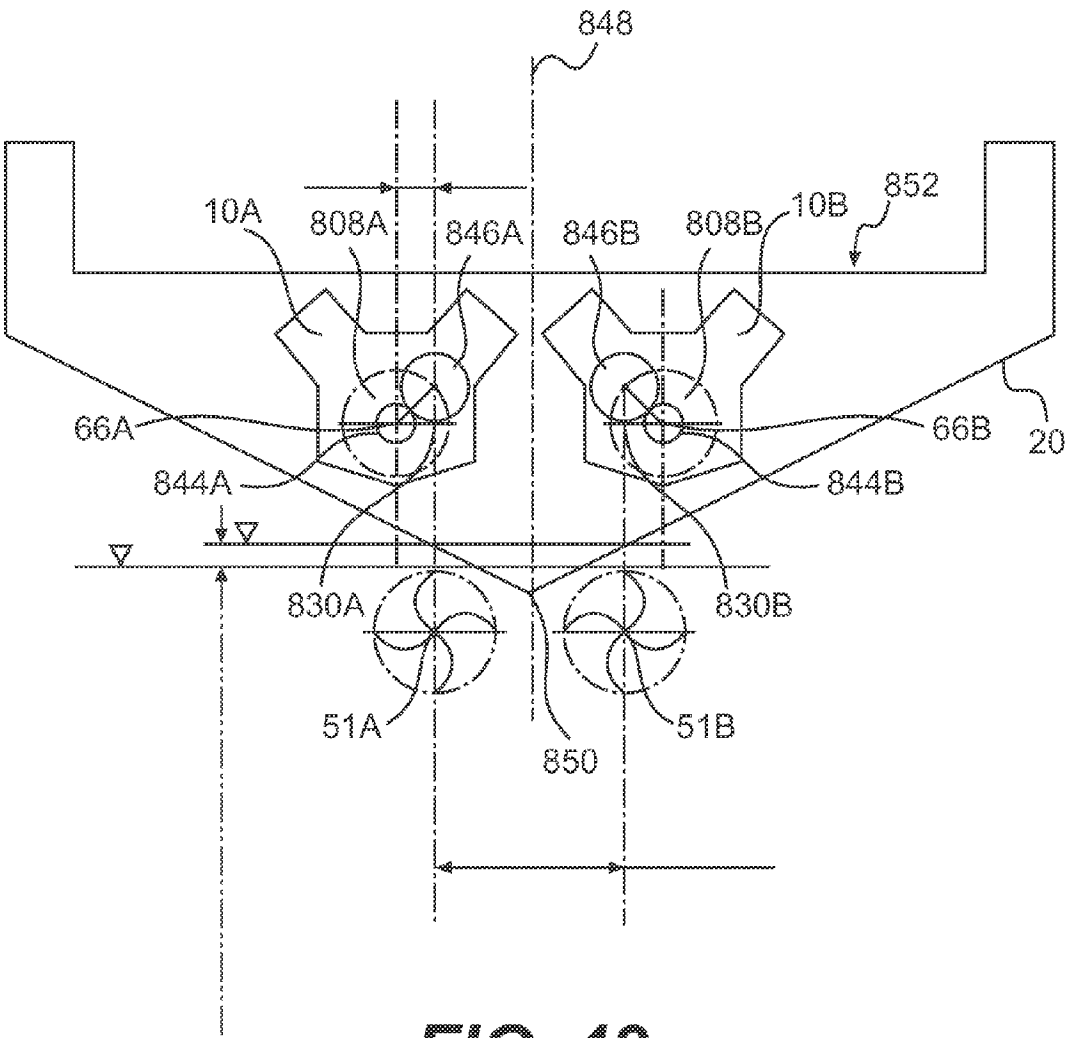
FIG. 48 is a schematic representation of a pair of engines of an alternative embodiment of the invention disposed inside a boat.

It is contemplated that the output shaft 830 could be both vertically and horizontally offset from the crankshaft 66. A seen in FIG. 48, some boats can be equipped with a pair of engines 10A, 10B, each driving a separate drive unit (not shown) in order to drive a pair of propellers 51A, 51B. It may be desirable in such cases to have the output shafts 830A, 830B closer to the centerline 848 of the hull 20 in order to have the propellers 51A, 51B as close to the keel 850 as possible. This improves the propulsion efficiency. Once again, the output shafts 830A, 830B are vertically offset from the crankshafts 66A, 66B so that the engine 10A, 10B can be installed completely below the deck floor 852. A system of output shaft driving gears 844A, 844B and output shaft driven gears 846A, 846B is used to transmit the power from the crankshafts 66A, 66B to the output shafts 830A, 830B. As can be imagined, if the output shafts 830A, 830B were to be co-axial with the crankshafts 66A, 66B, such an arrangement of the propellers 51A, 51B would not be possible. Firstly, the engines 10A, 10B could not be positioned horizontally close enough to each other. Secondly, in order to have the output shafts 830A, 830B engage the driveshaft of the drive units, the engines 10A, 10B would have to extend above the deck floor 852.

As seen in FIGS. 42 and 43, the driveshaft coupling 68 has an outer casing 854 having a flared front portion 856. The flared front portion 856 is fastened to a flange 858 connected to the output shaft 830. A torsional damper 860 made of elastomeric material is disposed inside the outer casing 854. A splined insert 862 is disposed at the center of the torsional damper 860. The driveshaft (not shown) of the drive unit 40 has a splined end which matingly engages the splines of the splined insert 862. This allows the transmission of power from the output shaft 830 to the driveshaft and ultimately to the propeller. In order to facilitate the alignment of the driveshaft with the driveshaft coupling 68, the back end of the splined insert 862 has a countersink 864. Preferably, the torsional damper 860 is vulcanized onto the splined insert 862, and this assembly is then press fitted inside the outer casing 854. The outer casing 854 is preferably made of aluminium.

The elastomeric material of the torsional damper 860 is preferably rubber. The splined insert 862 is preferably made of steel. It is contemplated that the elements of the driveshaft coupling 68 could be assembled differently and could be made of different material.

Turning back to FIGS. 35 to 41, the front gear train 814 is divided into two portions. The first portion is driven from the crankshaft 66 and the second portion is driven by the counter-balance shaft 802. As will be described below, the crankshaft 66 drives the oil pumps 618, 628, and 630, and the water pump 516. As will also be described below, the counter-balance shaft 802 drives the supercharger 108, the alternator 704, and camshafts 804, 806.

The crankshaft 66 is supported by the crankcase 64 in six positions. A bearing is provided at each of these positions. They are the front crankshaft bearing 822, the four central crankshaft bearings 824, and the rear crankshaft bearing 826. As previously mentioned, a rotating mass 840 is disposed on the front end of the crankshaft 66. The angular momentum of the rotating mass 840, along with that of the flywheel 808, reduces variation in the rotational speed of the crankshaft 66.

A front crankshaft gear 866 is disposed on the crankshaft 66 so as to rotate therewith. It is located rearwardly of the rotating mass 840, but forwardly of foremost cylinder 54. The front crankshaft gear 866 engages a first pump gear 868 located below and to the left thereof and disposed on a shaft 870. The first pump gear 868 has a larger diameter than the front crankshaft gear 866. The oil pump 618, which is used to pump oil from the oil tank 606, is also disposed on the shaft 870 forwardly of the first pump gear 868. The rotation of the first pump gear 868 rotates the shaft 870 which in turn actuates the oil pump 618. The front crankshaft gear 866 also engages a second pump gear 872 located below and to the right thereof and disposed on a shaft 874. The second pump gear 872 has a larger diameter than the front crankshaft gear 866. The oil suction pump 630, which is used to pump the oil from the oil suction chamber 640, is also disposed on the shaft 874 forwardly of the first pump gear 868. The oil pump 628, which is used to pump the oil back to the oil tank 606, is also disposed on the shaft 874 forwardly of the oil suction pump 630. The rotation of the second pump gear 872 rotates the shaft 874 which in turn actuates both the oil suction pump 630 and the oil pump 628. The second pump gear 872 engages a third pump gear 876 located above and to the right thereof and disposed on a shaft 878. The third pump gear 876 has a smaller diameter than the second pump gear 872. The water pump 516, which is used to pump the water inside the closed-loop cooling system 500, is also disposed on the shaft 878 forwardly of the third pump gear 876. The rotation of the third pump gear 876 rotates the shaft 878 which in turn actuates the water pump 516.

The counter-balance shaft 802 is supported by the cylinder block 56 in three positions. These positions correspond to the positions of the counter-balance shaft bearings 834. Having the counter-balance shaft 802 supported at a position between its ends reduces bending of the counter-balance shaft 802. This way, the counter-balance shaft 802 experiences mostly torsional forces. This torsion of the counter-balance shaft 802 is desired since it allows the counter-balance shaft 802 to act as a torsional damper for the components that it drives. A recess 880 has been made in the counter-balance shaft 802 in order to localize and enhance this torsional effect on the counter-balance shaft 802.

Figure 12:
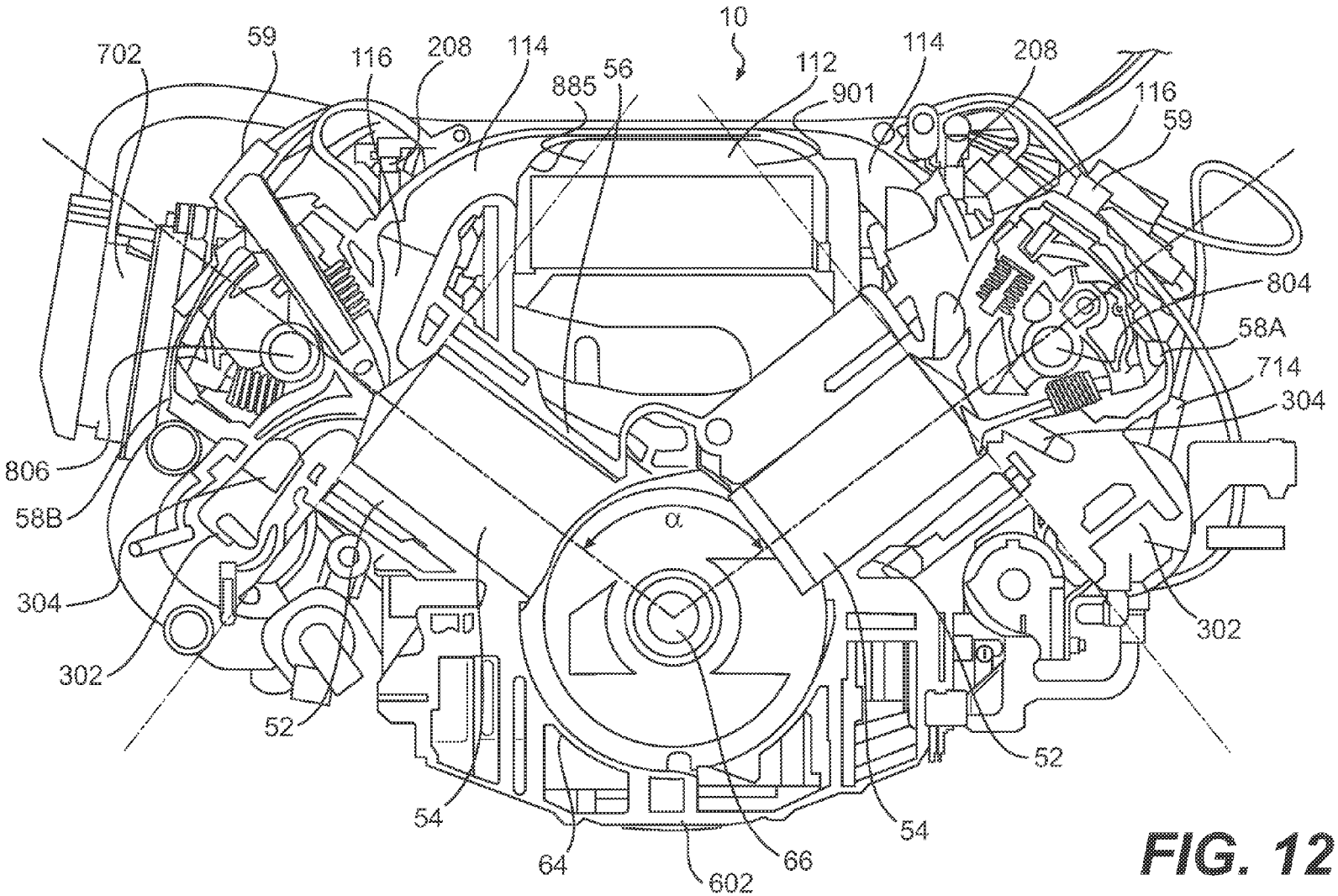
FIG. 12 is a transverse cross-section of the engine of FIG. 6.

As discussed above, the counter-balance shaft 802 has a counter-balance shaft driven gear 838 disposed at the rear end thereof which causes the counter-balance shaft 802 to be driven by the crankshaft 66. A first driving sprocket 882 is disposed on the counter-balance shaft 802 between the rearmost counter-balance shaft bearing 834 and the counter-balance shaft driven gear 838. The first driving sprocket 882 engages the timing chain 816 which engages a first driven sprocket 884 disposed on the right camshaft 806. The first driven sprocket 884 has a larger diameter than the first driving sprocket 882. A rear chain tensioner 832 of the type described in U.S. Pat. No. 6,626,140, which is incorporated herein by reference, applies a force on the bottom portion of the timing chain 816 to maintain an appropriate tension in the timing chain 816. A guide 886 disposed above the timing chain 816 maintains the alignment of the timing chain 816 with the sprockets 882, 884. The rotation of the first driven sprocket 884 causes the right camshaft 806 to rotate. The rotation of the right camshaft 806 operates the right valve operating assembly 888 of the type and in the manner described in U.S. Pat. No. 6,626,140 to operate the intake and exhaust valves of the right cylinder head assembly 58B. The hydraulic pump 41 is disposed co-axially with and is connected to the right camshaft 806 rearwardly of the first driven sprocket 884 such that it is actuated by the right camshaft 806. As such, a center of the hydraulic pump 41 is disposed above plane 885 (FIG. 12). The plane 885 is defined by the upper end of the right cylinder bank 52 which corresponds to the surface where the right cylinder head assembly 58B joins with the right cylinder bank 52.

A counterweight 890 (FIG. 45) is provided on the counter-balance shaft 802 forwardly of the foremost counter-balance shaft bearing 834. The counterweight 890 is sized and positioned to reduce the vibrations created by the rotation of the various components of the gearing system 800. A camshaft driving gear 892 is disposed on the counter-balance-shaft 802 forwardly of the counterweight 890. The camshaft driving gear 892 engages a camshaft driven gear 894 disposed to the left thereof and disposed on a shaft 896. A second driving sprocket 898 is disposed on the shaft 896 rearwardly of the camshaft driven gear 894 so as to rotate therewith. The second driving sprocket 898 engages the timing chain 812 which engages a second driven sprocket 900 disposed on the left camshaft 804. The second driven sprocket 900 has a larger diameter than the second driving sprocket 898. A front chain tensioner 820 of the type described in U.S. Pat. No. 6,626,140 applies a force on the bottom portion of the timing chain 812 to maintain an appropriate tension in the timing chain 812. A guide 902 disposed above the timing chain 812 maintains the alignment of the timing chain 812 with the sprockets 898, 900. The rotation of the second driven sprocket 900 causes the left camshaft 804 to rotate. It should be noted that the camshaft driving gear 892, the camshaft driven gear 894, the second driving sprocket 898, and the second driven sprocket 900 are sized such that the left camshaft 804 rotates at the same speed as the right camshaft 806. The rotation of the left camshaft 804 operates the left valve operating assembly 904 of the type and in the manner described in U.S. Pat. No. 6,626,140 to operate the intake and exhaust valves of the left cylinder head assembly 58A. The water pump 422 of the open-loop cooling system 400 is disposed co-axially with and is connected to the left camshaft 804 forwardly of the second driven sprocket 900 such that it is actuated by the left camshaft 804. As such, a center of the water pump 422 is disposed above plane 901 (FIG. 12). The plane 901 is defined by the upper end of the left cylinder bank 52 which corresponds to the surface where the left cylinder head assembly 58A joins with the left cylinder bank 52.

Figure 46:
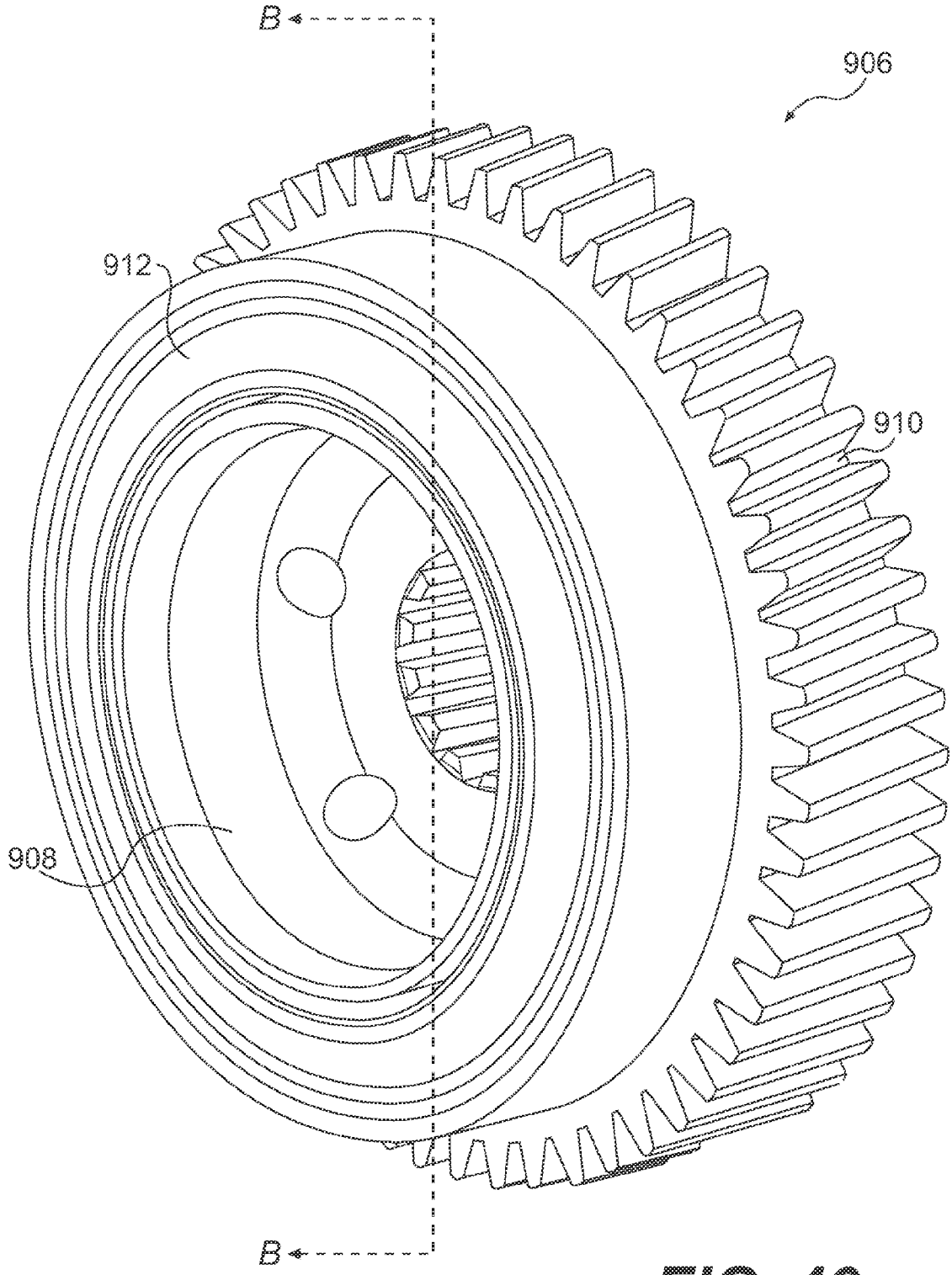
FIG. 46 is a perspective view, taken from a front, left side, of a coupling gear of the driveshaft assembly of FIG. 45.
Figure 47:
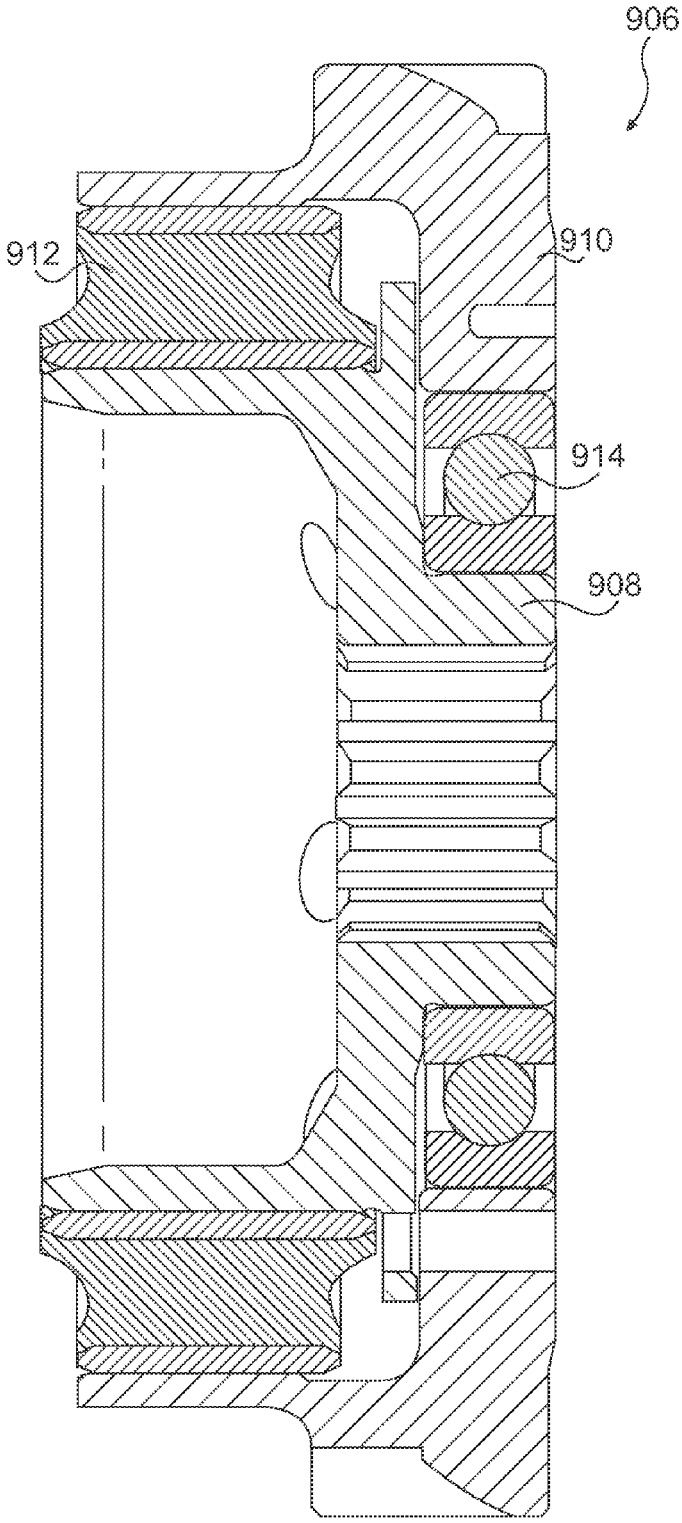
FIG. 47 is a cross-section view, taken through centerline B-B of the coupling gear of FIG. 46.

A coupling gear 906 is disposed on the counter-balance shaft 802 at the front thereof. As seen in FIGS. 46 and 47, the coupling gear 906 has a central splined portion 908, an external toothed portion 910, and an intermediate elastomeric portion 912. The central splined portion 908 engages the splined front end of the counterbalance shaft 802 so that the coupling gear 906 rotates with the counter-balance shaft 802. The intermediate elastomeric portion 912 is disposed between the external toothed portion 910 and the central splined portion 908 to provide some rotational damping. A bearing 914 is also provided at the back of the coupling gear 906 between the external toothed portion 910 and the central splined portion 908 to accommodate the partial rotation of the external toothed portion 910 relative to the central splined portion 908. The external toothed section 910 engages the gears adjacent to the coupling gear 906 to transmit power thereto.

Turning back to FIGS. 35 to 41, the coupling gear 906 engages gear 916 located to the left thereof and disposed on shaft 918. The gear 916 is disposed forwardly of the camshaft driven gear 894. The shafts 896 and 918 are co-axial, however the camshaft driven gear 894 and the gear 916 rotate independently from each other. That is to say that the camshaft driven gear 894 and the gear 916 rotate at different speeds. The gear 916 is coupled to an alternator driving gear 920 disposed forwardly thereof which is also disposed on the shaft 918. The alternator driving gear 920 engages an alternator driven gear 922 located to the left thereof and disposed on an alternator shaft 924. The alternator driven gear 922 causes the alternator shaft 924 to rotate, thus actuating the alternator 704. The coupling gear 906 also engages gear 926 located to the right thereof and disposed on shaft 928 to rotate therewith. A first supercharger screw 930 of the supercharger 108 is also disposed on and rotates with the shaft 928. A first supercharger gear 932 is also disposed on and rotates with the shaft 928 between the first supercharger screw 930 and the gear 926. The first supercharger gear 932 engages a second supercharger gear 934 located above and to the right thereof and disposed on shaft 936. A second supercharger screw 938 of supercharger 108 is also disposed on the shaft 936 forwardly of the second supercharger gear 934. The rotation of the second supercharger gear 934 causes the shaft 936 to rotate, which in turn rotates the second supercharger screw 938. It is contemplated that the diameters of gears 926, 932, and 934 could vary depending on the contemplated horsepower of the engine 10.

Although the engine 10 has described herein as being used in a stern drive engine/propulsion unit arrangement, it is contemplated that the engine 10 and/or features thereof could be used in other types of engine/propulsion unit arrangements, such as inboards and outboards. For example, to be used in an inboard, the engine 10 could be modified such that the output shaft 830 is coaxial with the crankshaft 66. This allows the driveshaft of the drive unit 40, which is usually lower in inboards than in stern drives, to be connected coaxially with the output shaft 830 and then to a jet propulsion unit or a propeller. In such an embodiment, the output shaft 830 and the crankshaft 66 could integrally formed as a single shaft, but could also be two distinct shafts. It should be understood that such a modification may not be necessary depending on the height of the driveshaft of the drive unit 40 or if a mechanism external to the engine 10, such as gears or pulleys, are used to connect the output shaft 830 to the driveshaft.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A boat comprising:

a hull;

a deck disposed on the hull, the deck having a deck floor;

at least one engine disposed in the hull, a top of the at least one engine being disposed vertically below the deck floor, the at least one engine including:

a crankcase;

a crankshaft disposed in the crankcase for rotation therewithin;

a first cylinder bank connected to the crankcase; and a second cylinder bank connected to the crankcase, the first cylinder bank and the second cylinder bank being disposed at an angle relative to each other;

a transom extending generally vertically upwardly from a rear portion of the hull;

a stern drive unit connected to the transom and operatively connected to the at least one engine through the transom; and an exhaust pipe in fluid communication with the at least one engine, a portion of the exhaust pipe extending vertically above the deck floor between the transom and a back wall of the deck.

2. The boat of claim 1, wherein the at least one engine further includes:

an output shaft driven by the crankshaft; and a driveshaft coupling disposed on the output shaft for operatively coupling a driveshaft of the stern drive unit, wherein the output shaft is disposed vertically above the crankshaft.

3. The boat of claim 1, further comprising at least two auxiliary units selected from a group consisting of a counterbalance shaft, an output shaft, a water pump, a hydraulic pump, a first oil pump, a second oil pump, and a supercharger;

wherein the at least two auxiliary units are gear driven from the crankshaft.

4. The boat of claim 1, wherein the angle is greater than 90 degrees.

5. The boat of claim 4, wherein the angle is less than 150 degrees.

6. The boat of claim 5, wherein the angle is approximately 105 degrees.

7. The boat of claim 1, wherein a distance from a bottom of the at least one engine to the top of the at least one engine is less than 510 mm.

8. The boat of claim 7, wherein the distance from the bottom of the at least one engine to the top of the at least one engine is less than or equal to 475 mm.

9. The boat of claim 8, wherein the deck floor is approximately 35 mm above the top of the at least one engine.

10. The boat of claim 1, further comprising an intercooler disposed between the first and second cylinder banks.

11. The boat of claim 1, further comprising a supercharger disposed at a front of the at least one engine.

12. The boat of claim 11, further comprising a counterbalance shaft driven by the crankshaft, wherein the supercharger is driven by the counter-balance shaft.

13. A marine engine comprising:

a crankcase;

a cylinder block connected to the crankcase;

a crankshaft disposed in the crankcase for rotation therewithin;

an output shaft disposed vertically above the crankshaft, the output shaft being disposed at least partially internal to the engine for rotation therewithin;

a drive operatively connected to the crankshaft and the output shaft to transmit power from the crankshaft to the output shaft, the drive being disposed internal to the engine; and a driveshaft coupling disposed on the output shaft for operatively coupling a driveshaft of a propulsion unit.

14. The marine engine of claim 13, further comprising at least two auxiliary units selected from a group consisting of a counter-balance shaft, the output shaft, a water pump, a hydraulic pump, a first oil pump, a second oil pump, and a supercharger, wherein the at least two auxiliary units are gear driven from the crankshaft.

15. The marine engine of claim 13, wherein the drive includes:

a first gear disposed on the crankshaft; and a second gear disposed on the output shaft, wherein the first gear engages the second gear to transmit power from the crankshaft to the output shaft.

16. The marine engine of claim 15, further comprising a flywheel disposed on the crankshaft, the flywheel having a diameter, wherein the diameter of the flywheel is less than a sum of a diameter of the first gear and a diameter of the second gear.

17. The marine engine of claim 16, further comprising a starter ring gear disposed on the crankshaft adjacent the flywheel, the starter ring gear having a diameter, wherein the diameter of the starter ring gear is less than a sum of the diameter of the first gear and the diameter of the second gear.

18. The marine engine of claim 16, further comprising a protective cover disposed over a bottom portion of the flywheel.

19. The marine engine of claim 13, further comprising:

a flywheel disposed on a first end portion of the crankshaft; and a rotating mass disposed on a second end portion of the crankshaft opposite the first end.

20. The marine engine of claim 13, further comprising a pair of cylinder banks disposed at an angle relative to each other.

21. A boat comprising:

a hull;

a deck disposed on the hull, the deck having a deck floor;

two engines disposed in the hull, each of the engines being disposed on a different side of a longitudinal centerline of the hull, a top of each of the engines being disposed vertically below the deck floor, each of the engines including:

a crankcase;

a crankshaft disposed in the crankcase for rotation therewithin;

an output shaft driven by the crankshaft, the output shaft being disposed vertically above the crankshaft, the output shaft being horizontally offset from the crankshaft towards the longitudinal centerline of the hull;

a driveshaft coupling disposed on the output shaft;

a first cylinder bank connected to the crankcase; and a second cylinder bank connected to the crankcase, the first cylinder bank and the second cylinder bank being disposed at an angle relative to each other;

a transom extending generally vertically upwardly from a rear portion of the hull; and two stem drive units connected to the transom, each stem drive unit being operatively connected to a corresponding one of the engines through the transom, a driveshaft of each stern drive unit being operatively coupled to a corresponding one of the driveshaft couplings.

* * * * *